US012534909B2

(12) United States Patent
Matlin et al.

(10) Patent No.: US 12,534,909 B2
(45) Date of Patent: Jan. 27, 2026

(54) SYSTEM AND METHOD OF RECONFIGURING A MODULAR WALL

(71) Applicant: FELLOWES, INC., Itasca, IL (US)

(72) Inventors: Tai Hoon K. Matlin, Round Lake Beach, IL (US); Shawn M. Applegate, Streamwood, IL (US); Michael Egan, Chicago, IL (US); James Edward Losser, St. Charles, IL (US)

(73) Assignee: FELLOWES, INC., Itasca, IL (US)

( * ) Notice: Subject to any disclaimer, the term of this patent is extended or adjusted under 35 U.S.C. 154(b) by 245 days.

(21) Appl. No.: 18/203,175

(22) Filed: May 30, 2023

(65) Prior Publication Data

US 2023/0392372 A1 Dec. 7, 2023

Related U.S. Application Data

(60) Provisional application No. 63/347,742, filed on Jun. 1, 2022.

(51) Int. Cl.
*E04B 2/74* (2006.01)
*E04B 2/02* (2006.01)

(52) U.S. Cl.
CPC ..... *E04B 2/74* (2013.01); *E04B 2/02* (2013.01); *E04B 2002/0243* (2013.01); *E04B 2002/7487* (2013.01)

(58) Field of Classification Search
CPC ..... E04B 2/74; E04B 2/7448; E04B 2/745; E04B 2002/7496; E04B 2002/7492;
(Continued)

(56) References Cited

U.S. PATENT DOCUMENTS 3,292,328 A 12/1966 Lewis et al.
3,562,978 A 2/1971 Ali-Oglu
(Continued)

FOREIGN PATENT DOCUMENTS

CA 2516083 C 3/2013
CN 205776919 U 12/2016
(Continued)

OTHER PUBLICATIONS

International Search Report and Written Opinion issued in International Application No. PCT/US2023/023844, dated Sep. 21, 2023.

*Primary Examiner* — Theodore V Adamos
(74) *Attorney, Agent, or Firm* — Pillsbury Winthrop Shaw Pittman, LLP

(57) ABSTRACT

A method of reconfiguring a modular wall is provided. The modular wall comprises a panel receiver structure with a panel receiving channel; a vertical panel received in the channel of the panel receiver structure; and a first and second fascia trim members. Each of the first and second fascia trim members is configured to be removably attached to opposing first and second sides of the panel receiver structure. The fascia trim members are configured to conceal the panel receiver structure. The method comprises removing at least the second fascia trim member; positioning a second panel receiver structure on the second side of the panel receiver structure, the second panel receiver structure having a second panel receiving channel; positioning a second vertical panel in the second panel receiving channel to be parallel to the vertical panel; and re-installing the removed second fascia trim member to the second panel receiver structure.

10 Claims, 36 Drawing Sheets

(58) Field of Classification Search
CPC .. E04B 2/7424; E04B 2/02; E04B 2002/7462; E04B 2002/7487; E04B 2002/0243; E06B 1/40; E06B 3/28
See application file for complete search history.

(56) References Cited

U.S. PATENT DOCUMENTS

| | | | | |
|---|---|---|---|---|
| 4,858,405 | A * | 8/1989 | Christie | E06B 3/44 52/476 |
| 5,802,789 | A | 9/1998 | Goodman et al. | |
| 5,806,258 | A | 9/1998 | Miedema et al. | |
| 5,852,904 | A | 12/1998 | Yu et al. | |
| 6,112,485 | A | 9/2000 | Beyer et al. | |
| 6,244,002 | B1 | 6/2001 | Martin | |
| 6,301,846 | B1 | 10/2001 | Waalkes et al. | |
| 6,418,671 | B1 | 7/2002 | DeRuiter et al. | |
| 6,493,995 | B2 | 12/2002 | McKenzie | |
| 6,688,056 | B2 | 2/2004 | Von Hoyningen Huene et al. | |
| 6,883,277 | B2 | 4/2005 | Wiechecki et al. | |
| 7,845,384 | B2 | 12/2010 | Goodman et al. | |
| 8,601,749 | B2 | 12/2013 | Von Hoyningen Huene et al. | |
| 8,613,168 | B2 | 12/2013 | Von Hoyningen Huene et al. | |
| 9,249,567 | B2 | 2/2016 | Yu et al. | |
| 9,284,729 | B2 | 3/2016 | Von Hoyningen Huene et al. | |
| 9,593,481 | B2 | 3/2017 | Gosling et al. | |
| 9,650,785 | B2 | 5/2017 | Yu et al. | |
| 9,765,518 | B2 | 9/2017 | Von Hoyningen Huene et al. | |
| 9,803,361 | B2 | 10/2017 | Von Hoyningen Huene et al. | |
| 9,816,269 | B2 | 11/2017 | Glick et al. | |
| 9,920,522 | B2 * | 3/2018 | Staten | E04B 2/7809 |
| RE46,929 | E | 7/2018 | Gosling et al. | |
| 10,053,858 | B2 | 8/2018 | Kopish et al. | |
| 10,136,724 | B2 | 11/2018 | Smed | |
| RE47,693 | E | 11/2019 | Gosling et al. | |
| 10,760,273 | B1 | 9/2020 | Alexander | |
| 10,920,418 | B2 | 2/2021 | Gosling et al. | |
| 10,927,545 | B2 | 2/2021 | Von Hoyningen Huene et al. | |
| 2009/0109575 | A1 | 4/2009 | McCoy-Deedler | |
| 2020/0308830 | A1 * | 10/2020 | Lee | E04B 2/828 |
| 2021/0172168 | A1 | 6/2021 | Von Hoyningen Huene et al. | |
| 2021/0363750 | A1 * | 11/2021 | Picchio | E04B 2/821 |
| 2022/0364359 | A1 | 11/2022 | Gosling et al. | |

FOREIGN PATENT DOCUMENTS

| | | | | |
|---|---|---|---|---|
| CN | 110056104 | A | 7/2019 | |
| DE | 1753816 | A1 | 10/1973 | |
| DE | 102004054430 | A1 | 5/2006 | |
| EP | 2161387 | A2 | 3/2010 | |
| EP | 2199481 | A2 * | 6/2010 | E04B 2/825 |
| EP | 2754810 | A2 | 7/2014 | |
| EP | 3034710 | A1 | 6/2016 | |
| FR | 2326546 | A1 | 4/1977 | |
| FR | 2625244 | A1 | 6/1989 | |
| GB | 2312451 | B2 | 10/1997 | |
| GB | 2510750 | A | 8/2014 | |
| IT | 201800009673 | A1 | 4/2020 | |
| KR | 10-1223751 | B1 | 1/2013 | |
| WO | 2000024981 | A1 | 5/2000 | |
| WO | 2010124832 | A2 | 11/2010 | |
| WO | 2021119167 | A1 | 6/2021 | |

* cited by examiner

Minimal Profile (A&D Focus)

Height Adjustable Profile

*framing and adjusting prior to handling heavy glass - leveling and positioning glass works well prior to finishing stage

*finished assembly pictures of adjustable profile with dual glass with reutilized Clear Wall door

SYSTEM AND METHOD OF RECONFIGURING A MODULAR WALL

This application claims the benefit under 35 USC 119(e) of prior U.S. Provisional Patent Application Ser. No. 63/347,742, filed Jun. 1, 2022, which is hereby incorporated by reference in its entirety.

BACKGROUND

Field

The present patent application relates to modular walls or modular wall systems, and particularly a system and a method of reconfiguring a modular wall.

Description of Related Art

Architectural wall systems (also called modular wall systems) are designed to easily subdivide open spaces into offices, conferences rooms and open spaces using prefabricated components. Because they are designed to be put up and taken down and that they add no additional stability to the building itself (that is, they are not load bearing walls), they are utilized to save time during the remodeling and construction phases by architects and contractors along with interior designers.

Architectural wall systems may take either a stick-built approach, where most of the work may be done on-site typically using aluminum extrusions cute to size and assembled along with locally acquired glass or solid panels, or alternatively, may use unitized walls. The unitized walls may be wall sections that have been preassembled off-site at a factory or a manufacturing facility with the final placement of the preassembled sections into wall runs are done on-site. These types of systems are attractive to architects and designers since they emulate the look of finished walls and are sold to them as being flexible and modular to the point of being re-usable.

The materials used in these walls systems may vary but may typically include glass, aluminum, steel, and a variety of wall panel materials such as gypsum, fiberboard, hardboard to name a few. Since the user of these types of systems desire them to emulate finished walls, they may span from floor to ceiling and assemble with seams and gaps being minimalized as to create the desired "clean" look. To obtain that clean and finished appearance with minimized seams, gaps within an installation that has varied ceiling heights, and non-plumb walls, non-squared walls typifying the majority of installations, these wall systems may require the components to be sized and/or cut for a particular positional placement within the wall run. Plumb wall may generally refer to walls that are not completely or precisely vertical. Once the wall system's components and subcomponents are cut to size, they become limited in their re-usability elsewhere since they have been re-sized for a particular position within the installation. The reuse or reconfiguration of an installed system's components are hampered since much of the time, damage to the finished parts occur during the dismantling process as well. Due to these types of adjustments and alterations as well as others, the actual promise of a cost advantage of re-usability and modularity has been diminished by the installation requirements and certain on-site adjustments, making it more difficult and more costly for the customer to use modularly than initially perceived during the purchasing process.

During the installation processes, many of the aluminum parts are cut and or adjusted on-site for a particular dimensional requirement to present a finished look. The current state of the art wall systems may use components within their assemblies that function as a structural element and a finish visual element, meaning portions of these parts are exposed as to be exposed and visible after assembly and therefore the look of these parts as to not be marred, scratched, nicked, dented, bent is very important. Since the current state of the art (prior art) modular wall systems may use these types of components, shipping, on-site handling and cutting and assembly is precarious, and it is quite common to damage key value elements causing costs to increase and timelines to be pushed out.

Furthermore, there may be a requirement for very specialized training and specialized installers for these wall systems due to their complexity and to mitigate the risks associated to the handling, cutting, fitting, adjusting, and assembling of these structural parts with exposed finished surfaces. This specialized training is costly, and the skill set requirement, due to the integral design of many of the components involved with the constructing of the wall are structural but have outward facing finished surfaces making handling and cutting errors impossible to recover from so these expensive components cannot be used causing material cost increases and wall construction delays. Due to the aforementioned reasons creating additional strains on the cost, time, and value models, much of the reason that these types of wall systems are sold as being advantageous are not fully met or realized.

As stated, current state of the art wall systems have deficiencies of practical versus theoretical or severely limited realization of reusability, modularity, configurability, and on-site re-configurability including upgrading and changing looks over time. The present patent application endeavors to provide improvements in the architectural wall systems.

SUMMARY

In one embodiment of the present patent application, a method of reconfiguring a modular wall is provided. The modular wall comprises a panel receiver structure with a panel receiving channel; a vertical panel received in the channel of the panel receiver structure; and a first and second fascia trim members. Each of the first and second fascia trim members is configured to be removably attached to opposing first and second sides of the panel receiver structure. The fascia trim members are configured to conceal the panel receiver structure. The method comprises removing at least the second fascia trim member; positioning a second panel receiver structure on the second side of the panel receiver structure, the second panel receiver structure having a second panel receiving channel; positioning a second vertical panel in the second panel receiving channel to be parallel to the vertical panel; and re-installing the removed second fascia trim member to the second panel receiver structure.

These and other aspects of the present patent application, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise. In addition, as used in the specification and the claims, the term "or" means "and/or" unless the context clearly dictates otherwise. It should also be appreciated that some of the components and features discussed herein may be discussed in connection with only one (singular) of such components, and that additional like components which may be disclosed herein may not be discussed in detail for the sake of reducing redundancy.

Other aspects, features, and advantages of the present patent application will become apparent from the following detailed description, the accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which FIGS. 1A-1F show front cross-sectional views of a double panel low profile configuration, a single panel low profile configuration, a single panel height adjustable configuration, a double panel height adjustable configuration, a triple panel height adjustable configuration, and a double panel height adjustable configuration with a privacy shade/panel configuration, respectively;

FIGS. 3A-3C show perspective views of a single panel height adjustable configuration, a double panel height adjustable configuration, and another (e.g., thicker/solid) single panel height adjustable configuration, respectively, FIG. 3D shows a partial perspective view of the modular wall where additional floor members being added to reconfigure the modular wall, and FIG. 3E shows a cross-sectional view of another modular wall with a corner joint;

FIGS. 7A-7D show that the same panel receiver structure and the same wall/floor support member of the modular wall may be used interchangeably used on the wall and/or the floor of the modular wall;

18A shows a low profile configuration with one panel, FIG. 18B shows a low profile configuration with two panels, FIG. 18C shows a height adjustable profile configuration with one panel and FIG. 18D shows a height adjustable profile configuration with two panels, FIG. 18A, FIG. 18B, FIG. 18C and FIG. 18D also show an adjustable façade mount and a panel bracket;

FIG. 24 shows various adjustment positions of the low profile modular wall;

FIG. 26 shows exemplary in-line connections, corner connections, and T-connections used in the modular walls;

FIG. 28A, FIG. 28B and FIG. 28C show front cross-sectional views of a double panel configuration, a single panel configuration, a single panel configuration with outserts, respectively, FIG. 28A, FIG. 28B and FIG. 28C also show a cross-sectional view of an additional space in the modular wall that is configured to receive electrical components;

DETAILED DESCRIPTION OF THE DRAWINGS

The present patent application provides a re-configurable modular wall system 100 with framing/structural elements and finishing elements and a method 200 of reconfiguring a modular wall 102. The system 100 and the method 200 address assembly efficiency and upgradeability by separating the framing/structural elements and the assembly thereof with the finishing elements. Other additional elements will be disclosed throughout the present patent application as compared to the current state of the art and prior art in this category of products. Modular, as used herein, may be configured to provide the degree to which components of wall system may be separated and recombined so as to provide flexibility and variety in use.

Figure 1A:
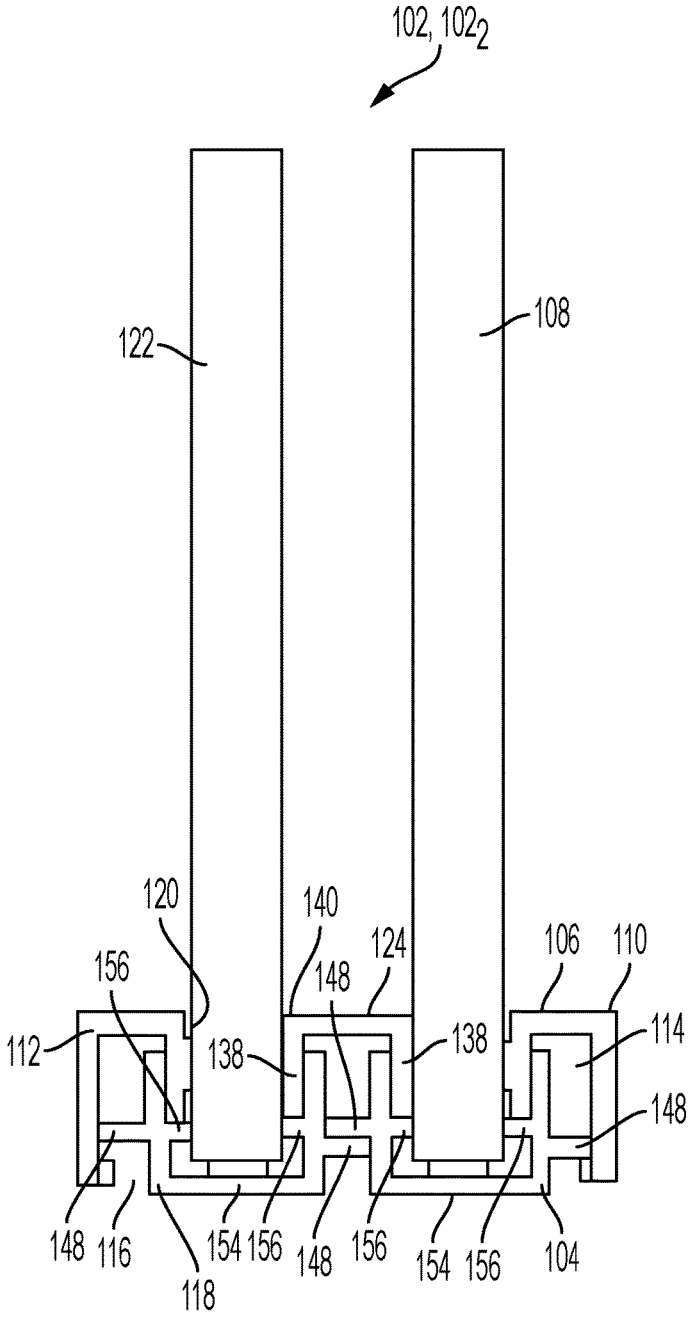
FIGS. 1A-F show various exemplary configurations of a modular wall that may be easily reconfigured between these configurations in accordance with an embodiment of the present patent application, where
Figure 1B:
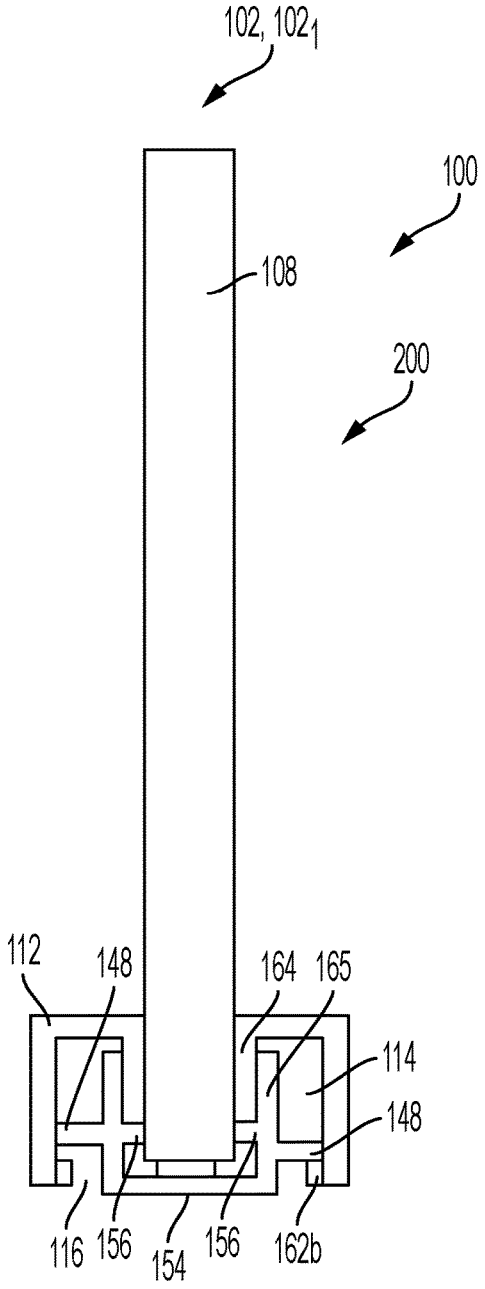
Figure 1C:
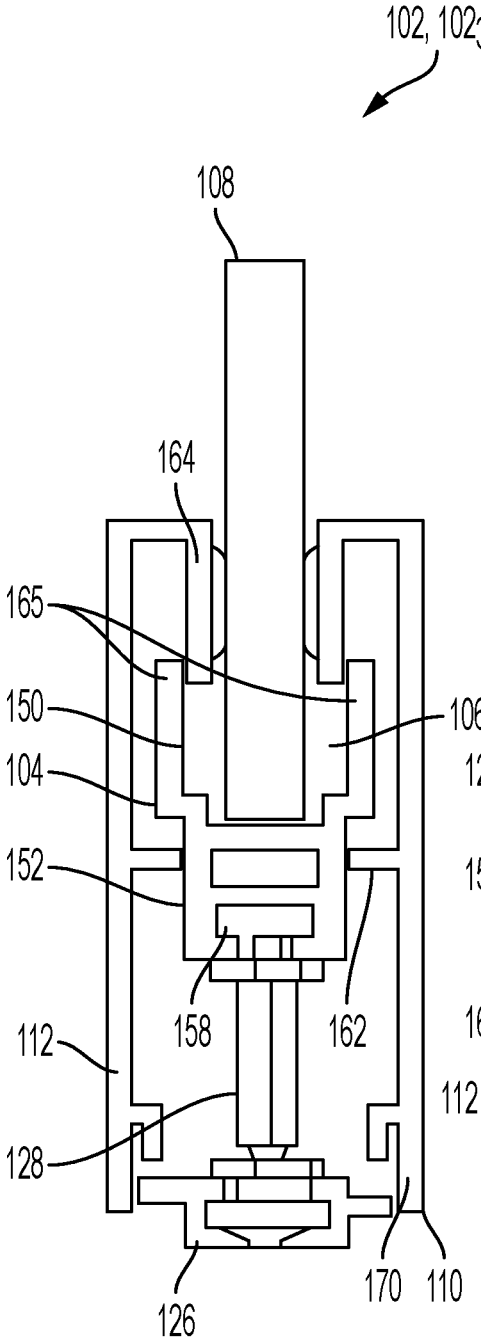
Figure 1D:
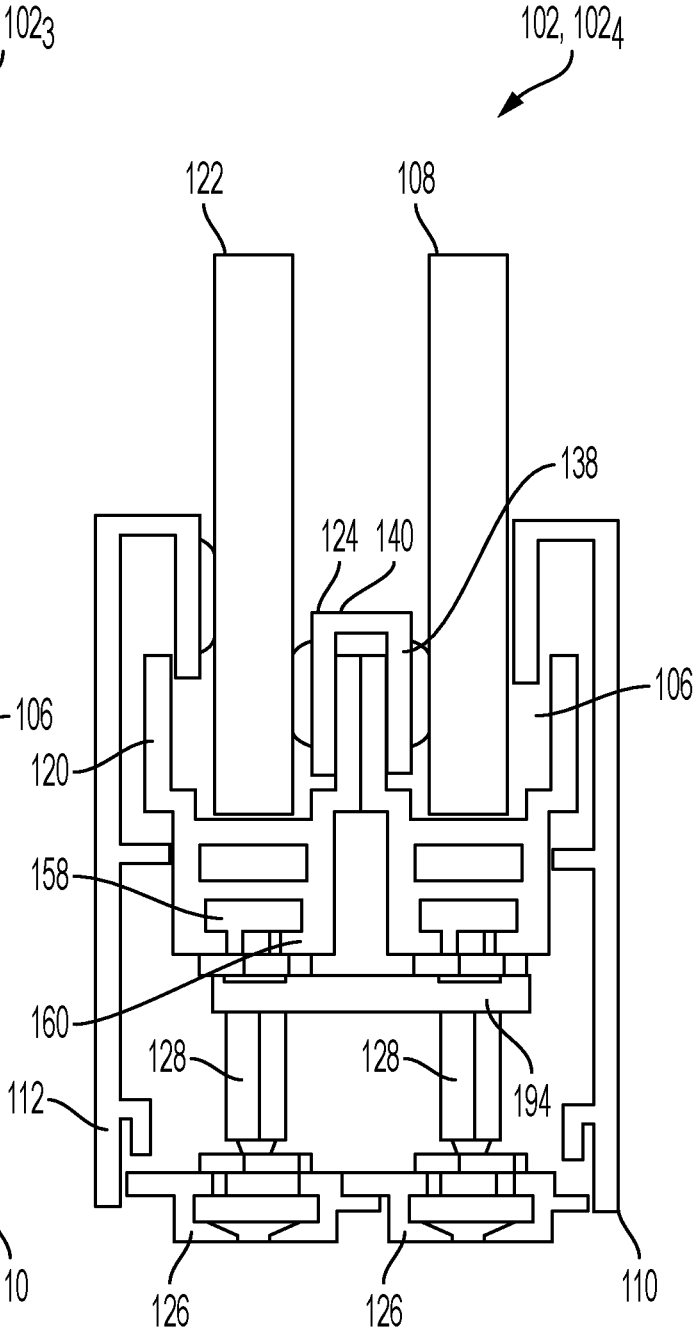
Figure 1E:
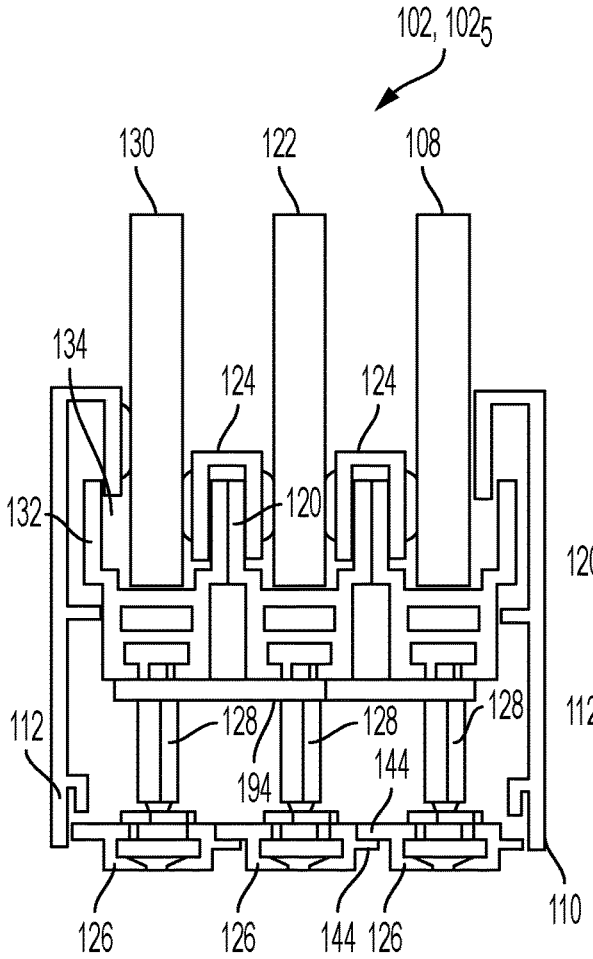
Figure 1F:
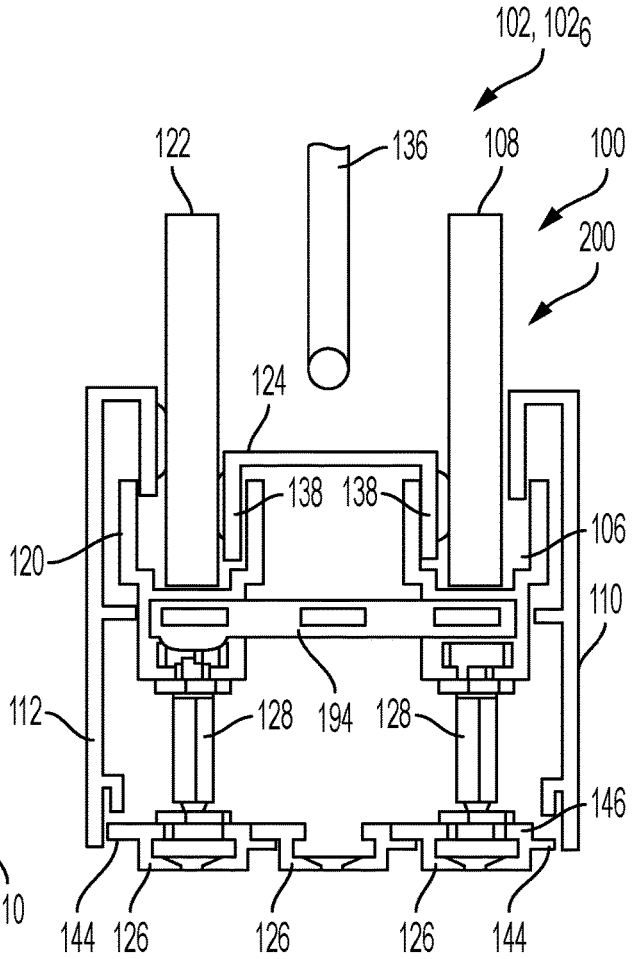

FIGS. 1A-1F shows the system 100 and the method 200 of reconfiguring the modular wall 102. The modular wall 102 may have many different configurations and may be modular wall $\mathbf{102}_1$ (as shown in FIG. 1B), $\mathbf{102}_2$ (as shown in FIG. 1A), $\mathbf{102}_3$ (as shown in FIG. 1C), $\mathbf{102}_4$ (as shown in FIG. 1D), $\mathbf{102}_5$ (as shown in FIG. 1E), and $\mathbf{102}_6$ (as shown in FIG. 1F).

The modular wall 102 may comprise a panel receiver structure 104 with a panel receiving channel 106; a vertical panel 108 received in the channel 106 of the panel receiver structure 104; and a first and second fascia trim members 110, 112. Each of the first and second fascia trim members 110, 112 is configured to be removably attached to opposing first and second sides 114, 116 of the panel receiver structure 104. The fascia trim members 110, 112 are configured to conceal the panel receiver structure 104.

A wall or a modular wall, may generally made up of a few wall sections. Each wall section may typically include its own frame parts, panel(s), trim, etc.

The system 100 may also include a second panel receiver structure 118 having a second panel receiving channel 120, and a second vertical panel 122 that may be configured to be received in the second panel receiving channel 120 of the second panel receiver structure 118. As shown in FIG. 1E, the system 100 may further include a third panel receiver structure 132 having a third panel receiving channel 134, and a third vertical panel 130 that may be configured to be received in the third panel receiving channel 134 of the third panel receiver structure 134. The second and third panel receiver structures 118, 132 may have the same shape, structure and configuration as the first panel receiver structure 104, the second and third vertical panels 122, 130 may have the same shape, structure and configuration as the first vertical panel 108, and the second and third panel receiving channels 120, 134 may have the same shape, structure and configuration as the first panel receiving channel 106, and, therefore, the first panel receiver structure 104, the first panel receiving channel 106, and the first vertical panel 108 may be described in detail below.

The modular walls $\mathbf{102}_1$ and $\mathbf{102}_2$, as shown in FIGS. 1A and 1B, are in their low profile configuration. This low profile configuration may be used for the ceilings, for example. That is, the modular walls $\mathbf{102}_1$ and $\mathbf{102}_2$ may not have height adjustment units 128 (as shown in and described with respect to FIGS. 1C-F). In the low profile configuration, as there is no height adjustment unit, the panel may be sized for location. The modular wall $\mathbf{102}_1$ of FIG. 1B may be configured to support one panel 108, while the modular wall $\mathbf{102}_2$ of FIG. 1A may be configured to support two panels 108 and 122. This configuration may in non-limiting embodiments, use spacers and/or wedges to adjust the height of the panel when used as a floor run.

The modular walls $102_3$-$102_6$, as shown in FIGS. 1C-1F, are in their adjustable height profile configuration. The modular walls $102_3$-$102_6$, as shown in FIGS. 1C-1F, may be configured to support one panel 108, two panels 108 and 122, three panels 108, 122, and 130, and two panels 108 and 122 with a privacy shade/panel 136.

Each of the modular walls $102_3$, $102_4$, $102_5$, and $102_6$ have one or more height adjustment units 128. For example, one height adjustment unit 128 may be positioned between the panel receiver structure and the corresponding floor/wall track 126 as will be described in detail below.

The panel receiver structure 104 may interchangeably be referred to as framing/structural element of the re-configurable modular wall system. The panel receiver structure 104 may also be interchangeably referred to as floor adjustment interface, wall adjustment interface, ceiling adjustment interface, etc.

The panel receiver structure 104 (by itself or along with some other structural elements of the re-configurable modular wall system, such as wall/floor/ceiling track or track members 126, height adjustment units 128, etc. that will be described in detail in the discussions below) may be configured to provide structural support to the vertical panel 108 received in the channel 106 of panel receiver structure 104. The panel receiver structure 104 may be formed of any suitable material, e.g., metal (e.g., aluminum or steel) or plastic and can be formed as an extrusion or by molding.

The panel receiver structure 104 may have different shapes or configurations. For example, the panel receiver structures 104, 118 shown in FIGS. 1A and 1B have different shapes or configurations than the panel receiver structures 104, 118 shown in FIGS. 1C-1F.

The panel receiver structure 104 of the low profile modular walls $102_1$ or $102_2$ (shown in FIGS. 1A and 1B) is configured to not only receive the vertical panel 108 in the channel 106 of the panel receiver structure 104 but also serve as ceiling/wall/floor track. The ceiling/wall/floor track may be interchangeably referred to as ceiling/wall/floor track member. In such an embodiment, portions 154 of a side (opposing the side of the channel 106) of the panel receiver structure 104 may be configured to engage portions of the floor/wall.

Each of the panel receiver structures 104, 118 in FIGS. 1A and 1B may have outwardly extending portions 148 thereon. The outwardly extending portions 148 may be round or elliptical in one embodiment. The outwardly extending portions 148 may be outwardly extending in the wall thickness or depth direction. As shown in FIG. 1B, the outwardly extending portions 148 may be configured to engage with portions of the first or second fascia trim members 110, 112 so as to removably attach the first and second fascia trim members 110, 112 to opposing first and second sides 114, 116 of the panel receiver structure 104.

The outwardly extending portions 148 may be positioned on both sides of the panel receiver structures 104, 118. In one embodiment, portion 148 on one side of the panel receiver structure 104 may be disposed higher or lower than portion 148 on the other side of the panel receiver structure 104. As shown in FIG. 1A, this configuration enables the outwardly extending portion 148 of one of the panel receiver structures 104, 118 be positioned either above or below and in an overlapping relationship with the outwardly extending portion 148 of the other/adjacent of the panel receiver structures 104, 118 when the panel receiver structures 104, 118 are positioned adjacent to each other to receive two panels 108 and 122 therein.

The panel receiver structures 104, 118 in FIGS. 1A and 1B may also have inwardly extending portions 156 (e.g., extending into the channel 106 or 120). The inwardly extending portions 156 may be extending in the wall thickness or depth direction. The inwardly extending portions 156 may be configured to support portions of the first or second fascia trim members 110, 112 thereon when the first and second fascia trim member 110, 112 are removably attached to the opposing first and second sides 114, 116 of the panel receiver structures as shown in FIG. 1B.

As shown in FIG. 1A, the inwardly extending portions 156 of the first panel receiver structure 104 may be configured to support a leg 138 of a connector member 124 (e.g., the connector member 124 may be configured to connect panel receiver structures 104, 118, and will be described in detail in the discussions below) on one/left side of the panel 108 and support portions of the first fascia trim member 110 on the other/right side of the panel 108. Also, as shown in FIG. 1A, the inwardly extending portions 156 of the second panel receiver structure 118 may be configured to support the (other) leg 138 of the connector member 124 on one/right side of the panel 122 and support portions of the second fascia trim member 112 on the other/left side of the panel 122.

As shown in FIGS. 1A and 1B, the panel receiving structure 104 may include the vertical facing channel 106 and the vertical panel 108 is received in the vertical facing channel 106. The panel 108 may be referred to as the "vertical" panel when the panel is being used to form the modular "walls."

The panel receiver structures 104, 118 of the adjustable height profile modular walls $102_3$ and $102_4$ (shown in FIGS. 1C and 1D) may be configured to be connected to portions (e.g., upper portions) 158 of a height adjustable unit 128 (will be described in detail in the discussions below). In such an embodiment, portions 160 on a side (opposing the side of the channel 106, 120) of the panel receiver structures 104, 118 may be configured to engage the portions 158 of the height adjustable unit 128.

The panel receiver structures 104, 118 of the adjustable height profile modular walls $102_3$ and $102_4$ (shown in FIGS. 1C and 1D) may also have two portions, the larger portion 150 may include the channel 106, 120 and the smaller portion 152 may include the portions 158 that engage/connect with the height adjustable unit 128. As shown in FIG. 1C, the outer walls of the smaller portion 152 may be configured to engage with portions 162 of the fascia trim members 110, 112.

As will be clear from the discussions throughout this application, the removably attachable configuration of the framing elements, including the panel receiving structures 104, the height adjustment units 128, the floor/wall tracks 126, connector members 124, enables reconfiguration of the modular wall 102 between the modular wall configurations $102_1$ of FIG. 1B, $102_2$ of 1A, $102_3$ of FIG. 1C, $102_4$ of FIG. 1D, $102_5$ of FIG. 1E, and $102_6$ of FIG. 1F.

FIGS. 1A-1F shows the panel receiver structures and/or other framing elements (e.g., the height adjustment units, the wall/floor tracks, connectors, etc.) at only one end of the modular wall 102. This may be the case in some designs that may not have retention at the ceiling (e.g., walls that go part way up). However, the framing elements may be generally positioned on both opposing ends of the modular wall 102 (e.g., as shown in FIGS. 17A-17B and FIGS. 18A-18D). The framing elements, positioned on both opposing ends of the modular wall 102, may have the same configuration. The framing elements, positioned on both opposing ends of the modular wall 102, may have different configurations. In one embodiment, the height adjustment units may be generally positioned in the lower/floor framing elements and may not be used in the framing elements on the ceiling.

The panel receiving channel 106 of the panel receiver structure 104 may have a U-shaped configuration. The panel receiving channel 106 may have other shaped configurations. The panel receiving channel 106 and the vertical panel 108 received therein may have complimentary shapes. The panel receiving channel 106 may be sized and configured to receive the vertical panel 108 therein.

The panel receiving channel 106 may also be sized and configured to receive either portions (e.g., portions of legs 138) of the connector member 124 and/or portions of the first and second fascia trim members 110, 112 therein along with the vertical panel 108.

Referring to FIG. 1D, the portions of the connector member 124 may be received by the panel receiving channel 106 on one/left side of the panel 108 and portions of the first fascia trim member 110 may be partially received by the panel receiving channel 106 on the other/right side of the panel 108. Referring to FIG. 1D, the portions of the connector member 124 may be received by the panel receiving channel 120 on one/right side of the panel 122 and portions of the second fascia trim member 112 may be partially received by the panel receiving channel 106 on the other/left side of the panel 122.

Portions of the first and second fascia trim members 110, 112 may be partially received in the corresponding channels (as shown in FIGS. 1C-1F) or completely received in the corresponding channels (as shown in FIGS. 1A-1B). In FIG. 1E, the second panel receiving channel 120 may be configured to receive the vertical panel 122 and portions of the connector member 124 (on both sides of the vertical panel 122) therein. The portions of the connector member 124 and/or the portions first and second fascia trim members 110, 112, received in the channel and disposed on sides of the vertical panel, may be configured to support, cushion or stabilize the vertical panel received in that channel.

The floor/wall track 126 may be interchangeably referred to as floor base. The floor/wall track 126 may be a vertical stile for corner attachment, a vertical stile for wall attachment, a vertical stile for wall adjustment, a ceiling track/member, etc. Stile may be one of the vertical members in the frame or panel into which the secondary members are fitted. The floor/wall track 126 may include a ceiling/floor/wall engaging portion that may be configured to engage the ceiling/floor/wall.

Referring to FIGS. 1C-1F, the floor/wall track 126 may have a fascia trim engaging member 144 and a height adjustment unit engaging member 146 (e.g., configured to engaged with the height adjustment unit 128 as will be clear from the discussions in detail below). The fascia trim engaging member 144 may be configured to extend outwardly from the floor/wall track 126 so as to engage with the fascia trim members 110, 112. The fascia trim engaging member 144 may be optional.

The fascia trim engaging member 144 may be configured to serve as and may be interchangeably referred to as floor/wall track engaging portion. The floor/wall track engaging portion may be positioned on positioned on both sides (e.g., one side portion being higher/lower than the other side portion) of the floor/wall track such that, when the floor/wall track is being connected to or engaged with an adjacent floor/wall track as in FIG. 1E, the floor/wall track engaging portion of one of the floor/wall track 126 may be positioned either above or below and in an overlapping relationship with the floor/wall track engaging portion of the other/adjacent of the floor/wall track 126.

The low profile configuration modular walls $\mathbf{102}_1$ and $\mathbf{102}_2$ do not have a separate ceiling/floor/wall track. That is, the panel receiving members of the modular walls $\mathbf{102}_1$ and $\mathbf{102}_2$ may be configured to serve as the ceiling/floor/wall track in the low profile configuration. The panel receiving member may have the panel receiving channel on one side thereof and the ceiling/floor/wall engaging portion on the other/opposing side thereof. The ceiling/floor/wall engaging portion of the panel receiving member may be configured to engage the ceiling/floor/wall so as to enable the panel receiving member to serve as the ceiling/floor/wall track.

The modular walls $\mathbf{102}_3$-$\mathbf{102}_6$ may have one or more height adjustment units 128. For example, the modular wall $\mathbf{102}_3$ may have the height adjustment unit 128 between the panel receiver structure 104 and the floor/wall track 126. The modular wall $\mathbf{102}_4$ may have two height adjustment units 128, one between the panel receiver structure 104 and the floor/wall track 126 and another one between the panel receiver structure 118 and the floor/wall track 126. Similarly, the modular wall $\mathbf{102}_5$ may have three height adjustment units between the panel receiver structures and the floor/wall tracks, while the modular wall $\mathbf{102}_6$ may have two height adjustment units (e.g., positioned in spaced apart configuration) between the panel receiver structures and the floor/wall tracks.

Figure 15:
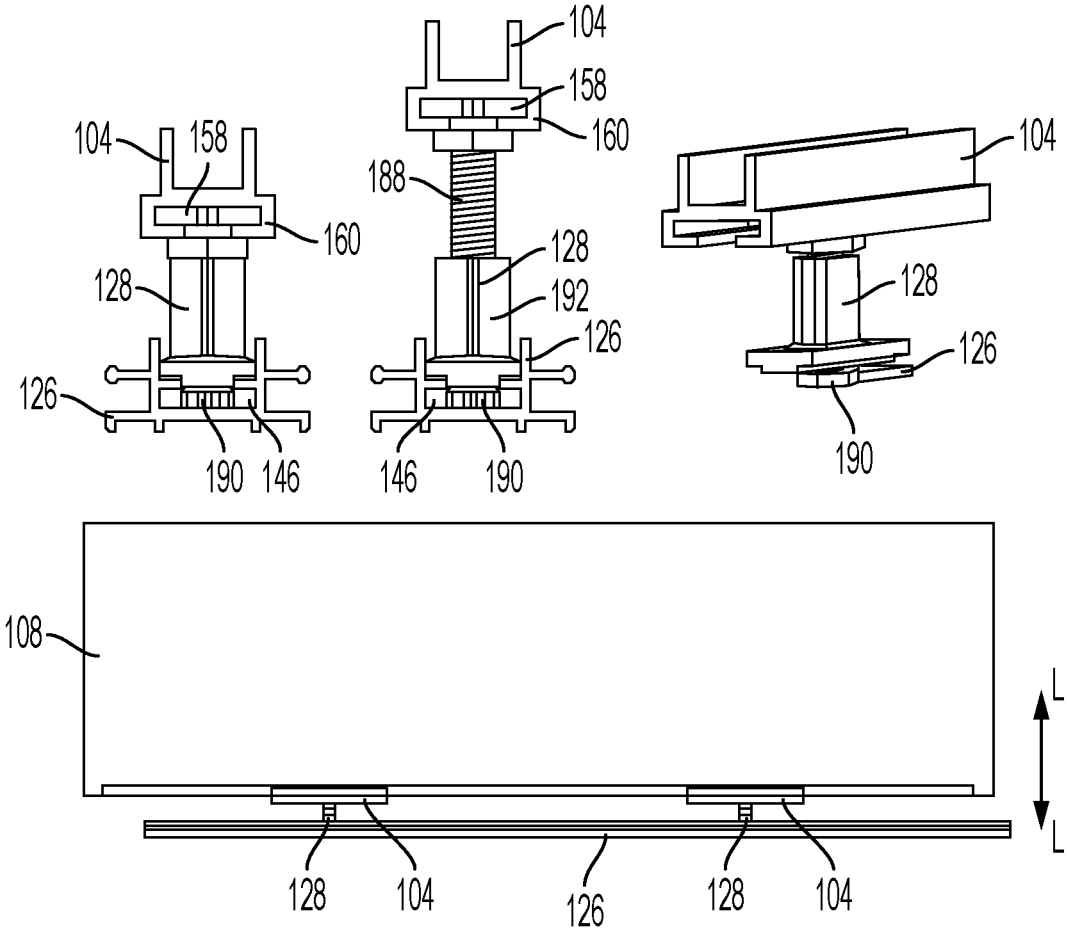
FIG. 15 shows a perspective view and two cross-sectional views of a height adjustment mechanism of the modular wall in accordance with an embodiment of the present patent application, where the two cross-sectional views show the height adjustment mechanism in a retracted configuration and an extended configuration, respectively, and where FIG. 15 also shows a front view of the modular wall with the height adjustment mechanisms.
Figure 16:
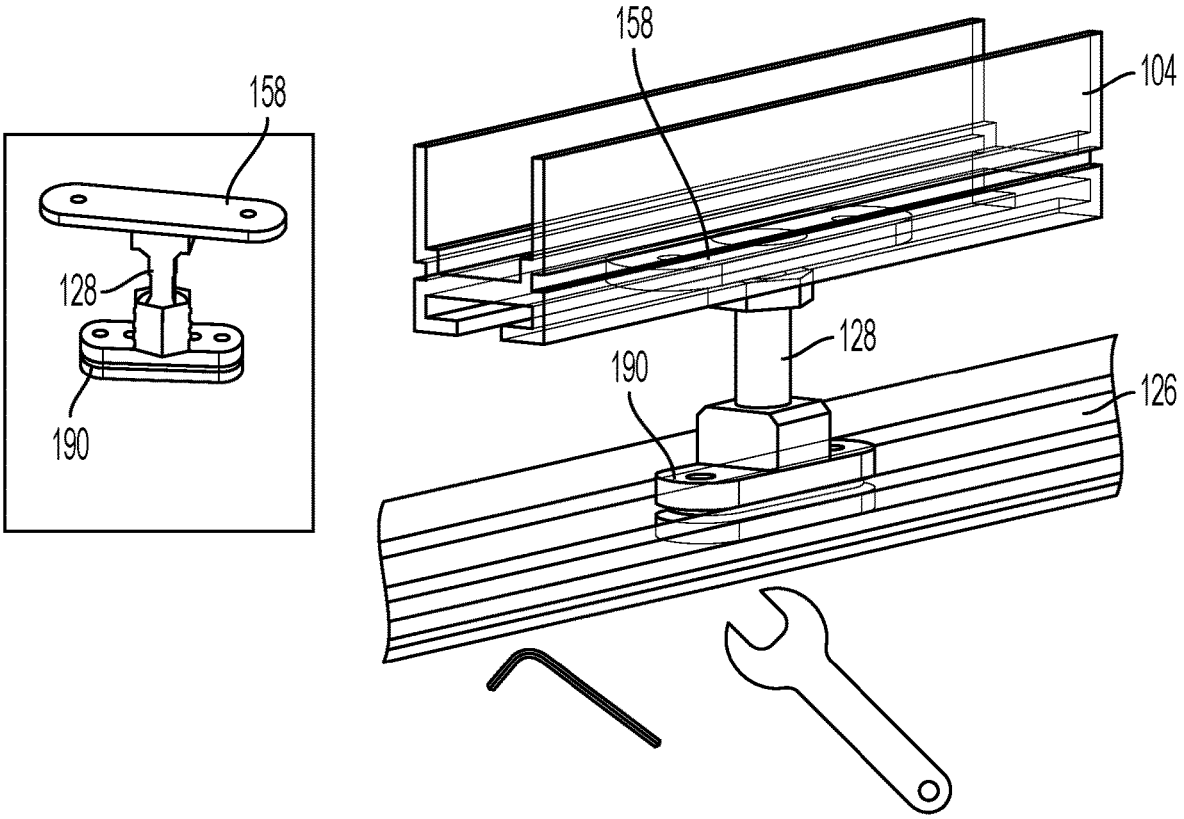
FIG. 16 shows a perspective view of the height adjustment mechanism of the modular wall in accordance with an embodiment of the present patent application, where FIG. 16 also shows a perspective view of the modular wall with the height adjustment mechanisms.

Referring to FIGS. 15 and 16, the height adjustment unit 128 may include two opposing end portions 158 and 190, one end portion 158 may be configured to engage or (e.g., fixedly) connect with the panel receiving structure 104 and the other end portion 190 may be configured to engage or (e.g., fixedly) connect with the floor/wall track 126. The panel receiving member 104 may have the panel receiving channel 106 on one side thereof and a height adjustment unit engaging portion 160 on the other/opposing side thereof. That is, the height adjustment unit engaging portion 160 may be configured to receive, engage or (e.g., fixedly) connect with portions (e.g., upper portions) 158 of the height adjustment unit 128.

The floor/wall track 126 may have floor/wall engaging portion on one side thereof and a height adjustment unit engaging portion 146 on the other/opposing side thereof. The height adjustment unit engaging member 146 of the floor/wall track 126 may be configured to receive, engage or (e.g., fixedly) connect with portions (e.g., lower portions) 190 of the height adjustment unit 128.

The opposing end portions 158 and 190 of the height adjustment unit 128 may have elongated configuration to enable the height adjustment unit 128 to be introduced and moved along the tracks of the panel receiving member 104 and the floor/wall track 126. The panel receiving member 104 and the floor/wall track 126 may have elongated track configuration. One or more the height adjustment unit 128 may be configured to be fixed/locked at spaced locations of the panel receiving member 104 and the floor/wall track 126. The height adjustment unit 128 may be configured to provide an adjustment range of 0.75 inches or more.

FIG. 15 shows an extended and a retracted position of the height adjustment unit 128. The height adjustment unit 128 may include a lead screw 188 threaded to a nut 192 for relative longitudinal movement (along the direction of L-L) of the panel receiving member 104 with respect to the floor/wall track 126 so as to adjust the height of the panel receiving member 104 and the panel 108 received therein. In one embodiment, the height adjustment unit may be referred to as a height adjuster and the height adjuster may contact the floor/ground directly.

As shown in FIGS. 1D-1F, the system 100 may also include one or more support links 194 that are configured to connect the newly added height adjustment units 128 and the existing height adjustment unit 128. For example, the support link 194, in FIG. 1D, may be configured to connect two height adjustment units 128; the support link 194, in FIG. 1E, may be configured to connect three height adjustment units 128; and the support link 194, in FIG. 1F, may be configured to connect two height adjustment units 128 that are spaced apart from each other. The support link(s) may be configured to provide robust connections in the modular wall.

The system 100 may include the connector member 124 that may be configured to be attached to the first and second panel receiver structures 104, 118. The connector member 124 may be configured for (e.g., removably) connecting the first and second receiver structures 104, 118. The connector members 124 may be a clip 124 configured for engaging with each inside wall of the first and second upwardly facing channels 106, 120.

The system 100 may also include similar connector member 124 configured to be attached to the second and third panel receiver structures 132, 118. The connector member 124 may be configured for connecting the third and second panel receiver structures 132, 118. The connector members 124 may be a clip 124 configured for engaging with each inside wall of the first and second upwardly facing channels 134, 120.

The connector member/clip 124 may have an inverted U-shaped configuration, with two legs 138 extending from a bight portion 140. Referring to FIGS. 1A and 1F, when the clip 124 is connecting the adjacent panel receiver structures, at least a portion of the legs 138 are being received in the channels of the adjacent panel receiver structures with the bight portion 140 positioned adjacent to (upper portions of) the sides/walls of the channel. For example, as shown in FIGS. 1A and 1F, at least a portion of the legs 138 are being received in the channels 106, 120 of the adjacent panel receiver structures 104, 118 such that inner surface of each leg is configured to engage with each inside wall of the first and second upwardly facing channels 106, 120. The same configuration of the connector member/clip 124 may also be seen in FIGS. 1D and 1E.

In FIG. 1F, the adjacent panel receiver structures 104, 118 of the modular wall $\mathbf{102}_6$ are positioned spaced apart so as to accommodate the privacy panel 136 therebetween. The clip 124, in FIG. 1F, has an elongated bight portion to accommodate the spaced configuration of the modular wall $\mathbf{102}_6$. The elongated bight portion 140 of the clip 124 in FIG. 1F may be seen by comparing the clip 124 in FIG. 1F with the clips 124 in FIGS. 1A, 1D and 1E. The connector member/clip 124 may have other shaped configurations that are configured to engage and connect the adjacent panel receiver structures.

The connector member 124 may be formed of any suitable material, e.g., metal or plastic, and can be formed as an extrusion or by molding. The connector member 124 may be formed of a flexible or resilient material.

The panel receiving members, the height adjustment units, and the floor/wall track/track member, the connectors in the modular walls $\mathbf{102}_3$ and $\mathbf{102}_4$ may be referred to as the structural or framing elements of the modular walls $\mathbf{102}_3$ and $\mathbf{102}_4$.

The panel 108 may interchangeably be referred to as planar structure, wall panel, etc. In one embodiment, the panel may include any suitable chemically-strengthened glass, thermal tempered glass, heat strengthened glass, annealed glass, soda lime glass, or glass ceramic, etc. The panel 108 may be a translucent panel. The translucent panel may be glass panel. The translucent, as used herein, may include transparent, frosted, or tinted. In another embodiment, the panel 105 may be made of (e.g., really high end) plastic material. The panel 108, in other configurations, may be a solid wall 109 as shown in FIGS. 2A-2C, 3C and 3E.

The system 100 may be configured to add one or two additional panels (e.g., panels 122 and 130) to the modular wall 102. For example, the modular walls $\mathbf{102}_2$ in FIG. 1A and $\mathbf{102}_4$ in FIG. 1D have two panels 108 and 122, while the modular wall $\mathbf{102}_5$ in FIG. 1E has three panels 108, 122 and 130 and the modular wall $\mathbf{102}_6$ in FIG. 1F has two panels 108 and 122 with the privacy screen/panel 136. The number of panels that may be added to the modular wall may vary.

The sound transmission class (STC) may generally be a single number rating scale that measures a wall, ceiling, or floor assembly's ability to block sound transmission. The modular walls $\mathbf{102}_2$, $\mathbf{102}_4$, $\mathbf{102}_5$, and $\mathbf{102}_6$ (e.g., having two or more panels) generally have higher sound transmission class than the modular walls $\mathbf{102}_1$ and $\mathbf{102}_3$ (e.g., having a single panel).

Figure 8:
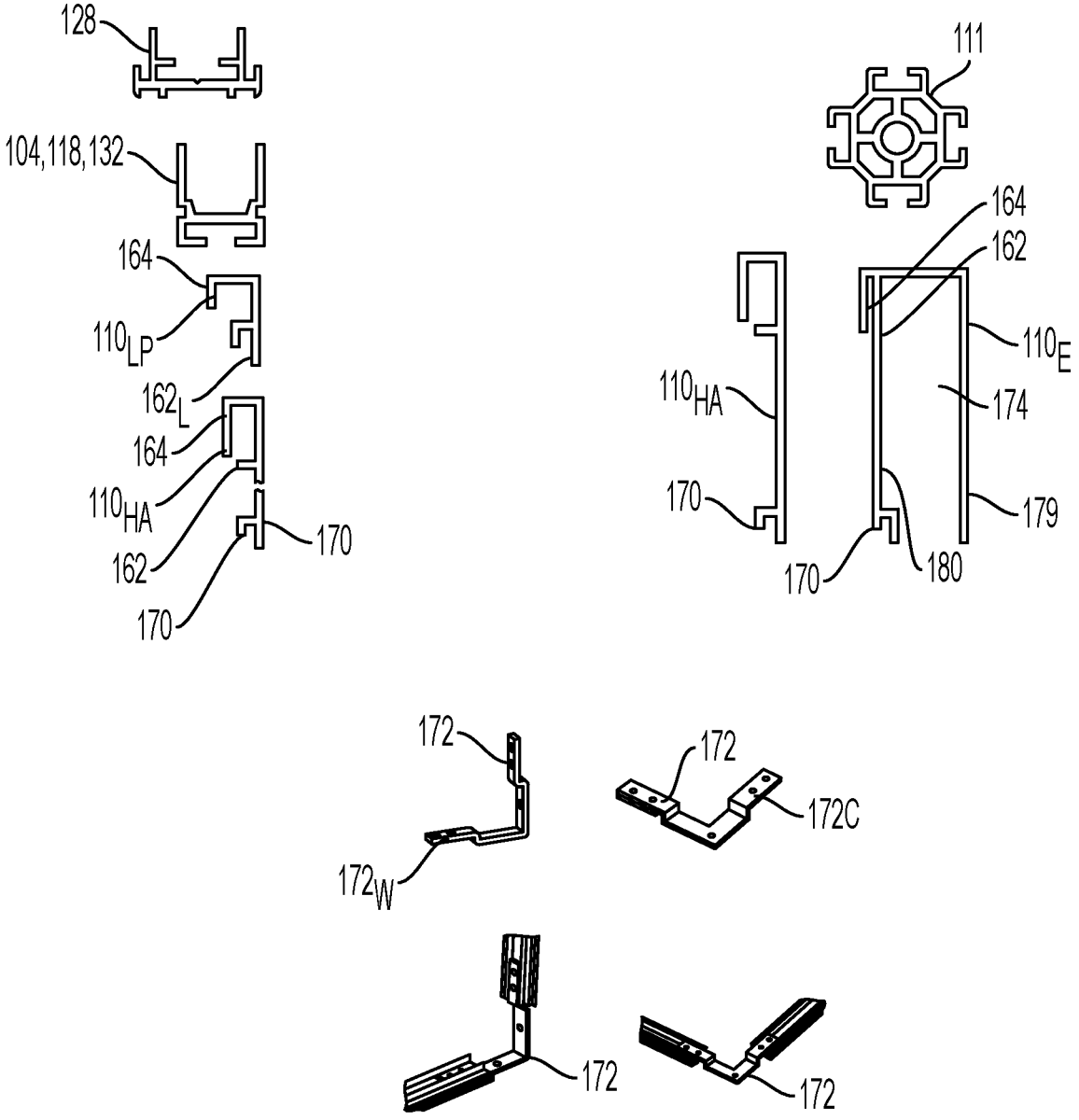
FIG. 8 shows various components/parts/members that may be used with/in the modular wall in accordance with an embodiment of the present patent application.
Figure 9:
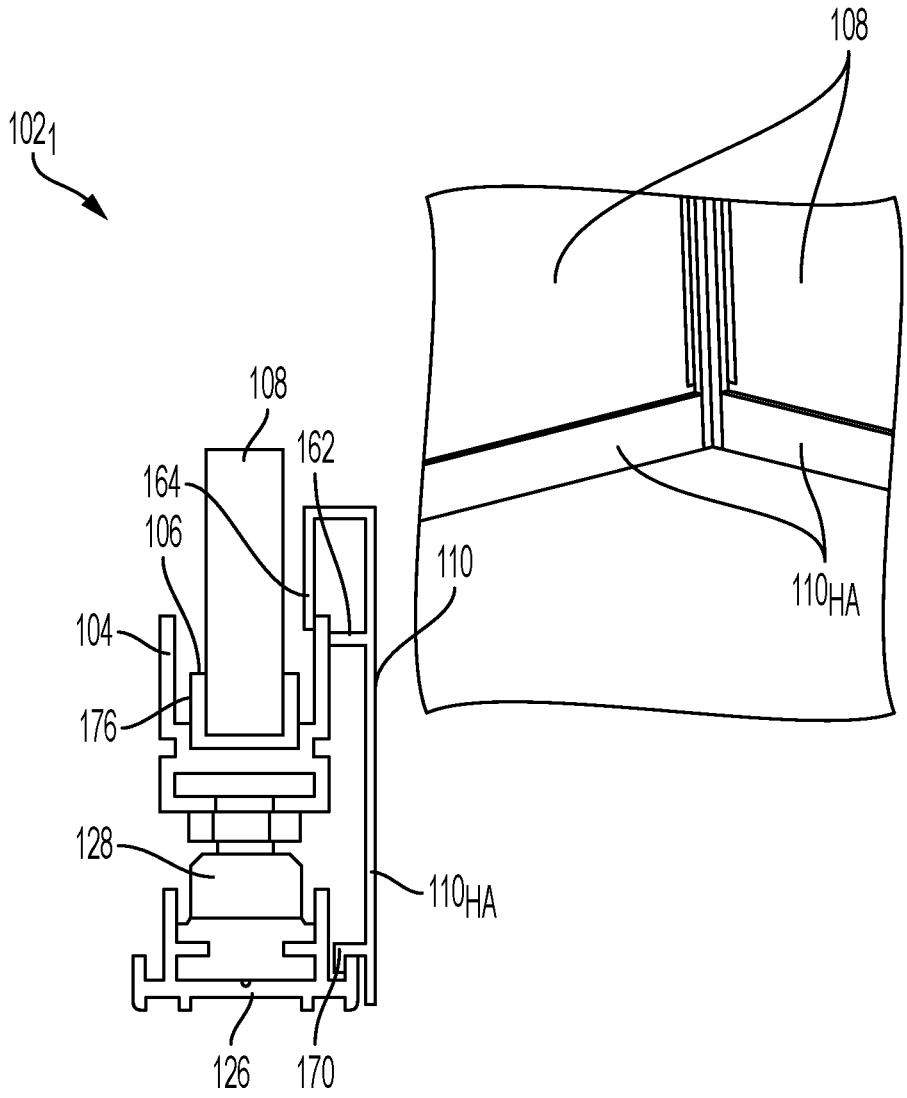
FIG. 9 shows a partial cross-sectional view and a partial perspective view of a modular wall using a standard façade/fascia trim member in accordance with an embodiment of the present patent application.

As shown in FIG. 8, the system 100 may also include other connector brackets 172 that are used to provide floor to ceiling connections, corner connections, door jamb, etc. in the modular walls. The connector brackets 172 may include wall (i.e., floor and ceiling) connector bracket $\mathbf{172}_W$, corner (i.e., floor and ceiling) connector bracket 172*c*, etc. FIG. 8 shows perspective view of the connector brackets $\mathbf{172}_W$, $\mathbf{172}_C$ and in their installed configurations. For example, these brackets may be used to connect two wall/floor/ceiling tracks. In the low profile configuration, these brackets may be used to connect two panel receiving members.

The first and second fascia trim members 110, 112 may interchangeably be referred to as finishing or finish elements of the re-configurable modular wall system. The fascia trim member may be interchangeably referred to as façade or outer covering.

The fascia trim member may be base/floor façades, ceiling façades and vertical/wall façades. The fascia trim member may be configured to be easily removable and upgraded. The fascia trim member may include accents on an outer surface thereof. The outer surfaces of the fascia trim member may be configured to have different patterns, designs, colors, etc. to match with the preferences of the user or of the office space.

The removably attachable configuration of the fascia trim members 110, 112 of the modular wall 102 (along with reconfigurable framing elements) enables reconfiguration of the modular wall 102 between the modular wall configurations $\mathbf{102}_1$ of FIG. 1B, $\mathbf{102}_2$ of 1A, $\mathbf{102}_3$ of FIG. 1C, $\mathbf{102}_4$ of FIG. 1D, $\mathbf{102}_5$ of FIG. 1E, and $\mathbf{102}_6$ of FIG. 1F.

The first and second fascia trim members 110, 112 may be formed of any suitable material, e.g., metal, plastic or a combination thereof, and can be formed as an extrusion or by molding.

As shown in FIGS. 1C and 1B, each of the first and second fascia trim members 110, 112 may include portions 164 configured to connect or engage with portions 165 of the panel receiver structure 104, 118 so as to removably attach the first and second fascia trim members 110, 112 to opposing first and second sides 114, 116 of the panel receiver structure 104, 118.

The first and second fascia trim members 110, 112 of the low profile configuration modular walls $\mathbf{102}_1$ and $\mathbf{102}_2$ in FIGS. 1A and 1B may have different sizes and configurations compared to the first and second fascia trim members 110, 112 of the adjustable height profile configuration modular walls $\mathbf{102}_3$-$\mathbf{102}_6$ in FIGS. 1C-1F.

For example, the fascia trim members 110, 112 in FIGS. 1C-1F are taller than those in FIGS. 1A-1B. This taller configuration of the fascia trim members 110, 112 in FIGS. 1C-1F may be configured to accommodate the adjustable height configuration of the modular walls $\mathbf{102}_3$-$\mathbf{102}_6$ in FIGS. 1C-1F, while the shorter configuration of the fascia trim members 110, 112 in FIGS. 1A-1B may be configured to correspond to the lower profile configuration of the modular walls $\mathbf{102}_1$-$\mathbf{102}_2$.

Also, the fascia trim members 110, 112 in FIGS. 1C-1F may be configured to engage with the panel receiver members at more than one location (e.g., see portions 164 and 162) and also to engage with the floor/wall track 126 (e.g., see portion 170).

As the low profile modular walls $\mathbf{102}_1$-$\mathbf{102}_2$ do not have separate floor/wall tracks 126, the fascia trim members 110, 112 of the low profile modular walls $\mathbf{102}_1$-$\mathbf{102}_2$ in FIGS. 1A-1B may be configured to engage with the panel receiver members at more than one location (e.g., see portions 164 and 162). FIG. 8 shows another low profile fascia trim members $\mathbf{110}_{LP}$ that may be used in the low profile modular walls $\mathbf{102}_1$-$\mathbf{102}_2$ in FIGS. 1A-1B. The low profile fascia trim members $\mathbf{110}_{LP}$ may be referred to as minimal or compact floor façade. The low profile fascia trim members $\mathbf{110}_{LP}$ may also be used vertical façade for corners.

Portions (e.g., 162, 162L, 164, 170) of the fascia trim members may be configured to engage or interengage with portions of the floor/wall tracks and/or portions of the panel receiving structures so as to removably attach the fascia trim members to the modular wall. These portions (e.g., 162, 162L, 164, 170) of the fascia trim members may have any shape or configuration as long as they are configured to removably attach the fascia trim members to the modular wall.

The fascia trim member may have many different shaped and configurations. Referring to FIG. 8, the fascia trim member may be a low profile fascia trim member $\mathbf{110}_{LP}$, an adjustable height fascia trim member $\mathbf{110}_{HA}$, an electrical fascia trim member $\mathbf{110}_E$, etc. The adjustable height fascia trim member $\mathbf{110}_{HA}$ may be used as a floor façade and/or as a vertical façade against the wall.

Figure 10:
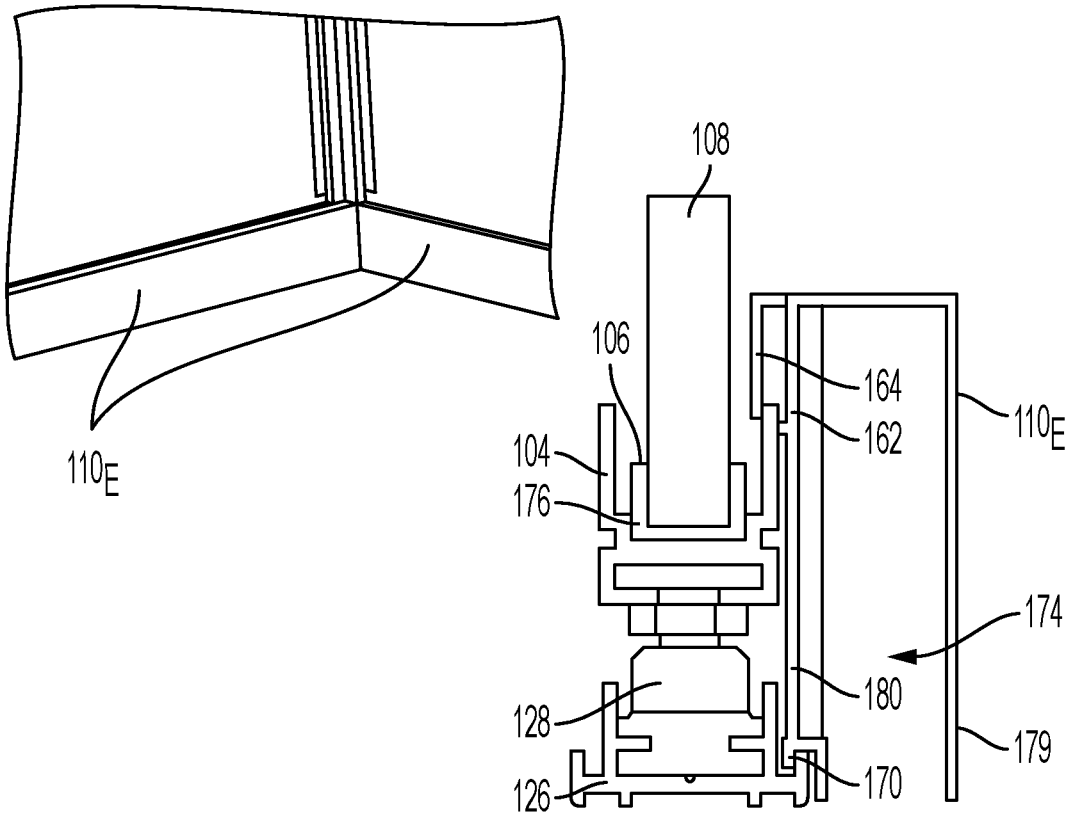
FIG. 10 shows a partial cross-sectional view and a partial perspective view of a modular wall using an electrical façade/fascia trim member in accordance with an embodiment of the present patent application, FIG. 10 also shows various electrical components that may be accommodated by the electrical façade/fascia trim member.
Figure 10:
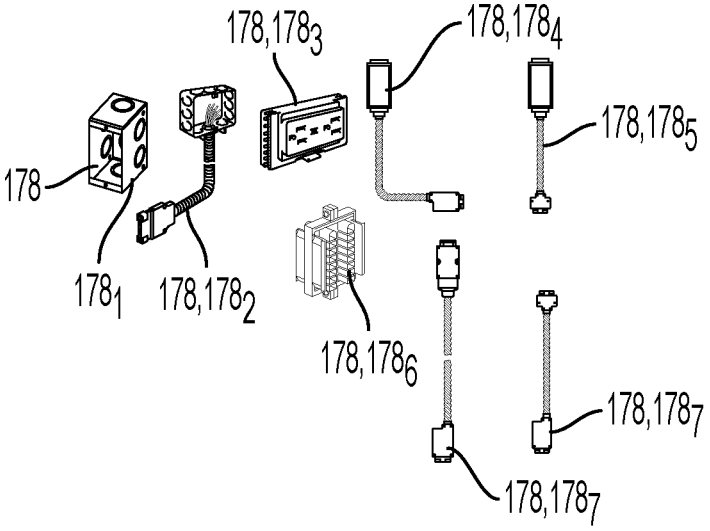

Referring to FIGS. 8 and 10, the electrical fascia trim member $\mathbf{110}_E$ may include a compartment or space 174 that may be configured to receive modular electrical solutions and/or contractor installed electrical solutions 178 (e.g., including hardware box unit $\mathbf{178}_1$, ceiling feed $\mathbf{178}_2$, power duplex $\mathbf{178}_3$, power module $\mathbf{178}_4$, work height adder power module $\mathbf{178}_5$, end block $\mathbf{178}_6$, pass through harness $\mathbf{178}_7$, male-male harness $\mathbf{178}_8$, or other standard electrical components). That is, the electrical components may be added to the modular wall post installation of the framing elements as an upgrade. The compartment or space 174 may be formed by portions/walls 179, 180 of the electrical fascia trim member $\mathbf{110}_E$. As shown in FIG. 10, the portions 164 and 162 of the fascia trim member $\mathbf{110}_E$ may be configured to engage on two opposing sides (e.g., inner and outer) of the wall of the channel 106 and the portion 170 of the fascia trim member 110 may be configured to engaged with portions of the floor/wall tracks 126 so as to removably attach the fascia trim member $\mathbf{110}_E$ to the panel receiver member 104 and/or the floor/wall track 126.

Figure 11:
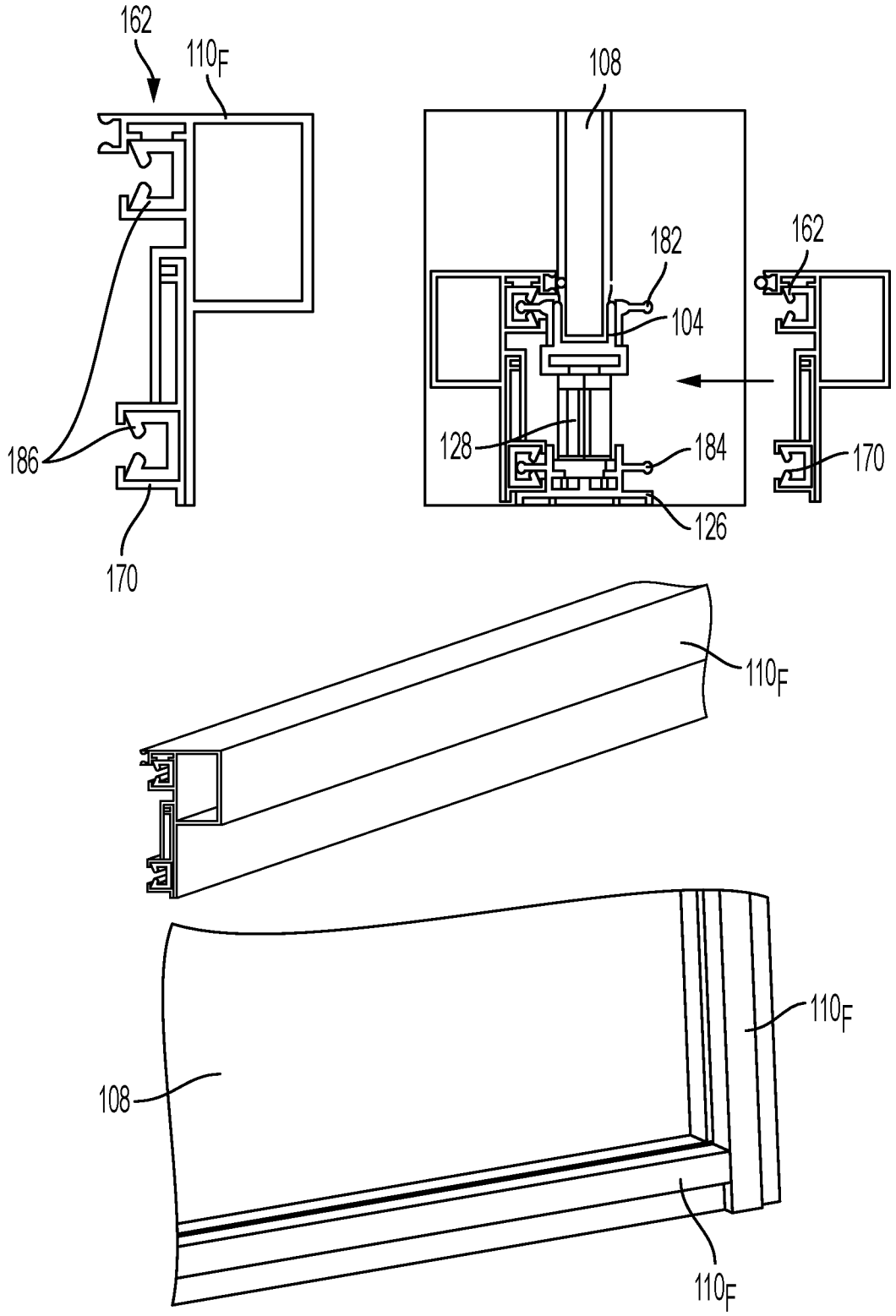
FIG. 11 shows a partial cross-sectional view and a partial perspective view of a floating façade/fascia trim member that may be used in a modular wall in accordance with an embodiment of the present patent application, FIG. 11 also shows a partial cross-sectional view and a partial perspective view of the modular wall with the floating façade/fascia trim member being installed thereon.

FIG. 11 shows another fascia trim member $\mathbf{110}_F$. The fascia trim member $\mathbf{110}_F$ may be referred to as a floating façade. The fascia trim member $\mathbf{110}_F$ may include portion 162 that may be configured to engage portions 182 of the panel receiver member 104 and portion 170 that may be configured to engage portions 184 of the floor/wall track 126.

The portions 162 and 170 of the fascia trim member $\mathbf{110}_F$ may include c-shaped configuration portion that are configured to engage with the portions 182 extending outwardly from the panel receiver member 104 and with the portions 184 extending outwardly from the floor/wall track 126, respectively. The engagement between portions 162, 170 of the fascia trim member and portions 182, 184 of the panel receiver member 104 and the floor/wall track 126 is configured to enable the removable connection of fascia trim member $\mathbf{110}_F$ to the panel receiver member 104 and the floor/wall track 126.

Each of the portions 162 and 170 of the fascia trim member $\mathbf{110}_F$ may include a flexible/resilient member 186 that is configured receive the corresponding portions 182, 184 of the panel receiver member 104 and the floor/wall track 126. The flexible/resilient member 186 may be optional. The male and female mating configurations of the portions 162 and 170 of the fascia trim member $\mathbf{110}_F$ and corresponding portions 182, 184 of the panel receiver member 104 and the floor/wall track 126 may be reversed in other embodiments.

Figure 12:
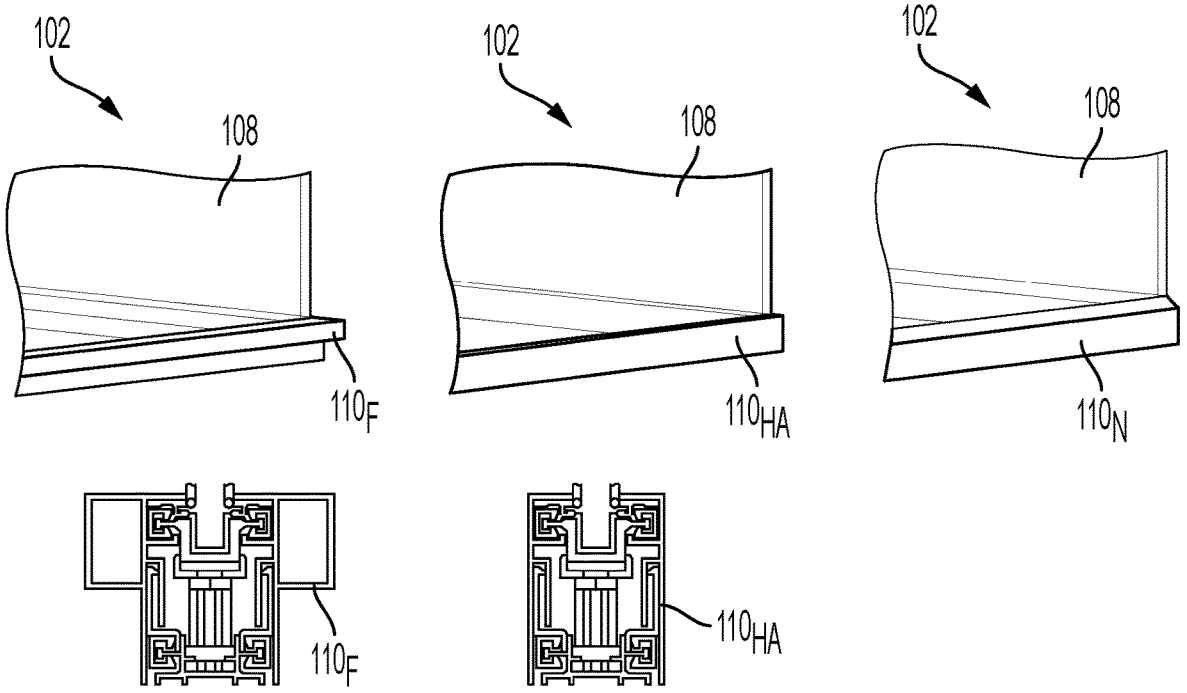
FIG. 12 shows partial cross-sectional views and their corresponding partial perspective views of the modular walls with floating façade/fascia trim member, standard façade/fascia trim member or other types of façade/fascia trim member being installed thereon in accordance with an embodiment of the present patent application.
Figure 13:
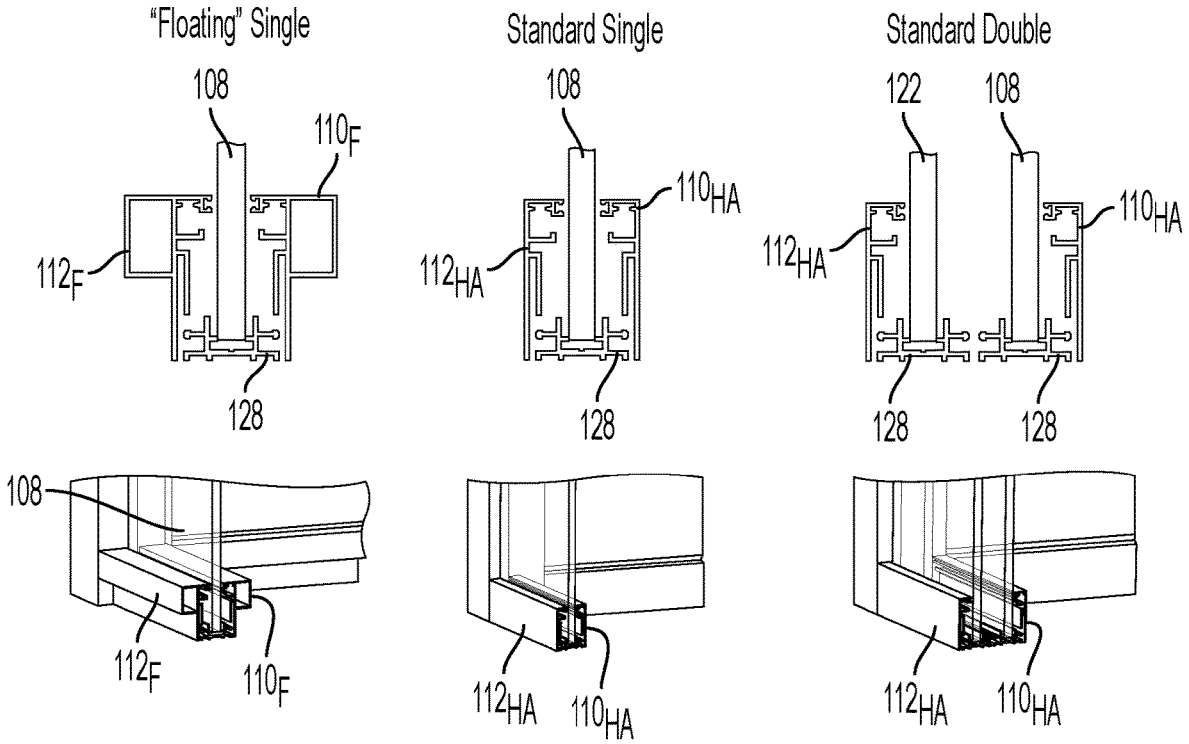
FIG. 13 shows partial cross-sectional views and their corresponding partial perspective views of the modular walls with floating façade/fascia trim member or standard single façade/fascia trim member being installed thereon in accordance with an embodiment of the present patent application.
Figure 14:
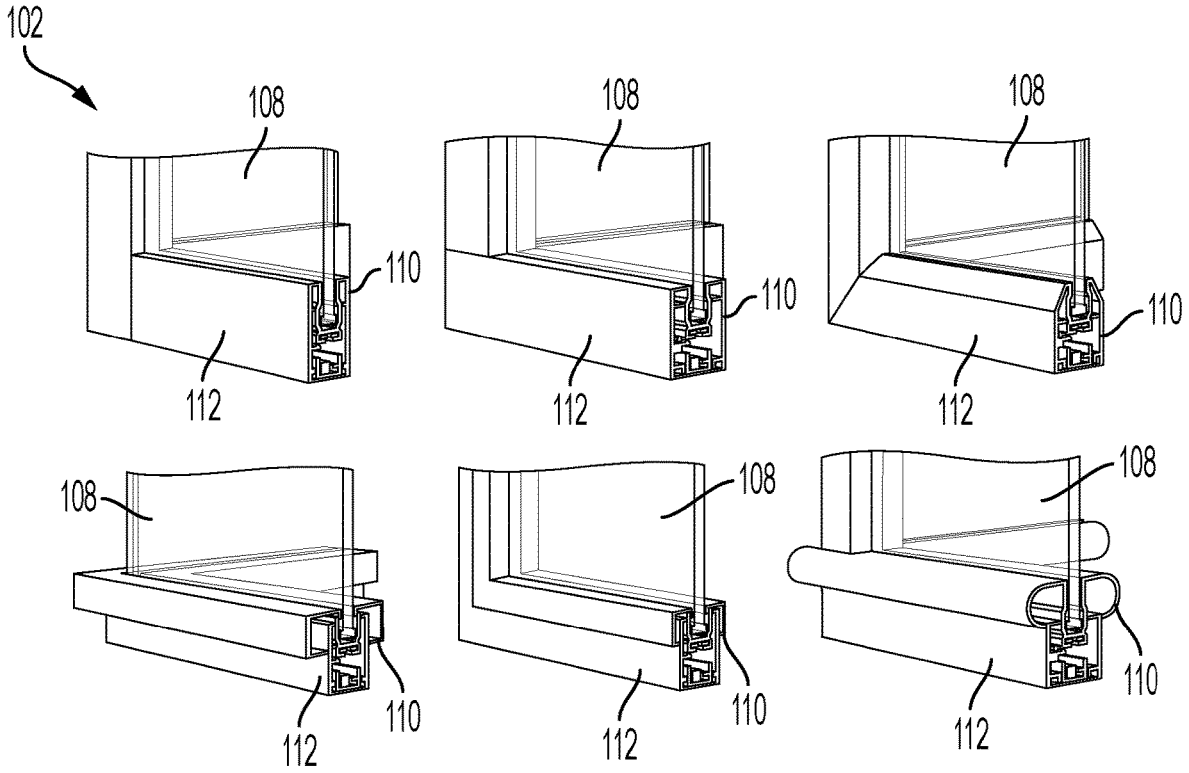
FIG. 14 shows partial perspective views of the modular walls with various different façade/fascia trim member being installed thereon in accordance with an embodiment of the present patent application.

FIG. 12 shows perspective views the modular walls 102 with the fascia trim member $\mathbf{110}_F$, the height adjustable fascia trim member $\mathbf{110}_{HA}$, and another fascia trim member $\mathbf{110}_N$. FIG. 12 also shows partial cross-sectional assembled views of the modular walls with the fascia trim member $\mathbf{110}_F$ and the height adjustable fascia trim member $\mathbf{110}_{HA}$. FIG. 13 shows partial cross-sectional views and their corresponding partial perspective views of the modular walls with floating fascia trim member ($\mathbf{112}_F$, $\mathbf{110}_F$) or standard fascia trim member ($\mathbf{112}_{HA}$, $\mathbf{110}_{HA}$) being installed thereon. The standard fascia trim member ($\mathbf{112}_{HA}$, $\mathbf{110}_{HA}$) is being shown in both the standard single modular wall configuration having a single panel 108 and the standard double modular wall configuration having two panels 108, 122. Some portions of the modular walls are not shown in FIG. 13 to clearly show other portions of the modular walls. FIG. 14 shows partial perspective views of the modular walls with various different façade/fascia trim member 112, 110 being installed thereon.

The design of the removable fascia trim member allows for ease of post construction upgrades, changes, and reconfiguration prolonging the useful life of the modular wall system and continued utilization or reutilization of major components thereby saving materials, labor and time that encourage reconfiguring and upgrading. The finish elements 110, 112 may be removed (to be utilized again), if desired, additional framing elements can be added to reconfigure the initially assembly.

For example, a single pane glass wall installed as to be an enclosed conference room was found to have undesirable acoustical properties. To improve the acoustical rating performance, a double pane glass wall may be needed. In the current state of the art systems, the entire conference room wall assembly (units with single pane glass) would be disassembled, removed and then replaced with an entirely new double glass wall assembly. There is no possibility to re-use the single pane glass panels again as they are not sized to fit a double glass track.

By contrast, the present patent application facilitates the addition of additional glass panels, while still utilizing the previously installed panels so as to become a double glass wall without having to fully dismantle the previously installed wall. For example, the façade would be removed, additional floor and ceiling rails would be added, the additional glass would be added, and the façades would be re-installed. Since these types of changes can be implemented faster, easier while re-utilizing the existing components, the re-configurable modular wall system 100 is uniquely designed to adapt to reconfigurations more easily and quickly than the current systems in the market.

Referring to FIGS. 1A and 1B, the method 200 of reconfiguring modular wall $\mathbf{102}_1$ is discussed. That is, the method 200 includes procedures to reconfigure the modular wall $\mathbf{102}_1$ of FIG. 1B to form modular wall $\mathbf{102}_2$ of FIG. 1A. The method 200 may be configured to add another panel 122 to the modular wall $\mathbf{102}_1$ so as to form the modular wall $\mathbf{102}_2$ with two panels 108 and 122.

The method 200 comprises a procedure of removing at least the second fascia trim member 112 of the modular wall $\mathbf{102}_1$; and a procedure of positioning the second panel receiver structure 118 on the second side 116 of the panel receiver structure 104.

In the illustrative embodiment, the left fascia trim member is being removed and the second panel receiver structure is being added to the left of the existing/first panel receiver structure. In another embodiment, the right fascia trim member may be removed and the second panel receiver structure may be added to the right of the existing/first panel receiver structure such that the newly added/second panel may be positioned to the right of the existing/first panel.

The method 200 also may include a procedure of positioning the second vertical panel 122 in the second panel receiving channel 120 to be parallel to the vertical panel 108; and a procedure of re-installing the removed second fascia trim member 112 to the second panel receiver structure 118.

The procedure of positioning the second panel receiver structure 118 on the second side 116 of the panel receiver structure 104 may comprise positioning the second panel receiver structure 118 such that the panel receiving channel 120 thereof is facing vertically. The procedure of positioning the second vertical panel 122 in the second upwardly facing channel 120 is performed after positioning the second panel receiver structure 118.

In one embodiment, the panel receiving structure may have a horizontally facing channel and the vertical panel is received in the horizontally facing channel. That is, the panel receiving structure/member with a vertical channel, the channel will face horizontally inward. Positioning the second panel receiver structure on the second side of the panel receiver structure may comprise positioning the second panel receiver structure such that the panel receiving channel thereof is facing horizontally. The method may include connecting the first and second receiver structures using a connector member attached to each receiver structure. The connector member may be a clip engaging with each inside wall of the first and second upwardly facing channels.

Also, as shown in FIG. 1A, the second panel receiver structure 118 may be positioned on the second side 116 of the first panel receiver structure 104 such that the outwardly extending portion 148 of the second panel receiver structure 118 may be positioned either above or below (FIG. 1A shows it being below) and in an overlapping relationship with the outwardly extending portion 148 of the first panel receiver structure 104.

The method 100 may also include a procedure of connecting the first and second receiver structures 104, 118 using the connector member 124 attached to each receiver structure 104, 118. This procedure of connecting the first and second receiver structures 104, 118 using the connector member 124 may be performed before positioning the second vertical panel 122 in the second panel receiving channel 120.

The method 200 may also include procedures to reconfigure the modular wall $\mathbf{102}_2$ of FIG. 1B to form the modular wall $\mathbf{102}_1$ of FIG. 1A. The method 200 may comprise a procedure of removing at least the second fascia trim member 112 of the modular wall $\mathbf{102}_2$; a procedure of removing the second vertical panel 122 from the second panel receiving channel 120; a procedure of removing the connector member 124 attached to each receiver structure 104, 118 and that is connecting the first and second receiver structures 104, 118; a procedure of removing the second panel receiver structure 118 on the second side 116 of the panel receiver structure 104; and a procedure of re-installing the removed second fascia trim member 112 to the first panel receiver structure 104. That is, the method 200 and the system 100 may be configured to remove the panel 122 from the modular wall $\mathbf{102}_2$ so as to form the modular wall $\mathbf{102}_1$ with a single panel 108. Although the procedures are described in the illustrated embodiment as the left panel is being removed from the modular wall, in another embodiment, the right panel and the right panel receiver structure (and the connector member) may be removed.

The method 200 to reconfigure the modular wall $\mathbf{102}_3$ of FIG. 1C to form the modular wall $\mathbf{102}_4$ of FIG. 1D and to reconfigure the modular wall $\mathbf{102}_4$ of FIG. 1D to the modular wall $\mathbf{102}_3$ of FIG. 1C may be similar to those described with respect to the modular wall $\mathbf{102}_1$ of FIG. 1B and the modular wall $\mathbf{102}_2$ of FIG. 1A, except for the differences noted below.

The procedure of positioning the second panel receiver structure 118 on the second side 116 of the panel receiver structure 104 may also include positioning the floor/wall track 126 on the second side 116 of the panel receiver structure 104, positioning the height adjustment unit 128 between the floor/wall track 126 and the second panel receiver structure 118 on the second side 116 of the panel receiver structure 104, connecting the height adjustment unit 128 to both the floor/wall track 126 and the second panel receiver structure 118 on the second side 116 of the panel receiver structure 104, and connecting the new height adjustment unit 128 and the existing height adjustment unit 128 using the support link 194.

Similarly, the procedure of removing the second panel receiver structure 118 on the second side 116 of the panel receiver structure 104 may include disconnecting the support link 194 that is connecting the two height adjustment units 126, disconnecting the height adjustment unit 128 from both the floor/wall track 126 and the second panel receiver structure 118 on the second side 116 of the panel receiver structure 104, and removing the floor/wall track 126 and the height adjustment unit 126 on the second side 116 of the panel receiver structure 104.

Although the left panel/left panel receiver member/left height adjustment unit/left floor/wall track are being added to or removed from the exiting modular wall in FIGS. 1C-1D, in another embodiment, the right panel/right panel receiver member/right height adjustment unit/right floor/wall track may be added to or removed from the existing modular wall.

The method 200 may also include procedures to reconfigure the modular wall $\mathbf{102}_3$ of FIG. 1C or $\mathbf{102}_4$ of FIG. 1D to form the modular wall $102_5$ of FIG. 1E, and vice versa. The method 200 may be configured to add two panels 122 and 130 to the modular wall $102_3$ or to add panel 130 to the modular wall $102_4$ so as to form the modular wall $102_5$ with three panels 108, 122 and 130.

The method 200 may comprise a procedure of positioning the third panel receiver structure 132, the height adjustment unit 128 and the floor/wall track 126 on the second side 116 of the second panel receiver structure 118, and a procedure of positioning the third vertical panel 130 in the third panel receiving channel 134 to be parallel to the vertical panels 108, 122. The method 100 may also include a procedure of connecting the third and second receiver structures 132, 118 using the connector member 124 attached to each receiver structure 132, 118. This procedure of connecting the third and second receiver structures 132, 118 using the connector member 124 may be performed before positioning the second vertical panel 130 in the third panel receiving channel 134. The rest of the procedures of the method 200 may be similar to those described with respect to the modular wall $102_3$ of FIG. 1C and the modular wall $102_4$ of FIG. 1D, except for the differences noted below.

Instead of one panel/panel receiver member/height adjustment unit/floor/wall track being added to the existing modular wall, two panels/panel receiver members/height adjustment units/floor/wall tracks may be added. The two newly added panels/panel receiver members/height adjustment units/floor/wall tracks may be added either to the right or to the left of the existing modular wall. In another embodiment, two panels/panel receiver members/height adjustment units/floor/wall tracks may be added such that one may be positioned to the right of the existing modular wall and the other may be positioned to the right of the existing modular wall. In such an embodiment, both right and left fascia trim members may be removed for the addition of the two panels/panel receiver members/height adjustment units/floor/wall tracks.

The method 200 may also include procedures to reconfigure the modular wall $102_3$ of FIG. 1C, $102_4$ of FIG. 1D, $102_5$ of FIG. 1E to form the modular wall $102_6$ of FIG. 1F, and vice versa. For example, the method 200 may be configured to add a panel, in a spaced apart configuration, to the modular wall $102_3$, and then add the privacy panel 136 thereto. The method 200 may be configured to remove the panel from the modular wall $102_5$, reconfigure one of the remaining panels such that the remaining panels are in spaced apart configuration, and then then add the privacy panel 136 thereto. The method 200 may be configured to reconfigure one of the panels the modular wall $102_4$ such that the panels are in spaced apart configuration, and then then add the privacy panel 136 thereto. The privacy panel may be configured to attached to the modular wall system $102_6$ by any attachment system or method as would be appreciated by one of ordinary skill in the art.

The spaced apart configuration of the panels, shown in FIG. 1F, may be obtained by placing an extra floor/wall track between the two floor/wall tracks. The panel receiver members in the spaced apart configuration may be connected to each other using a connector member 124 having elongated bight portion 140 and also using the connector link 194.

Figure 2A:
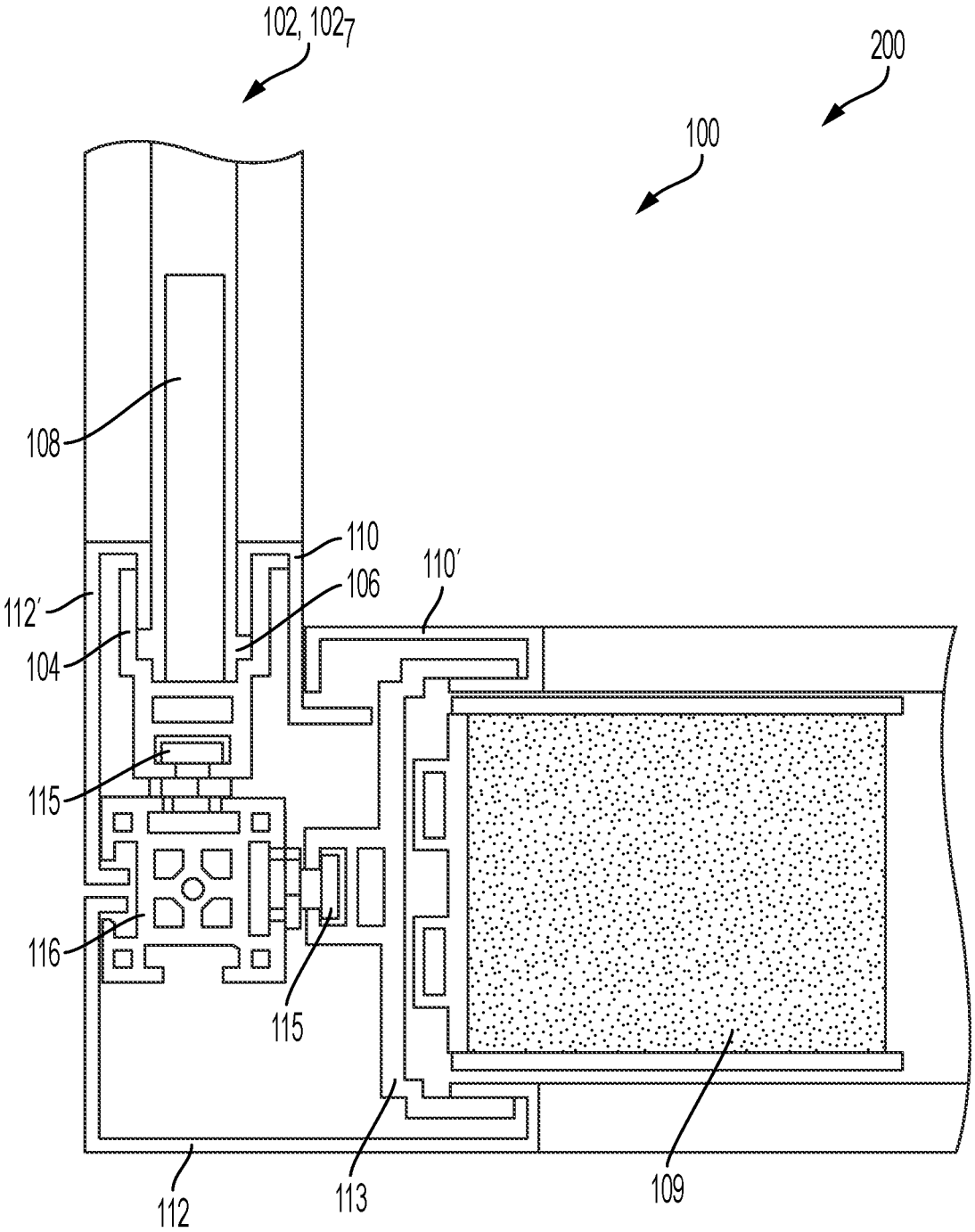
FIGS. 2A-2C show a top view of another exemplary method of reconfiguring a modular wall in accordance with an embodiment of the present patent application, where the modular wall includes a corner joint.
Figure 2B:
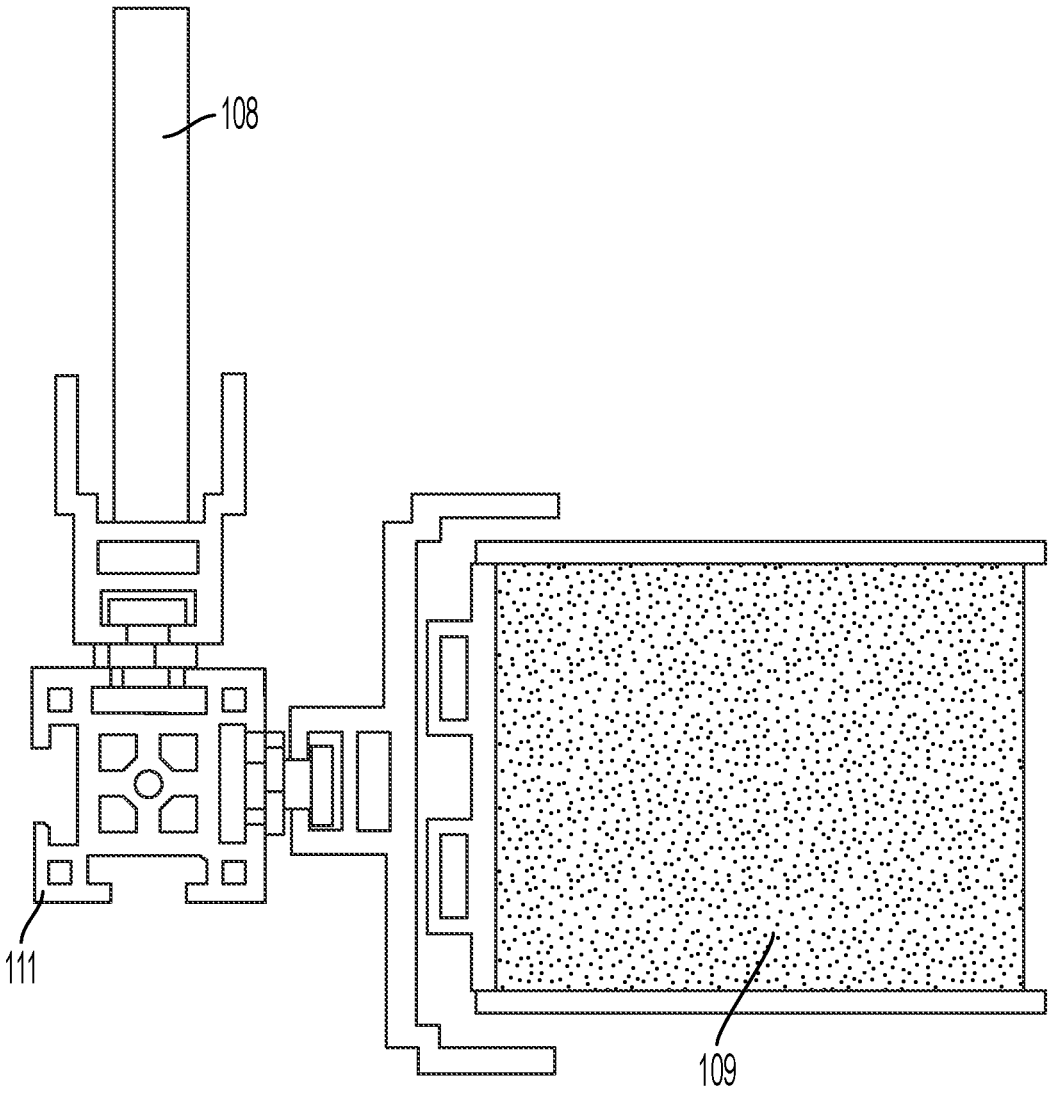
Figure 2C:
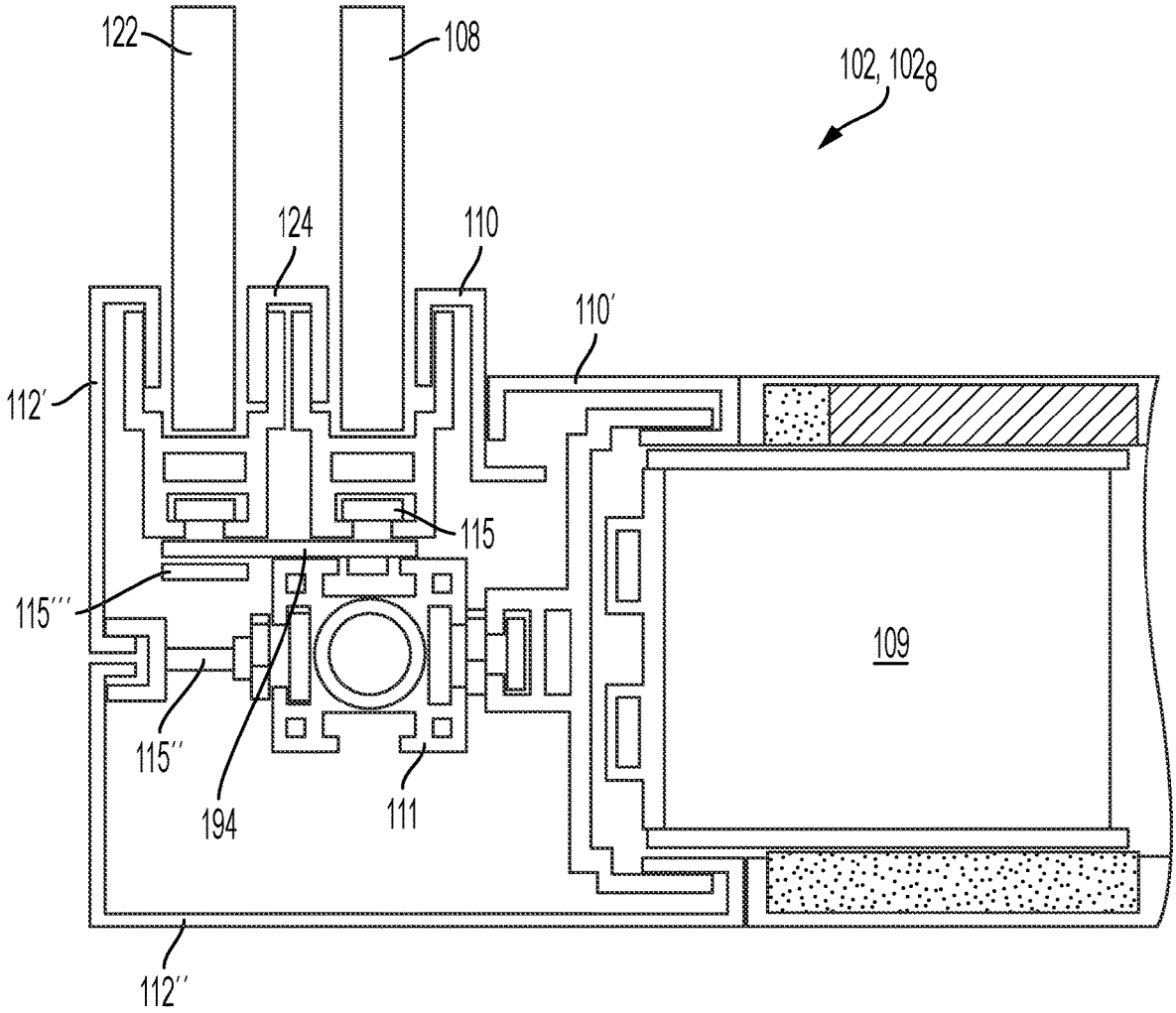

As shown in FIGS. 2A-2C, the modular wall $102_7$ includes two panels 108 and 109 that may be positioned at perpendicular to each other and connected to each other via a corner joint 111. The corner joint 111 may be in the form of a column (e.g., extending along the height of the modular wall). The panels 108, 109 may be supported by their associated panel receiver members 104 and 113. Each of the panel receiver members 104 and 113 may be connected to the corner joint 111 using connectors 115. The modular wall $102_7$ may also include fascia trim members 112, 112', 110 and 110'. To increase the sound transmission class (STC) rating of the modular wall $102_7$, a second panel 122 may be added to the modular wall $102_7$ so as to form the modular wall $102_8$.

The corner joint 111 may be interchangeably referred to as corner junction or corner junction structures. The drawings of the present patent application show one example of the corner junction structures, and a still more preferred example of the corner junction structure is shown and described in detail in U.S. Patent Application Serial Nos.: 63/328,756 and Ser. No. 18/127,617 both titled "Connecting Members And System For Modular Wall Junctions", each of which is incorporated by reference in its entirety. These patent applications are commonly owned by the same assignee as the present patent application.

FIGS. 2A-2C show procedures of the method 200 in which the modular wall $102_7$ with the corner joint 111 and the single panel (108) configuration may be reconfigured to form the modular wall $102_8$ with the corner joint 111 and double panel (108, 122) configuration.

In one embodiment, all the components of the modular wall $102_7$ may be reused to form the modular wall $102_8$ except the fascia trim member 112 that is replaced by fascia trim member 112" to accommodate the additional width (because of the additional panel 122 and its corresponding support members) of the modular wall $102_8$. In addition, the panel 122, the panel receiver structure 118, a connector 115" that connects to the corner joint 111 and (end portions of) the fascia trim members 112, 112", a connector 115'" that is attached to the panel receiver structure 118, a connector member 124 to connect the panel receiver structures 104, 118 and a link structure 194 that connects the connector 115 and 115'" may be used to form the modular wall $102_8$. In the modular wall $102_7$, one of the end portions of the fascia trim members 112, 112' are received by/connected to the corner joint 111. In the modular wall $102_8$, due to the spaced configuration, the end portion of the fascia trim member 112 cannot be received in the corner joint 111. The connector 115" may be configured to serve as an extension member and configured to receive one of the end portions of the fascia trim members 112, 112".

In one non-limiting embodiment, the fascia trim member may extend all the way around the corner or at least on the one side and another side of the corner. In such an embodiment where the trim extends around the corner is used, the fascia trim member is removed all the way around the corner or at least on the one side and the other side of the corner before reconfiguring the modular wall.

The method 200 may include procedures of removing the fascia trim members 112, 112' (i.e., most of the modular wall structure remains intact and in place); positioning the panel receiver structure 118 on the second/left side of the panel receiver structure 104; connecting the panel receiver structures 118, 104 using the connector member 124, and also using the connector 115" and the link structure 194; positioning the panel 122 in the panel receiver structure 118 to be parallel to the panel 108; re-installing the removed fascia trim member 112, and installing new fascia trim member 112" (i.e., instead of fascia trim member 112'). The connecting procedure may use any other connector structures that would be appreciated by one skilled in the art and not limited to the ones disclosed here to connect the panel receiver structures 118, 104. Thus, in FIGS. 2A-2C, the modular wall $102_7$ having a single panel with lower STC may be easily reconfigured to the modular wall $102_8$ having two panels with higher STC after the initial installation of the modular wall $102_7$. Thus, any adjustments to the modular wall $102_7$ may be made after initial framing and walk through.

Figure 3A:
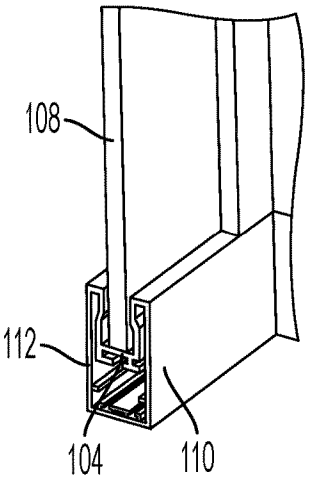
FIGS. 3A-3E show various exemplary configurations of the modular wall in accordance with an embodiment of the present patent application.
Figure 3B:
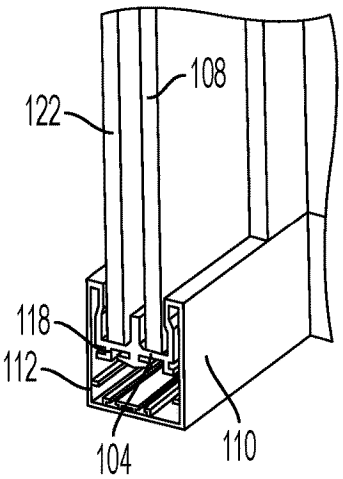
Figure 3C:
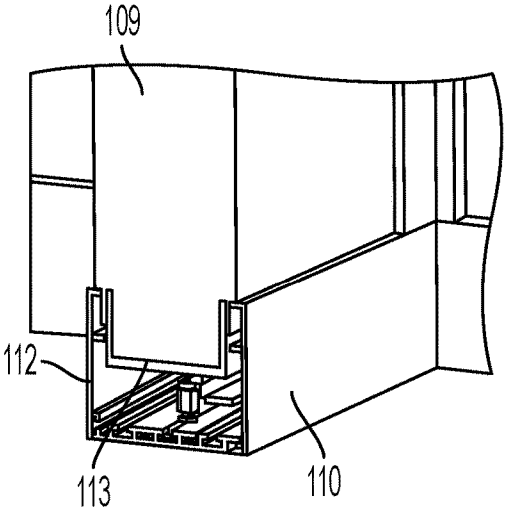
Figure 3D:
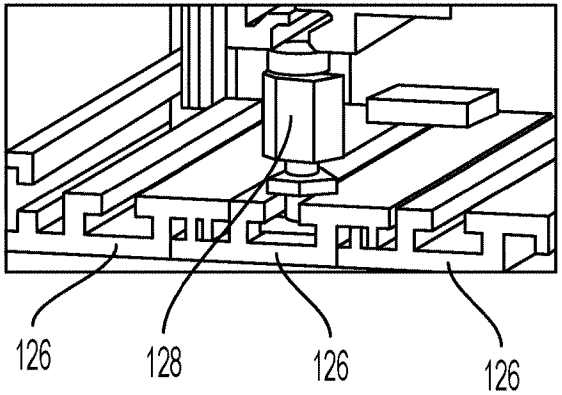

FIGS. 3A-3B show perspective views of the modular walls $102_3$ of FIG. 1C and $102_4$ of FIG. 1D. FIG. 3D shows a partial perspective view of the modular wall where additional floor tracks 126 are being added to reconfigure the modular wall.

Figure 3E:
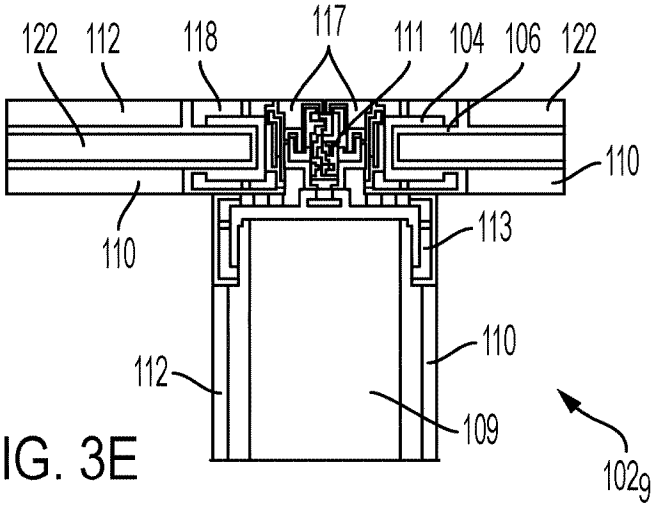

FIG. 3E shows a reconfigurable modular wall $102_9$ with the corner joint 111, two (glass) panels 108, 122 positioned to face opposing directions, and one solid wall 109 (meeting at what is often called a T-junction). The reconfigurable modular wall $102_9$ includes a t-shaped corner joint configuration. The panels 108, 122, and 109 may be received in the panel receiver structures 104, 118 and 113, respectively. Each of the panel receiver structures 104, 118 and 113 may be connected to the corner joint 111 using connectors. Each of the panels 108, 122, and 109 may include fascia trim members 112, 110.

The reconfigurable modular wall $102_9$ may also include fascia trim members 117, 117' that may be configured to be connected to the corner joint 111. In one embodiment, the panel 109, the panel receiver structure 113 and the connector that connects the panel receiver structure 113 to the corner joint 111 may be removed and replaced with another panel receiver structure that is configured to receive either a single panel or a double panels. In one embodiment, the panel 109, the panel receiver structure 113 and the connector that connects the panel receiver structure 113 to the corner joint 111 may be removed and new fascia trim members 117, 117' may be installed to form a straight wall configuration. FIG. 3C shows a configuration mounting a non-transparent panel (e.g., wood). The floor track is re-configured to hold the panel, which as an example is of greater thickness that the dual-glass run in FIG. 3B (and the re-configuration may also be in a reverse direction from wood panel to glass (or the like)). The fascia trim members 110, 112 can be re-utilized between the configurations. As another option, the height adjustment components may be re-utilized as well.

Figure 4A:
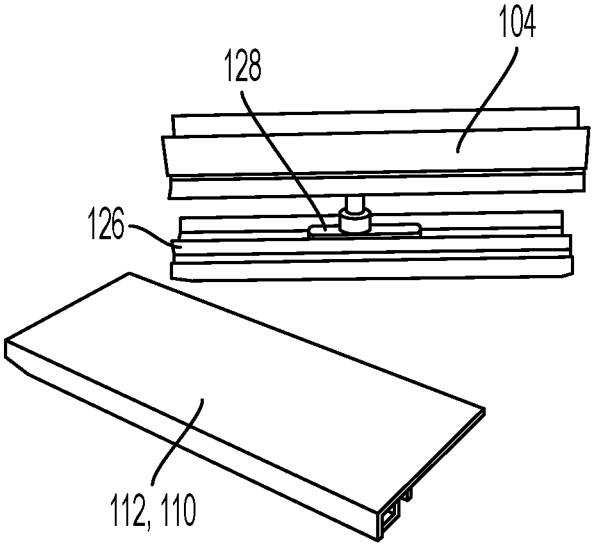
FIGS. 4A-4C show a partially exploded view, an assembled cross-sectional view and a partial assembled cross-sectional view of a modular wall, respectively in accordance with an embodiment of the present patent application.
Figure 4B:
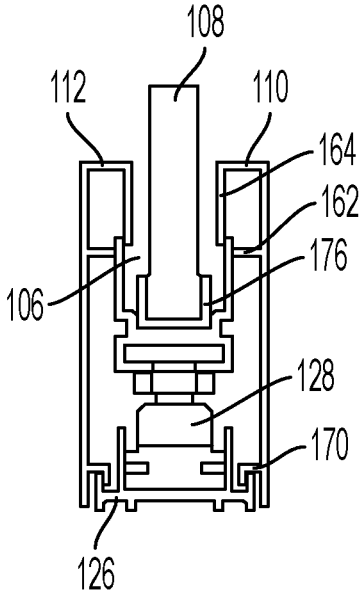
Figure 4C:
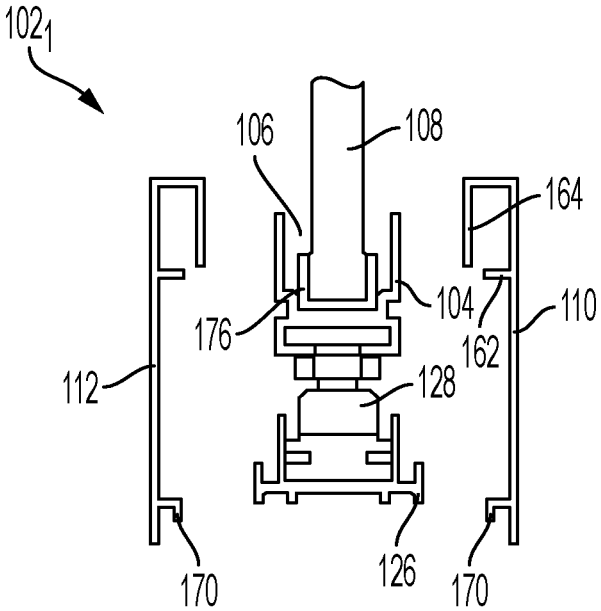

FIGS. 4A-4C show a partially exploded view, an assembled cross-sectional view and a partial assembled cross-sectional view of the modular wall $102_1$, respectively. The modular wall $102_1$ in FIGS. 4A-4C is similar to the modular wall $102_1$ in FIG. 1C, except for the differences noted below. Portions 164 and 162 of the fascia trim member 110 may be configured to engage on two opposing sides (e.g., inner and outer) of the wall of the channel 106 and the portion 170 of the fascia trim member 110 may be configured to engage with portions of the floor/wall track 126 so as to removably attach the fascia trim member 110 to the panel receiver member 104 and/or the floor/wall track 126. The channel 106 may include another member 176 (e.g., a cushioning or a stability member) that may be configured to receive the panel 108 therein. The member 176 may be optional.

Figure 5A:
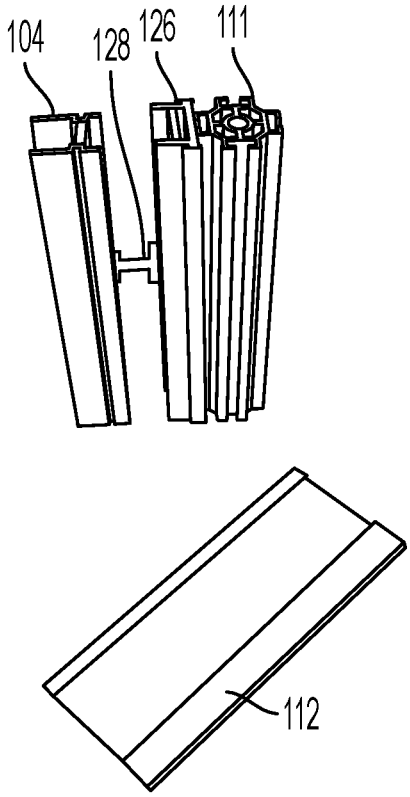
FIGS. 5A and 5B show a partially exploded view and an assembled cross-sectional view a modular wall with a corner joint, respectively in accordance with an embodiment of the present patent application, where FIG. 5B also shows a cross-sectional view of a corner member.
Figure 5B:
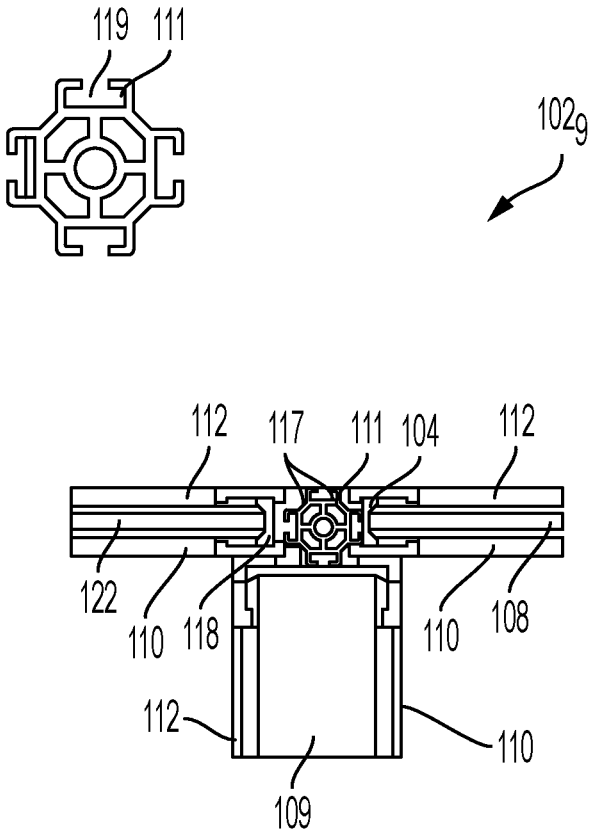

FIGS. 5A and 5B show a partially exploded view and an assembled cross-sectional view the modular wall $102_9$ (of FIG. 3E) with the corner joint 111, respectively, where FIG. 5B also shows a cross-sectional view of the corner member 111. The modular wall $102_9$ may include the height adjustment member 126 between the panel receiver member 104 and the corner member 111. The corner member 111 may serve as a vertical key and/or as an adjustable spacer that may be configured to allow forgiving horizontal adjustments. The corner member 111 may be configured to receive portions of the fascia trim members 117 in the vertical key portions 119 so as to removably attach the fascia trim members 117 to the modular wall.

In one embodiment, the corner joint 111 may be referred to as a joint, end-to-end joint, or joint member. In such a non-limiting embodiment, the joint 111 may be an assembly of components (a joint assembly or adjoining assembly) that facilitate an end-to-end junction or connection between two walls or wall sections. For example, two walls or wall sections extending in opposing directions may be connected to each other in an end-to-end connection using the joint 111. The trim may then cover the other sides (e.g., exposed sides) of the joint 111. In another embodiment, the two pairs of walls or wall sections extending in opposing directions may be connected to each other using the joint 111. In yet another embodiment, the two walls or wall sections extending in directions perpendicular to each other may be connected to each other using the joint 111 and the trim may cover the other sides (e.g., exposed sides) of the joint 111.

Figure 6:
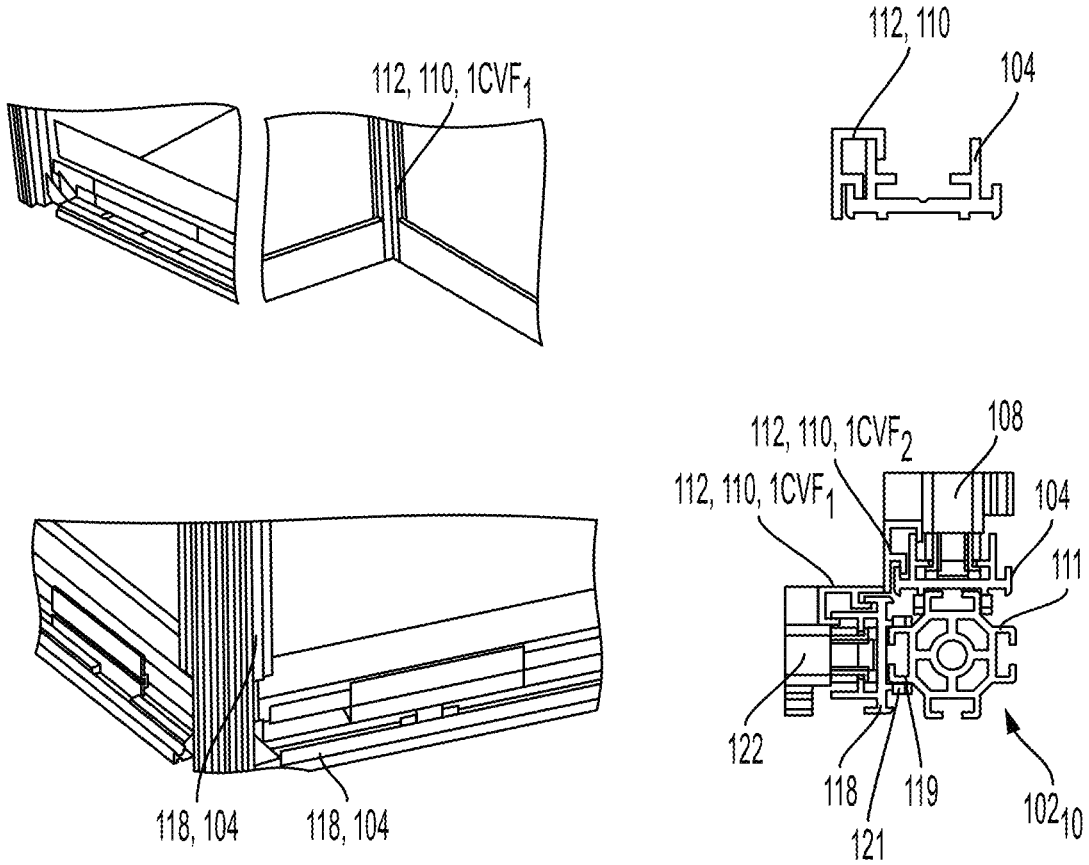
FIG. 6 shows another modular wall with a corner joint in accordance with an embodiment of the present patent application, where some parts/components of the modular wall may be multi-purposed.

FIG. 6 shows another modular wall $102_{10}$ with the corner joint 111, where some parts/components of the modular wall may be multi-purposed. For example, in this low profile modular wall $102_{10}$ configuration. For example, the low profile fascia trim members 112, 110 (e.g., similar to the ones that are used in FIGS. 1A-1B) may be used as inside corner vertical façades/fascia trim members $ICVF_1$, $ICVF_2$. As discussed in the present patent application, the panel receiver member and the floor/wall track may be the same in the low profile modular wall configuration. In one embodiment, the floor base (or floor/wall track) may also be used as vertical stile.

Also, as shown in FIG. 6, the corner member 111 may serve as an adjustable spacer when connecting the panel receiver structure 118 to the corner member 111. Portions 121 of the panel receiver structure 118 may be configured to engage with portions 119 of the corner member 111 so as to connect the panel receiver structure 118 and the corner member 111.

Figure 7A:
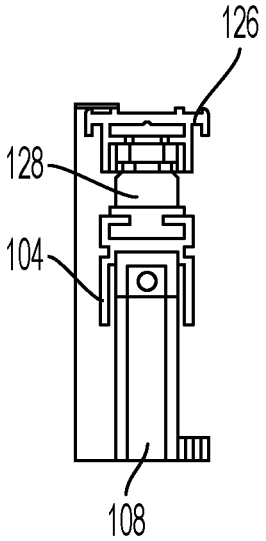
FIG. 7A shows an assembled cross-sectional view of a modular wall and FIGS. 7B-7D show assembled perspective views of the modular wall in accordance with an embodiment of the present patent application.
Figure 7B:
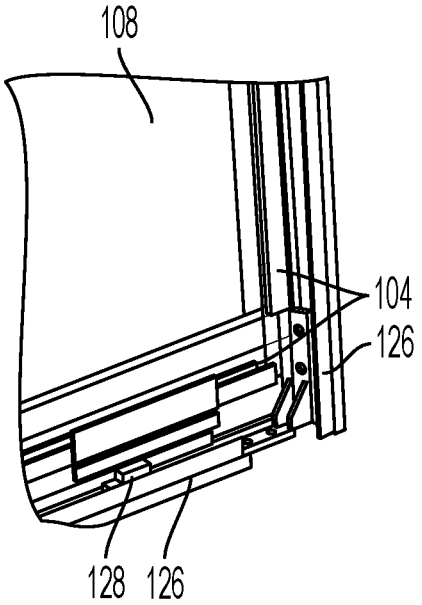
Figure 7C:
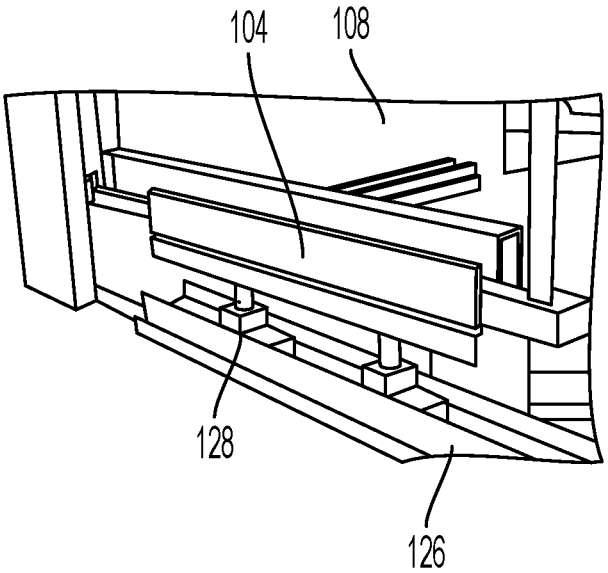
Figure 7D:
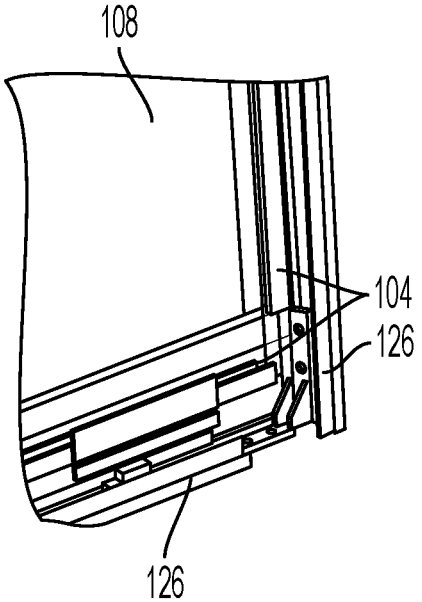

FIG. 7A shows an assembled cross-sectional view of a modular wall and FIGS. 7B-7D show assembled perspective views of the modular wall, FIGS. 7A-7D show that the same panel receiver structure 104 and the same wall/floor support member 126 of the modular wall may be used interchangeably used on the wall and/or the floor of the modular wall. The modular wall may be configured to utilizes same extrusions as adjustment floor extrusions.

Figure 17A:
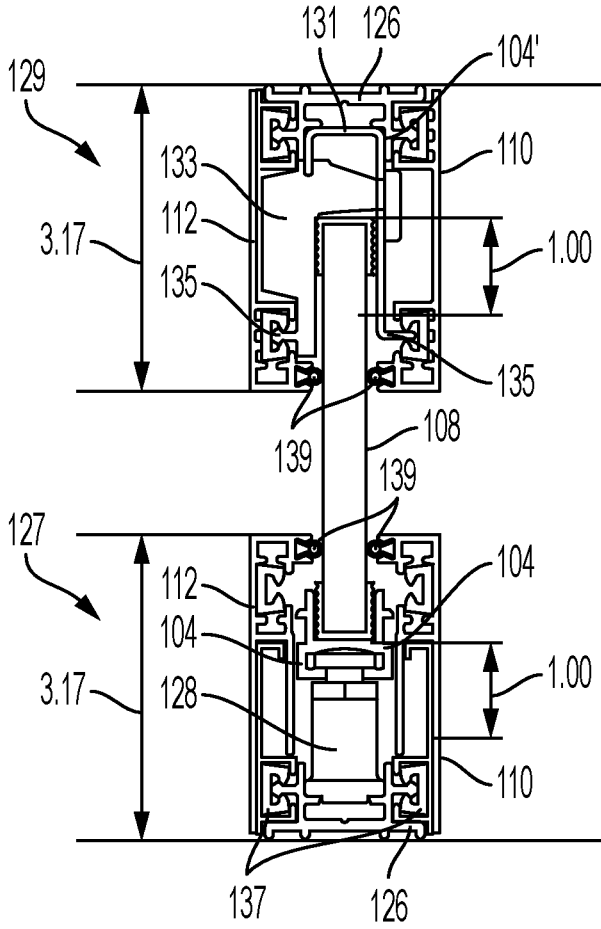
FIGS. 17A and 17B show side by side comparison of cross-sectional views of a height adjustable profile configuration and a low prolife configuration of the modular wall, respectively, in accordance with an embodiment of the present patent application.
Figure 17B:
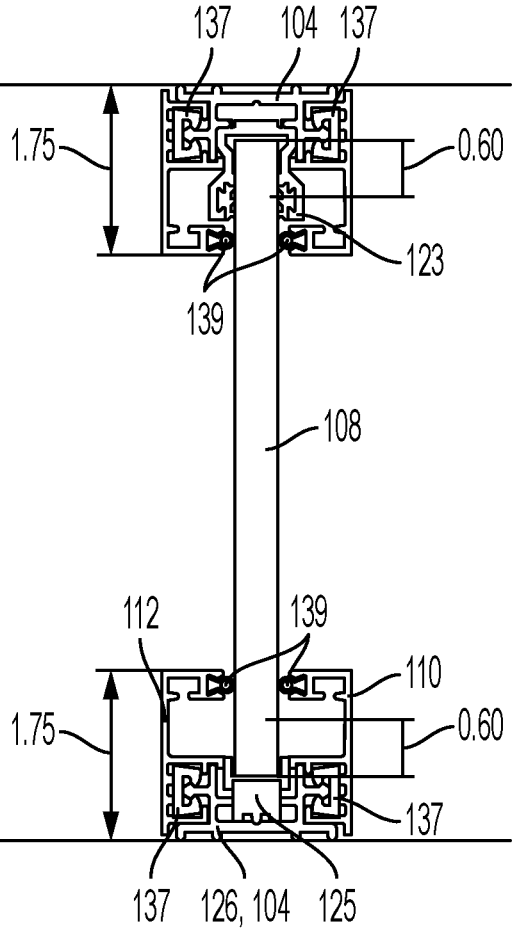

FIGS. 17A-17B show side by side comparison of cross-sectional views of a height adjustable profile configuration and a low prolife configuration of the modular wall, respectively. These Figures are not to scale and the components located at the floor and ceiling are shown much closer to one another than would be typical, which is done for convenience in rendering the drawings. For example, in one non-limiting embodiment, the framing elements in the regular or height adjustable profile configuration may have a height of about 3.17 inches with an adjustability of about 1 inch provided by the height adjustment unit 28, while the framing elements in the low profile configuration may have a height of about 1.75 inches with an adjustability of about 0.6 inch. The adjustability in the low profile configuration may be provided by, for example, by members 123 and/or 125. Component 125 may be a height adjustment wedge, such as that discussed below with respect to FIG. 24, and used to adjust the panel height. Component 123 is a channel for "toeing" in the upper end of the panel. The channel 123 has fingers formed of resilient material, which allow the upper end to be inserted at an angle as it is being installed and retained in place with vertical movement of the upper end being allowed therein while the wedge (or other height adjuster) is used to adjust the panel height.

In the height adjustable profile configuration, the framing elements, at one end 127 of the modular wall, may include the height adjustment unit 128 (along with the panel receiver member 104 and the floor/wall track 126 connected to the opposing ends of the height adjustment unit 128). The framing elements, at the other end 129 of the height adjustable modular wall, may include the floor/wall track 126 and the panel receiver structure 104'. The panel receiver structure 104' may have a slightly different structure and configuration than the panel receiver structure 104.

Figure 20:
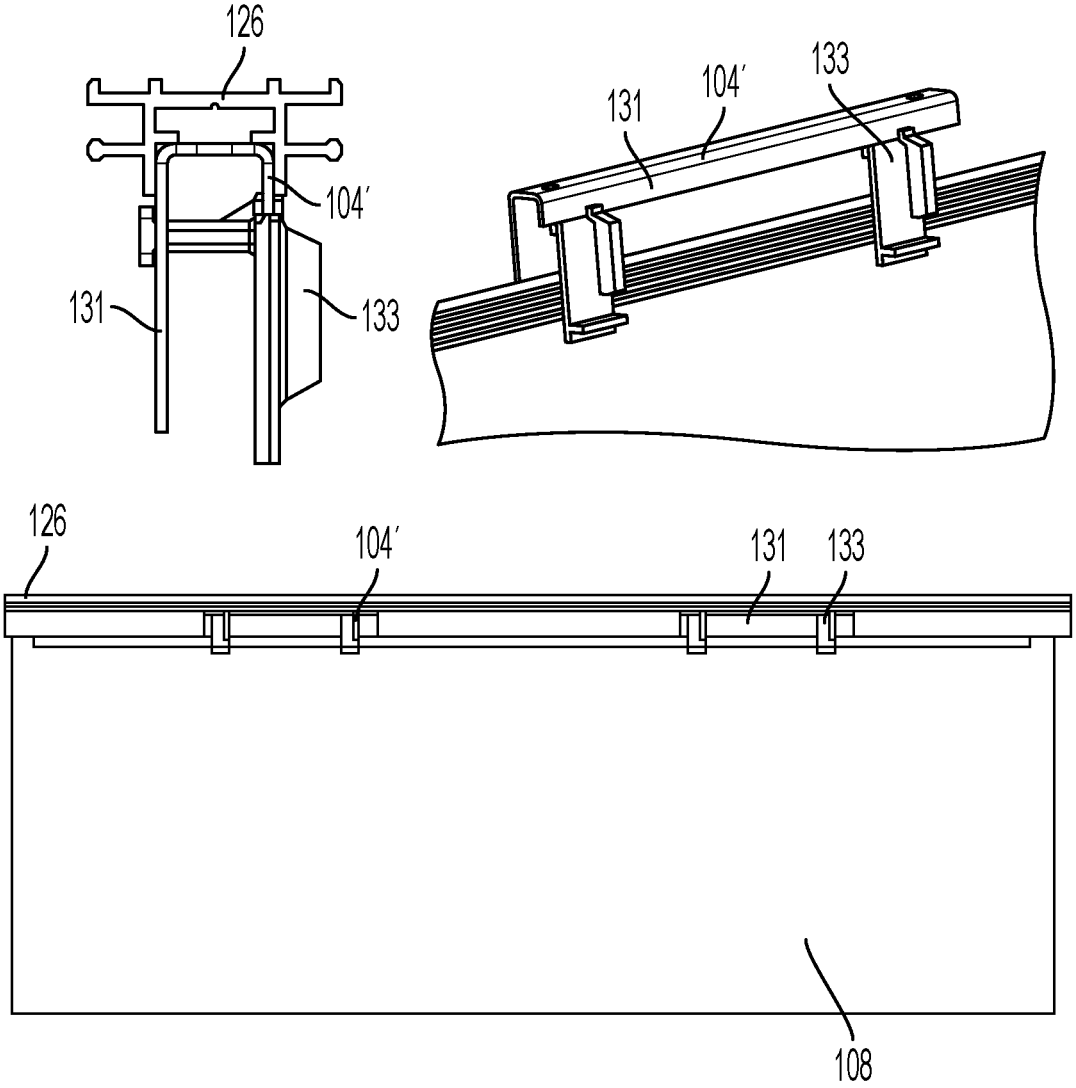
FIG. 20 shows a perspective view and a cross-sectional view of the panel bracket of the modular wall in accordance with an embodiment of the present patent application, where FIG. 20 also shows a perspective view of the modular wall with the panel brackets installed thereon.

For example, as shown in FIG. 17A, FIGS. 18C-18D, and 20, the panel receiver structure 104', at the end 129 of the height adjustable modular wall may be in the form of U-channel panel bracket. The panel receiver structure 104' may be disposed on the upper portion of the modular wall and may be connected to the ceiling/wall track 126. The panel receiver structure 104' may be positioned at spaced apart locations along the ceiling/wall track 126 as shown in FIG. 20. The panel receiver structure 104' may two components 131 and 133 that are connected to each other. One of the components 131, 133 may be configured to receive the panel therein and the other of the components 131, 133 may be connected to the ceiling/wall track 126. Each of the components 131, 133 may have portions 135 that are configured to engage with the fascia trim members 110, 112 so as to attach the fascia trim members 110, 112 to the modular wall.

As would appreciated by one skilled in the art, the modular wall may also include resilient members 137 disposed at the connections between floor/wall track 126 and the fascia trim members 112, 110, and resilient members 139 disposed at the interface between the fascia trim members 112, 110 and the panel 108.

Figure 18A:
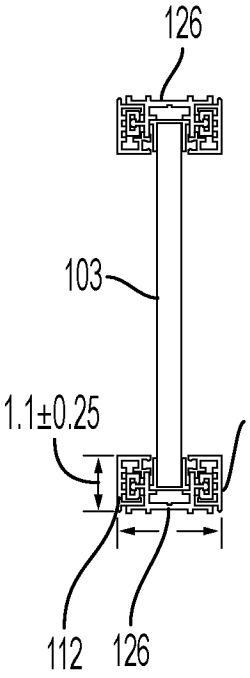
FIG. 18A, FIG. 18B, FIG. 18C and FIG. 18D show another side by side comparison of cross-sectional views of a low profile configuration and a height adjustable configuration of the modular wall, respectively, in accordance with an embodiment of the present patent application, where FIG.
Figure 18B:
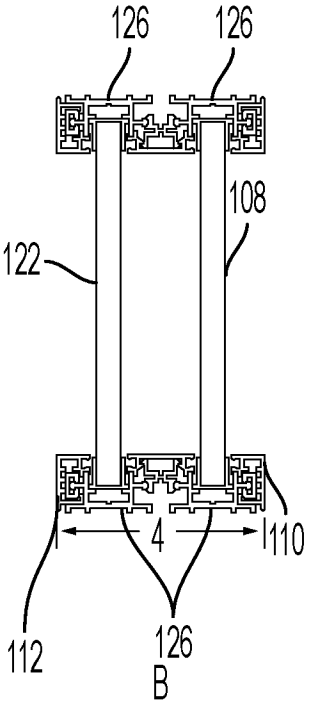
Figure 18C:
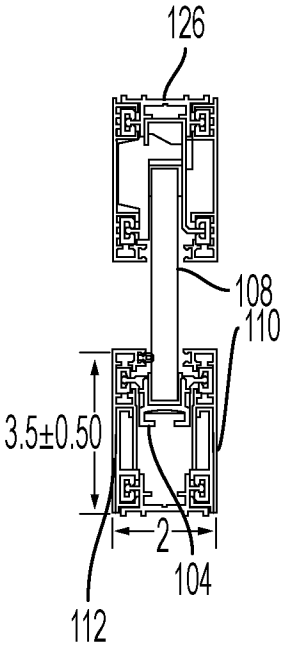
Figure 18D:
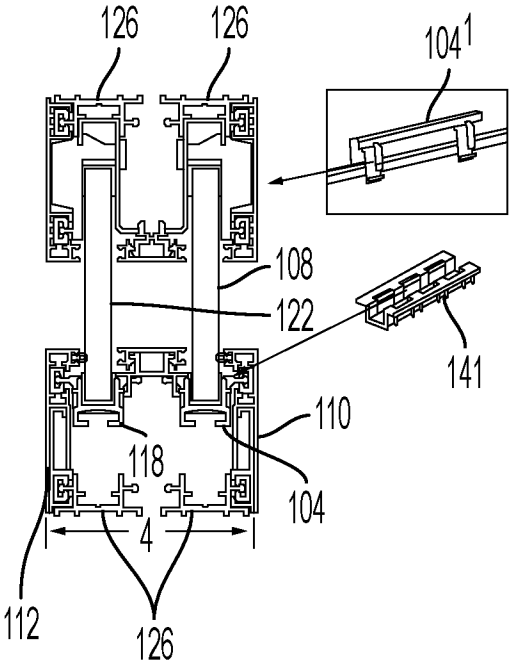
Figure 19:
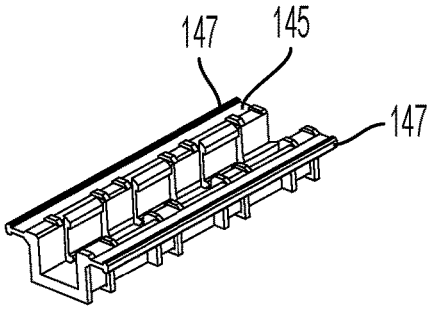
FIG. 19 shows a perspective view and a cross-sectional view of the adjustable façade mount of the modular wall in accordance with an embodiment of the present patent application, where FIG. 19 also shows a perspective view of the modular wall with the adjustable façade mounts installed thereon.
Figure 19:
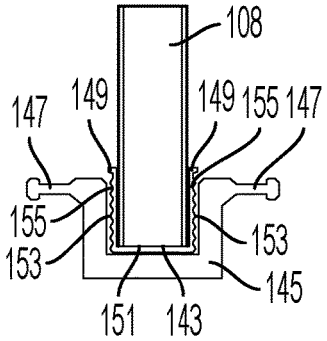
Figure 19:
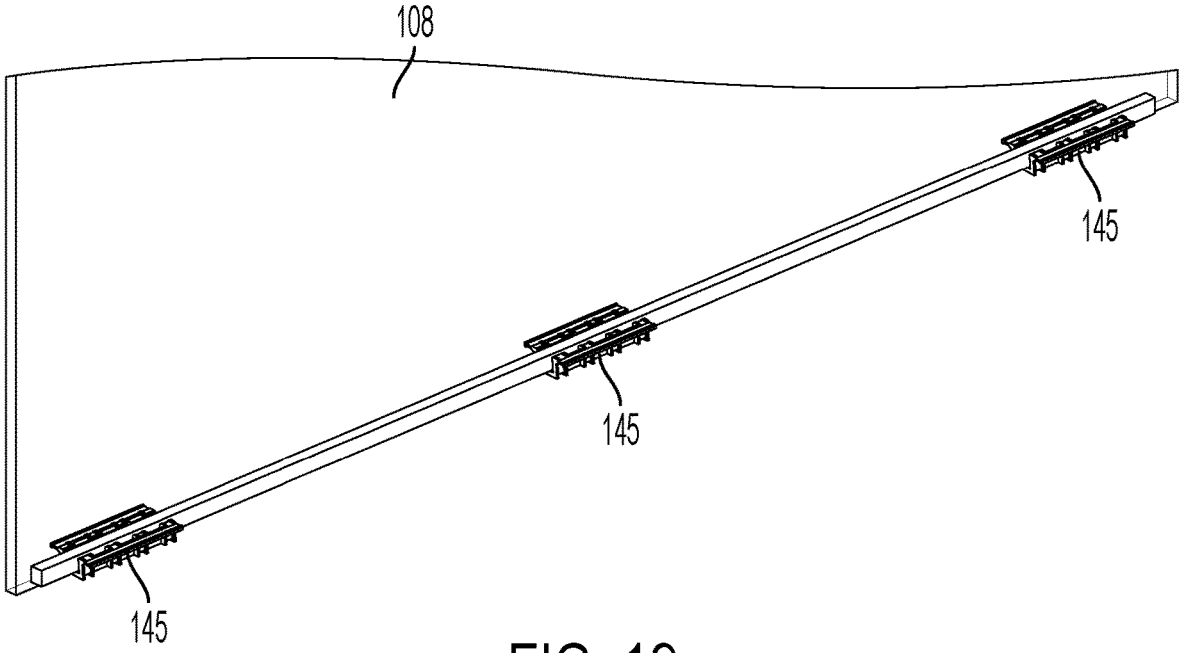

FIGS. 18A-18B show low profile modular wall configuration with a single panel 108 and two panels 108, 122, respectively. FIGS. 18C-18D show adjustable height profile modular wall configuration with a single panel 108 and two panels 108, 122, respectively. The configurations in FIGS. 18A-18D may be similar to those in FIGS. 1A-1B, 1C-1D, and 17A-17B. The adjustment height configuration in FIG. 17A, FIGS. 18C and 18D may use an adjustable façade mount 141. The adjustment façade mount 141 is also shown in FIG. 19. The adjustment façade mount 141 may include two components 143 and 145.

The inner component 143 may be configured to receive the panel therein (e.g., in a channel of the inner component 143). The inner component may serve as the panel receiver structure. The other/outer component 145 may be configured to receive the inner component 143 (along with the panel therein) in a channel of the outer component 145. The outer component 145 may also have outwardly extending portions 147 that are configured to engage with the fascia trim members 110, 112 so as to removably attach the fascia trim members 110, 112 to the modular wall. The outwardly extending portions 147 may be outwardly extending in the wall thickness or depth direction.

The inner component 143 may have a u-shaped configuration with bight portion 151 and two legs 149. The outer surfaces of the legs 149 may have ribbed configuration/portions 153. The inner surfaces of the outer component 145 may include inwardly radially protruding portions 155 (e.g., protruding into the channel of the outer component 145). The inwardly radially protruding portions 155 of the outer component 145 may be configured to engage with the ribbed portions 153 of the inner component 143 to adjust the positioning of the fascia trim members 110, 112 that are being removably attached to the modular wall.

The adjustable façade mount 141 may be positioned at spaced apart locations along the modular wall. The adjustable façade mount 141 may be easily snapped into pace (by the engagement between the outwardly extending portions 147 and portion of the fascia trim members 110, 112) without the need for any attachment hardware.

The top and bottom framing elements in FIGS. 18A-18D may be mixed and matched between the low profile and adjustment height configurations so as to achieve desired aesthetic appearance and also providing more adjustment capabilities.

Figure 21:
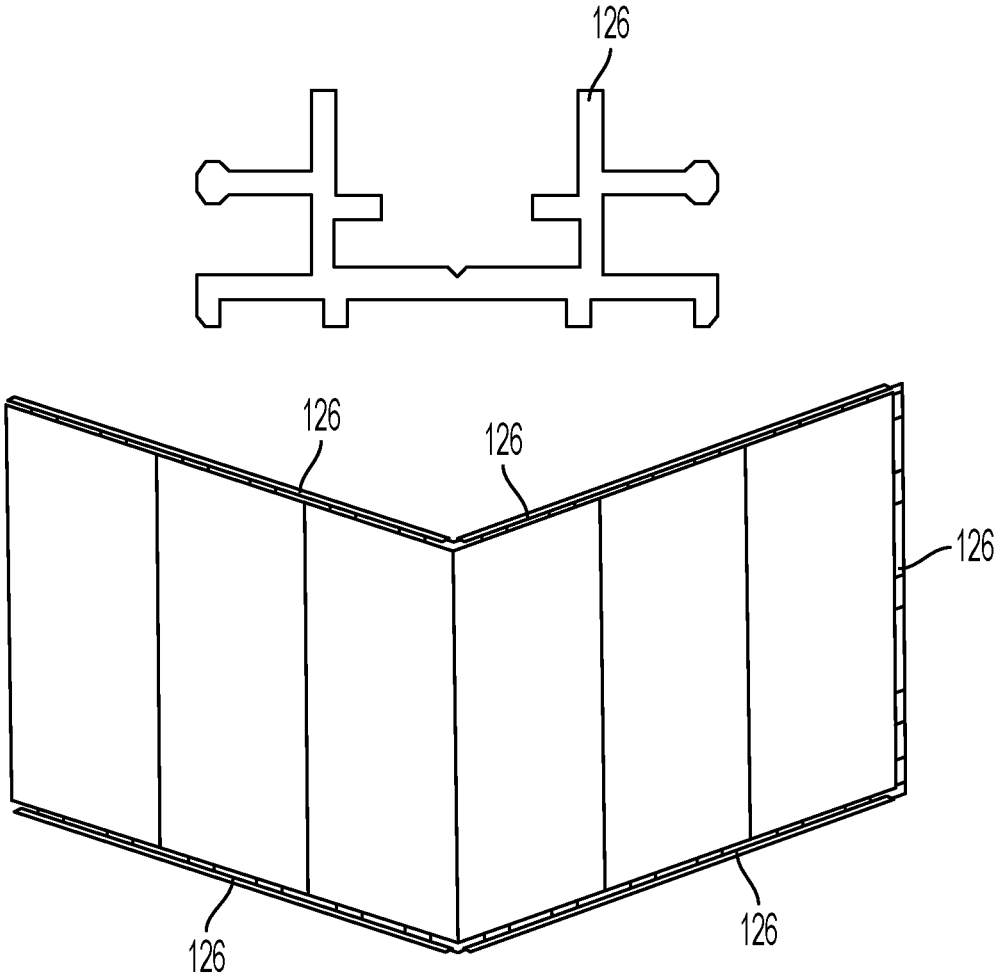
FIG. 21 shows a cross-sectional view of a floor base member/track of the modular wall in accordance with an embodiment of the present patent application, where FIG. 21 also shows a perspective view of the modular wall with the floor base member/tack installed thereon.

FIG. 21 shows a cross-sectional view of a floor base member 126 of the modular wall. FIG. 21 also shows a perspective view of the modular wall with the floor base member installed thereon. For example, the same floor base member may be used in the vertical/wall/corner portions, the ceiling portions, and/or the floor portions of the modular wall.

Figure 22:
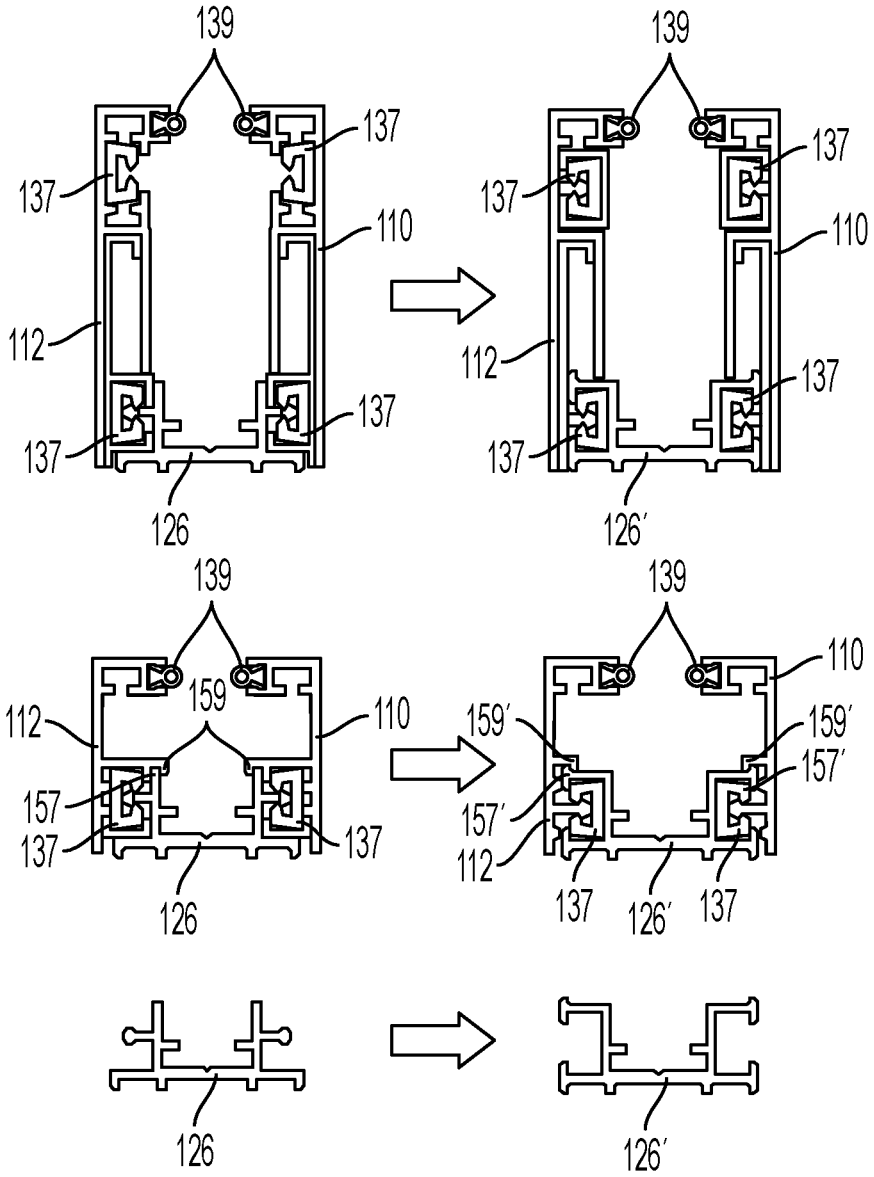
FIG. 22 shows side by side comparison of cross-sectional views of portions of the modular wall using two different types of floor base members in accordance with an embodiment of the present patent application.

FIG. 22 shows side by side comparison of cross-sectional views of portions of the modular wall using two different types of floor base members 126 and 126'. The two top figures of FIG. 22 show the adjustable height configuration modular walls using different types of floor base members 126 and 126'. The two middle figures of FIG. 22 show the low profile configuration modular walls using different types of floor base members 126 and 126'. The two bottom figures of FIG. 22 show just two different types of floor base members 126 and 126'. The floor base members 126 and 126' may have different male/female engagement portions that are configured to removably attach the fascia trim members 110, 112 to the modular wall.

Reversing the male and female parts of the façade connections, as shown in FIG. 22, may have many benefits. For example, these benefits may include frame extrusion that is easier to screw into from the top if needed, stronger frame extrusion, low profile ceiling extrusion works better and easier assembly.

Referring to FIG. 22, the design of the base member 126' (on the right) is preferred because the resilient members 137 can stay in the channel on the base member 126', which avoids the need for including it on the replacement trim 110, 112 (and reduces the cost/complexity of the replacement trim 110, 112). The resilient members 137 may interchangeably referred to as clips 137. The design of the base member 126' may also be advantageous if you want to make the base member 126' out of something more structurally rigid, like metal material or a reinforced plastic material, as using the additional part 137 as an insert into the base member 126' can provide some resiliency for making the connection with the finger on the trim member 110, 112.

In the modified configuration (on the right side of FIG. 22), the assembly of trim 110, 112 onto base track/member 126' is easier due to the visibility of the clips 137 inserted into the channel detail/profile of 126'. The clip 137 does not need to run the entire length of base track 126' to save in cost and, therefore, may be cut to various lengths and numbers to regulate the assembly holding force. The channel detail/profile of the base track/member 126' is also configured to accommodate the easy insertion of a variety of differing clip profiles in the future, the adjustment of their location, etc. The visual reference of the inserted attachment points gives the floor/base track/member 126', in the illustrated embodiment, additional advantageous capabilities.

Figure 23:
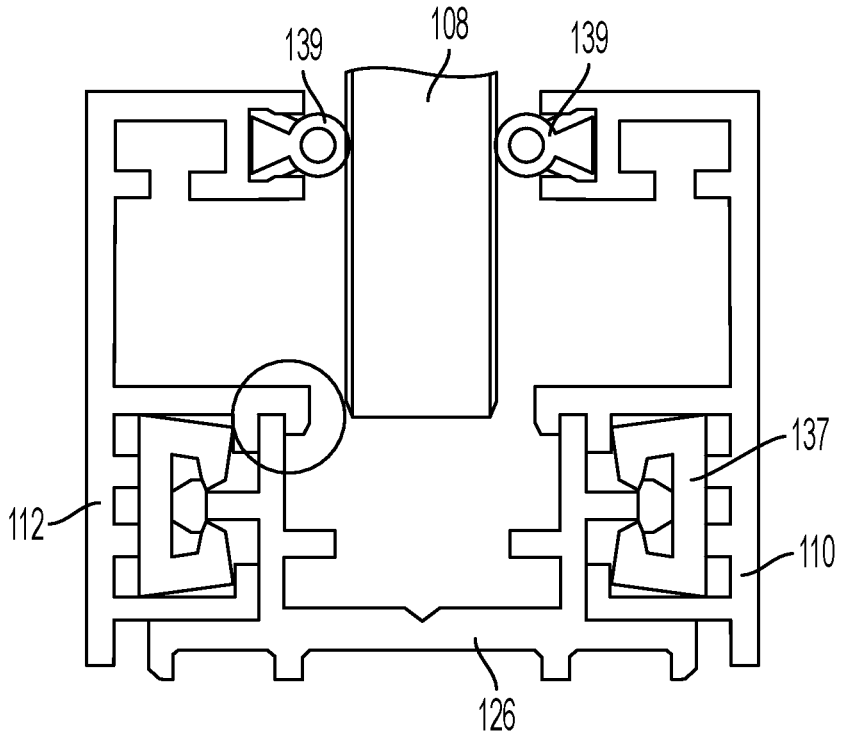
FIG. 23 shows a cross-sectional view of portions of the modular wall in accordance with an embodiment of the present patent application.

FIG. 23 shows a cross-sectional view of portions of the low profile modular wall configuration using the floor base track 126. Instead of having two male and female portions/snaps as in the regular profile (e.g., see right and left top figures in FIG. 22), the low profile may be configured to capture the top edge 157 of the frame extrusion 126 while the upper section 159 of the low profile is pressed against the panel 108. Similar configuration is provided in the low profile configuration using the floor base member 126' is shown in the middle right figure of FIG. 22.

Figure 24:
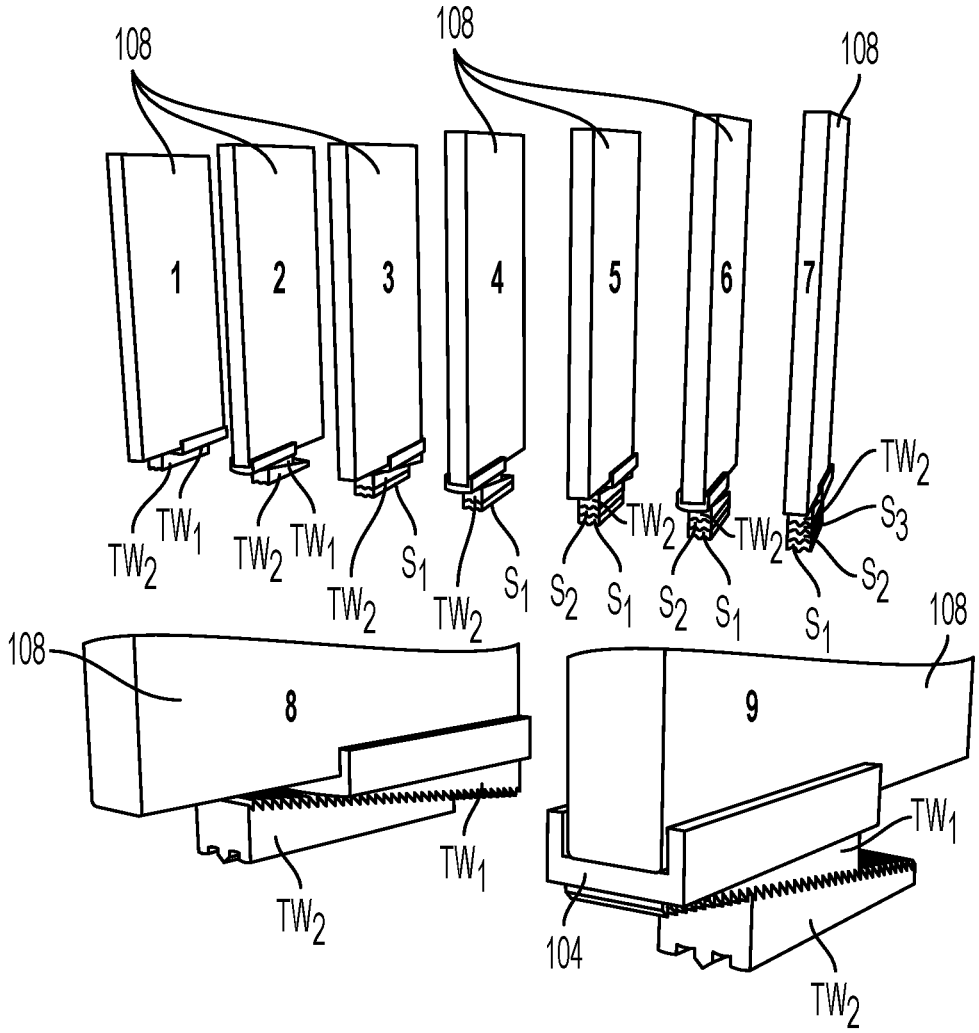
FIG. 24 shows perspective views of a low profile modular wall and a leveling/height adjustment system therefor in accordance with an embodiment of the present patent application, where

In one embodiment, as shown in FIG. 24, the low profile design may be configured to allow for leveling and height adjustment at the base of up to 0.6 inch with a toothed wedge system ($TW_1$ and $TW_2$) and 0.2 inch (for example) shim system (see $S_1$, $S_2$, $S_3$) that allows for 0.01 inch adjustments. Referring to FIG. 24, modular walls 1-2 and 8-9 show two wedge shaped members $TW_1$ and $TW_2$. Surfaces of the first wedge shaped member $TW_1$ and the second wedge shaped member $TW_2$ may be inclined at the same angle. Teeth formed on the surfaces of the first wedge shaped member $TW_1$ and the second wedge shaped member $TW_2$ may be configured to interengage with each other to enable movement of the first wedge shaped member $TW_1$ with respect to the second wedge shaped member $TW_2$, but prevent such movement when pressure is applied (such as the weight of the panel/components down against the upper wedge to engage its teeth with the lower wedge against movement therebetween. The two wedge shaped members $TW_1$ and $TW_2$ may have the same length and width and may also guide members thereon to aid in the movement of the first wedge shaped member $TW_1$ with respect to the second wedge shaped member $TW_2$. These wedge members are a marked improvement over crude shims that simply force a piece of material into a space adjust a panel.

Modular wall in positions 1, 2, 8 and 9 in FIG. 24 show the height adjustment obtained using the two wedge shaped members $TW_1$ and $TW_2$ (and with no shims). For example, the modular wall in the positions 1 and 8 is in its lowest height adjusted position and the modular wall in the positions 2 and 9 is in its highest height adjusted position.

Modular wall in positions 3 and 4 in FIG. 24 show the height adjustment obtained using the two wedge shaped members $TW_1$ and $TW_2$ and with one shim $S_1$. For example, the modular wall in the position 3 is in its lowest height adjusted position and the modular wall in the position 4 is in its highest height adjusted position.

Modular wall in positions 5 and 6 in FIG. 24 show the height adjustment obtained using the two wedge shaped members $TW_1$ and $TW_2$ and with two shims $S_1$ and $S_2$. For example, the modular wall in the position 5 is in its lowest height adjusted position and the modular wall in the position 6 is in its highest height adjusted position.

Modular wall in position 7 in FIG. 24 show the height adjustment obtained using the two wedge shaped members $TW_1$ and $TW_2$ and with three shims $S_1$, $S_2$ and $S_3$. The number of shim members may vary.

Figure 25:
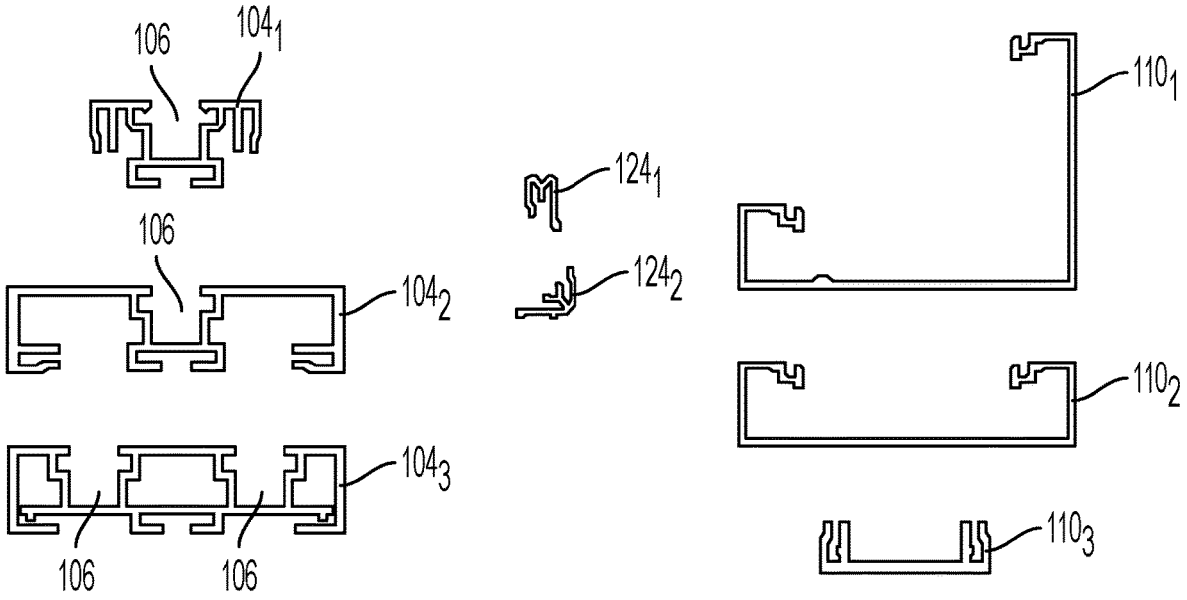
FIG. 25 shows various exemplary semi-structural members, connector members, and cover members that are used in a system of reconfiguring a modular wall in accordance with an embodiment of the present patent application.

FIG. 25 shows various exemplary semi-structural members, connector members, and cover members that are used in the system 100 of reconfiguring a modular wall. For example, the system 100 may include semi-structural extrusions (panel receiver structure) $\mathbf{104_1}$, $\mathbf{104_2}$, and $\mathbf{104_3}$. The semi-structural extrusions $\mathbf{104_1}$ and $\mathbf{104_2}$ may be configured to receive a single panel in a channel 106 therein. The semi-structural extrusion $\mathbf{104_1}$ and $\mathbf{104_3}$ may be configured to receive double panels in channels 106 therein. Each of the semi-structural extrusions $\mathbf{104_1}$, $\mathbf{104_2}$ and $\mathbf{104_3}$ may have portions configured to connect with other of the semi-structural extrusions $\mathbf{104_1}$, $\mathbf{104_2}$ and $\mathbf{104_3}$ and/or with fascia trim members $\mathbf{110_1}$, $\mathbf{110_2}$, $\mathbf{110_3}$ using one or more connectors $\mathbf{124_1}$ and $\mathbf{124_2}$. That is, the portions the semi-structural extrusion may be configured to receive or engage with at least some portions of the connector when one of the semi-structural extrusions $\mathbf{104_1}$, $\mathbf{104_2}$ and $\mathbf{104_3}$ is being connected to other of the semi-structural extrusions $\mathbf{104_1}$, $\mathbf{104_2}$ and $\mathbf{104_3}$ and/or to fascia trim members $\mathbf{110_1}$, $\mathbf{110_2}$, $\mathbf{110_3}$. The one or more connectors $\mathbf{124_1}$ and $\mathbf{124_2}$ may be made of a plastic material. The one or more connectors $\mathbf{124_1}$ and $\mathbf{124_2}$ may be made of metal or other materials.

The system 100 may be configured to utilize a few extrusions to cover the vast majority of installation types. The system 100 may also be configured to provide adaptability. That is, junctions can be added or changed without demounting the existing wall systems. As can seen FIGS. 26-27, corners and junctions may be easily configurable using the extrusions shown in FIG. 25.

Figure 26:
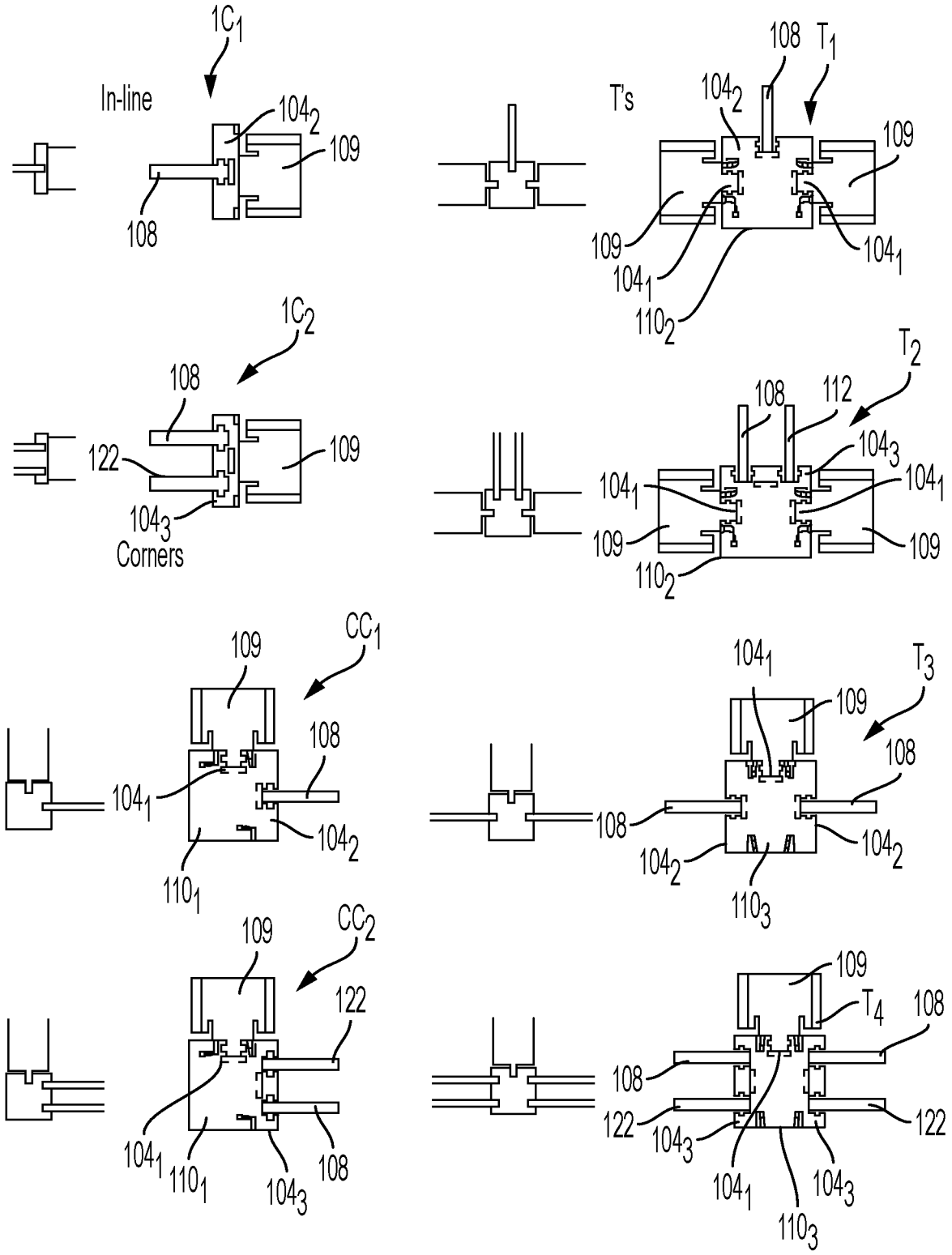
FIG. 26 shows various exemplary configurations of the modular wall in accordance with an embodiment of the present patent application, where

FIG. 26 shows two exemplary inline configurations $IC_1$ and $IC_2$; two corner exemplary configurations $CC_1$ and $CC_2$; and four exemplary T configurations $T_1$, $T_2$, $T_3$ and $T_4$. All these configurations are formed using the extrusions (e.g., $\mathbf{104_1}$,$\mathbf{104_2}$,$\mathbf{104_3}$,$\mathbf{124_1}$, $\mathbf{124_2}$, $\mathbf{110_1}$, $\mathbf{110_2}$, $\mathbf{110_3}$) shown in FIG. 25.

For example, the inline configuration $IC_1$ may use the semi-structural extrusion $\mathbf{104_2}$, and the inline configuration $IC_2$ uses the semi-structural extrusion $\mathbf{104_3}$. The inline configuration $IC_1$ may be configured to transition from a solid wall 109 configuration to a single panel 108 configuration. The inline configuration $IC_2$ may be configured to transition from a solid wall 109 configuration to double panels 108, 122 configuration.

The corner configuration $CC_1$ may use the semi-structural extrusions $\mathbf{104_1}$ and $\mathbf{104_2}$, the façade/cover extrusion $\mathbf{110_1}$, and the connectors $\mathbf{124_1}$ and $\mathbf{124_2}$. The corner configuration $CC_1$ may be configured to provide a solid wall 109 configuration on one side of the corner and a single panel 108 configuration on the adjacent perpendicular side of the corner.

The corner configuration $CC_2$ may use the semi-structural extrusions $\mathbf{104_1}$ and $\mathbf{104_3}$, the façade/cover extrusion $\mathbf{110_1}$, and the connectors $\mathbf{124_1}$ and $\mathbf{124_2}$. The corner configuration $CC_2$ may be configured to provide a solid wall 109 configuration on one side of the corner and double panel 108, 122 configuration on the adjacent perpendicular side of the corner.

The T-shaped configuration $T_1$ may use semi-structural extrusions $\mathbf{104_2}$ and (two of) $\mathbf{104_1}$, the façade/cover extrusion $\mathbf{110_2}$, and the connectors $\mathbf{124_1}$ and $\mathbf{124_2}$. The T-shaped configuration $T_1$ may be configured to provide solid wall 109 configuration on two opposing sides of the corner and a single panel 108 configuration on the adjacent perpendicular side of the corner.

The T-shaped configuration $T_2$ may use semi-structural extrusions $\mathbf{104_3}$ and (two of) $\mathbf{104_1}$, the façade/cover extrusion $\mathbf{110_2}$, and the connectors $\mathbf{124_1}$ and $\mathbf{124_2}$. The T-shaped configuration $T_2$ may be configured to provide solid wall 109 configuration on two opposing sides of the corner and a two panel 108, 122 configuration on the adjacent perpendicular side of the corner.

The T-shaped configuration $T_3$ may use semi-structural extrusions $\mathbf{104_1}$ and (two of) $\mathbf{104_2}$, the façade/cover extrusion $\mathbf{110_3}$, and the connectors $\mathbf{124_1}$ and $\mathbf{124_2}$. The T-shaped configuration $T_3$ may be configured to provide solid wall 109 configuration on one side of the corner and a two single panel 108 configuration on the two opposing sides of the corner.

The T-shaped configuration $T_4$ may use semi-structural extrusions $\mathbf{104_1}$ and (two of) $\mathbf{104_3}$, the façade/cover extrusion $110_3$, and the connectors $124_1$ and $124_2$. The T-shaped configuration $T_4$ may be configured to provide solid wall 109 configuration on one side of the corner and two panel 108, 122 configuration on the two opposing sides of the corner.

These are just a few exemplary configurations that may be obtained using the semi-structural extrusions, façade/cover, and the connector members shown in FIG. 25.

Figure 27:
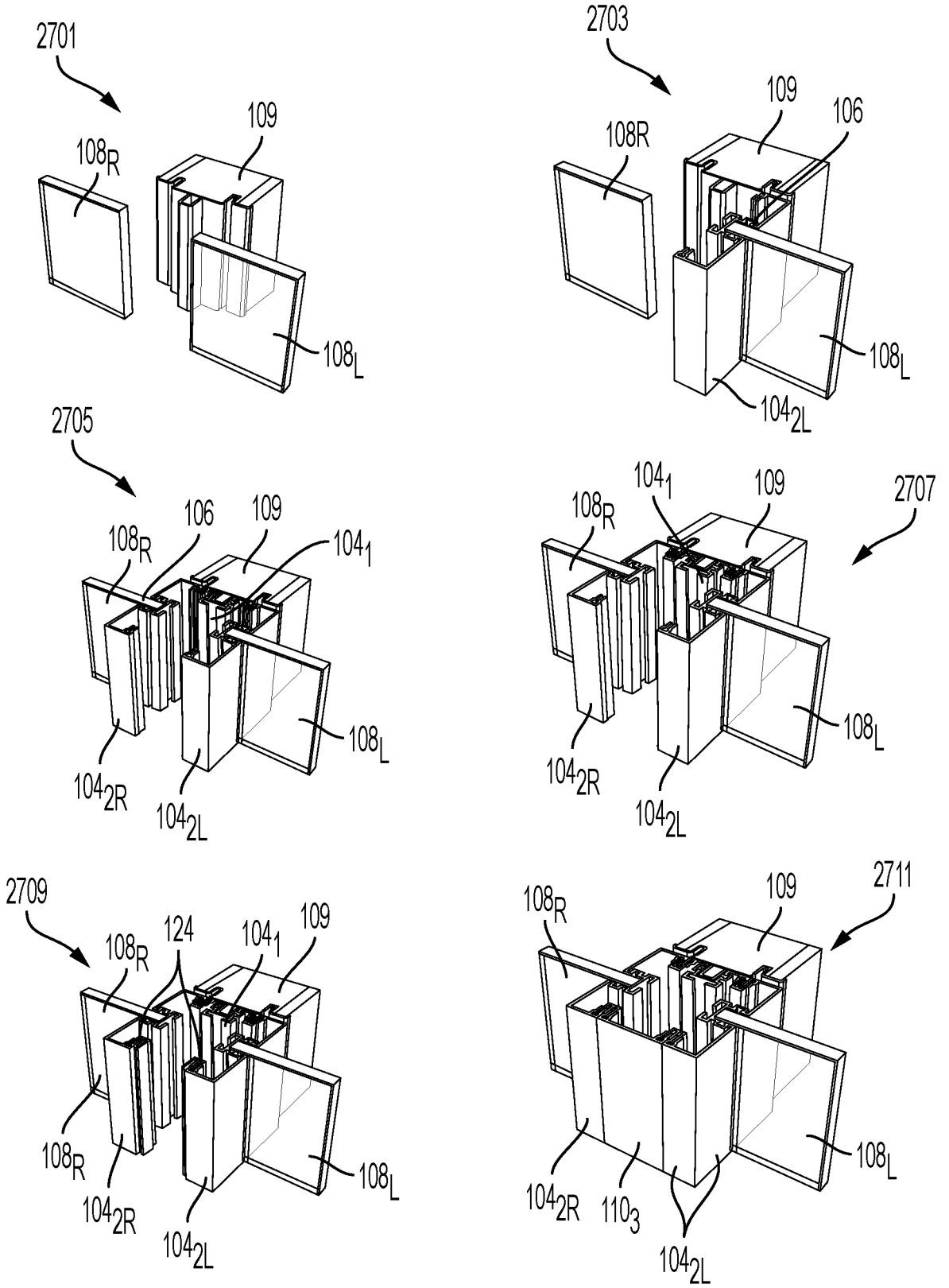
FIG. 27 shows various procedures in a method of configuring a corner or T-shaped joint configuration of the modular wall in accordance with an embodiment of the present patent application.

FIG. 27 show a step by step procedure of forming the T-shaped configuration $T_3$. At procedure 2701, a solid wall 109 and two panels $108_L$ and $108_R$ may be positioned to form a corner or T-shaped arrangement such that the two panels $108_L$ and $108_R$ are facing opposing directions and are perpendicular to the solid wall 109. At procedure 2703, the semi-structural extrusion $104_{2L}$ may be positioned in place such that the panel $108_L$ is received in the channel 106 of the semi-structural extrusion $104_2$. At procedure 2705, the semi-structural extrusion $104_{2R}$ is positioned in place such that the panel $108_R$ is received in the channel 106 of the semi-structural extrusion $104_{2R}$ and also the semi-structural extrusion $104_1$ is positioned in place such that portions of the solid wall are received in the channel of the semi-structural extrusion $104_1$.

At procedures 2707 and 2709, two connector members $124_1$ are used to connect the semi-structural extrusion $104_{2L}$ and the semi-structural extrusion $104_1$ and to connect the semi-structural extrusion $104_{2R}$ and the semi-structural extrusion $104_1$. Also, two additional connector members $124_1$ may be positioned in place, one at the interface between the semi-structural extrusion $104_{2L}$ and the fascia trim member $110_3$ and the other at the interface between the semi-structural extrusion $104_{2R}$ and the fascia trim member $110_3$.

At procedure 2711, the fascia trim member $110_3$ is connected to the semi-structural extrusion $104_{2L}$ at one end and to the semi-structural extrusion $104_{2R}$ at the other end using the connector members $124_1$ already positioned in place at procedure 2709.

Figures 28A, 28B, 28C:
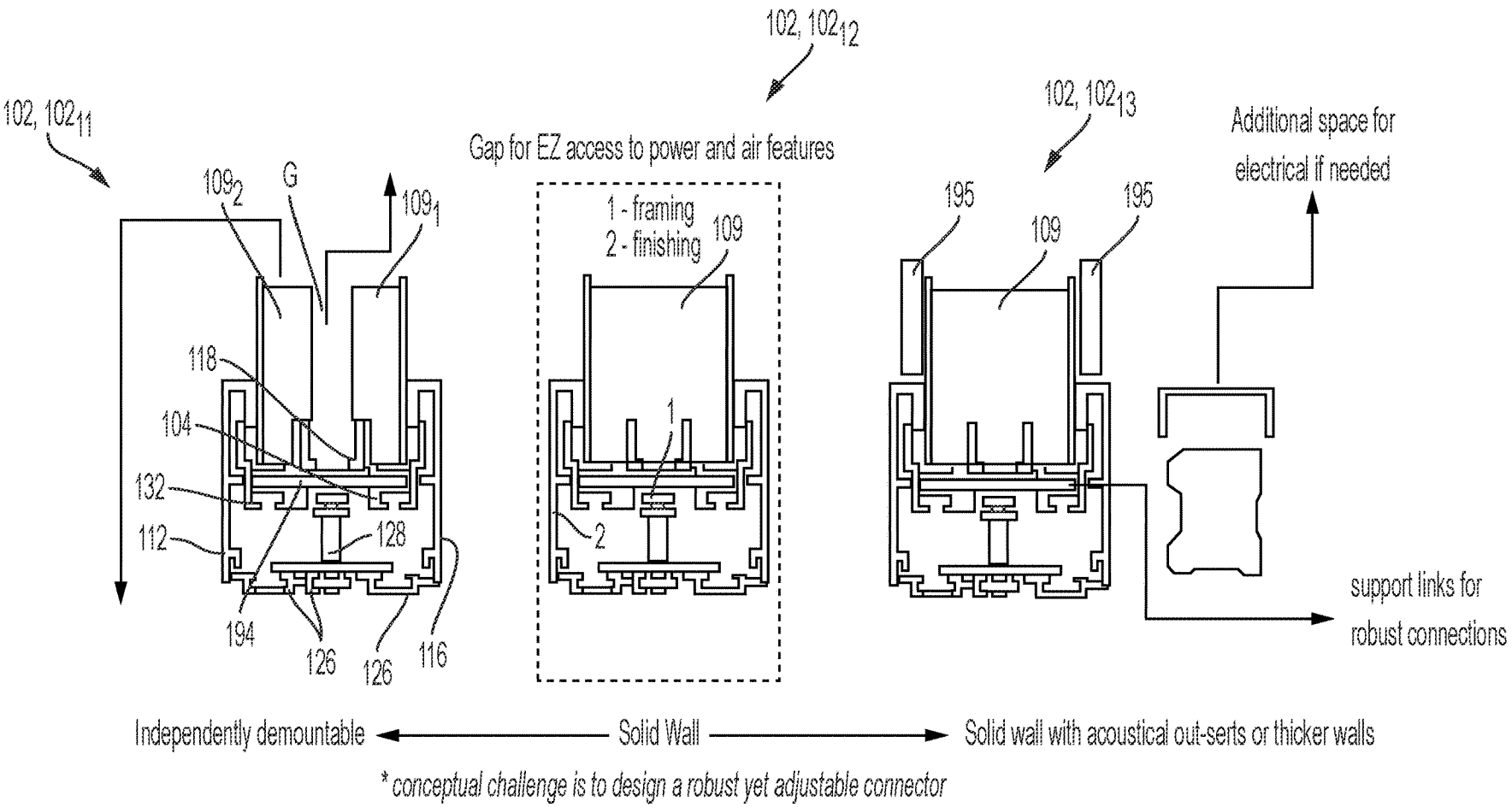
FIG. 28A, FIG. 28B and FIG. 28C show various exemplary configurations of a modular wall that may be easily reconfigured between different configurations in accordance with an embodiment of the present patent application, where

FIG. 28A, FIG. 28B and FIG. 28C show various exemplary configurations of a modular wall that may be easily reconfigured between different configurations. FIGS. 28A-C show front cross-sectional views of a double panel configuration, a single panel configuration, a single panel configuration with outserts, respectively. FIG. 28A, FIG. 28B and FIG. 28C also show a cross-sectional view of an additional space in the modular wall that is configured to receive electrical components. The fascia can be changed out to one with a wider or deeper profile to provide the additional space, such as for containing an electrical junction box or a run space for wiring, etc.

The modular wall $102_{11}$, $102_{12}$, $102_{13}$ of FIGS. 28A-C may have somewhat similar configuration to the modular walls described in FIGS. 1C-1D, and the differences between them are described in detail below. The modular wall $102_{11}$, $102_{12}$, $102_{13}$ of FIGS. 28A-C may be configured to support solid wall(s) (instead of the glass panel(s) of FIGS. 1C-1D).

In FIG. 28A, the modular wall $102_{11}$ may include two solid panels $109_1$ and $109_2$ that are received and supported by two spaced part panel receiver members 104, 132. The two panel receiver members 104, 132 are spaced apart by positioning the panel receiver member 118 therebetween. The modular wall $102_{11}$ may include three floor tracks 126 and a single height adjustment unit 126. The height adjustment unit 126 may be positioned such that one end of the height adjustment unit 126 is received by and connected with the panel receiver member 118 and the other end of the height adjustment unit 126 is received by and connected with the middle floor track 126. The modular wall $102_{11}$ may also include two fascia trim members 110, 112. The spaced apart configuration of the modular wall $102_{11}$ (i.e., gap G between the solid panels $109_1$ and $109_2$) may be configured for easy access to power and air features of the modular wall. The modular wall $102_{11}$ may include support link 194 that is configured to connect panel receiver members 104, 118, 132 to each other. This configuration may allow for each side of the wall $102_{11}$ to be demounted from its side independently as described in detail with respect to FIGS. 1A-1F.

The modular wall $102_{12}$ in FIG. 28B may include similar construction as the modular wall $102_{11}$, except a single panel receiver member (instead of three panel receiver member in FIG. 28A) may be used to receive the single solid wall 109. The single solid wall 109 of the modular wall $102_{12}$ in FIG. 28B has a thickness more than the thickness of each of the solid panels $109_1$ and $109_2$ in the modular wall $102_{11}$ in FIG. 28A.

The modular wall $102_{13}$ in FIG. 28C may include similar construction as the modular wall $102_{12}$, except outserts 195 may be positioned on either side of the single solid wall 109. The additional outserts 195 may include wall element that protrudes more than the base thickness. The additional outserts 195 typically may be independently removed and upgraded as well. The outserts 195 may be framed glass elements in addition to solid wall like materials. The modular wall $102_{13}$ in FIG. 28C, thus, may provide solid wall with acoustical outserts or thicker walls. The outserts may also be decorative elements also. These outserts may be attached or connected to the modular wall using any methods or attachment systems that would be appreciated by one skilled in the art. The same fascia trim members 110, 112 may be used for all the designs in FIG. 28. The panels in FIG. 28A may be accessed from one side, and thus enable a wall panel to be swapped out with most or all work conducted from one side of the wall.

Figure 29:
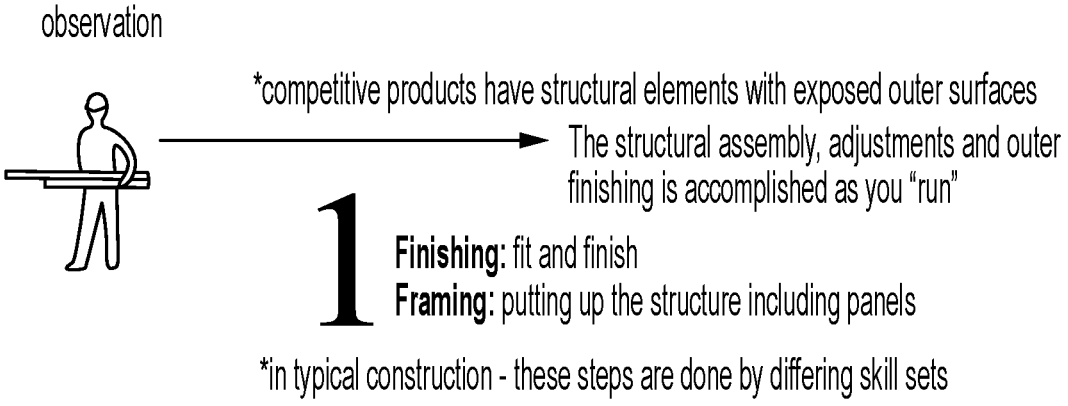
FIG. 29 PRIOR ART
FIG. 29 shows procedures in a prior art method of assembling a modular wall.

FIG. 29 shows procedures in a prior art method of assembling a modular wall. In the prior art, the framing and finishing are performed together in a single phase process/procedure. That is, the structural assembly, adjustments and the outer finishing are all accomplished in this single phase procedure. The structural components used for framing generally include exposed finished surfaces (i.e., surfaces that finish the modular wall). Therefore, the exposed finished surfaces of the structural components are generally prone to damage from mishandling during the framing, and also to miss measuring and cutting during the framing.

Figure 30:
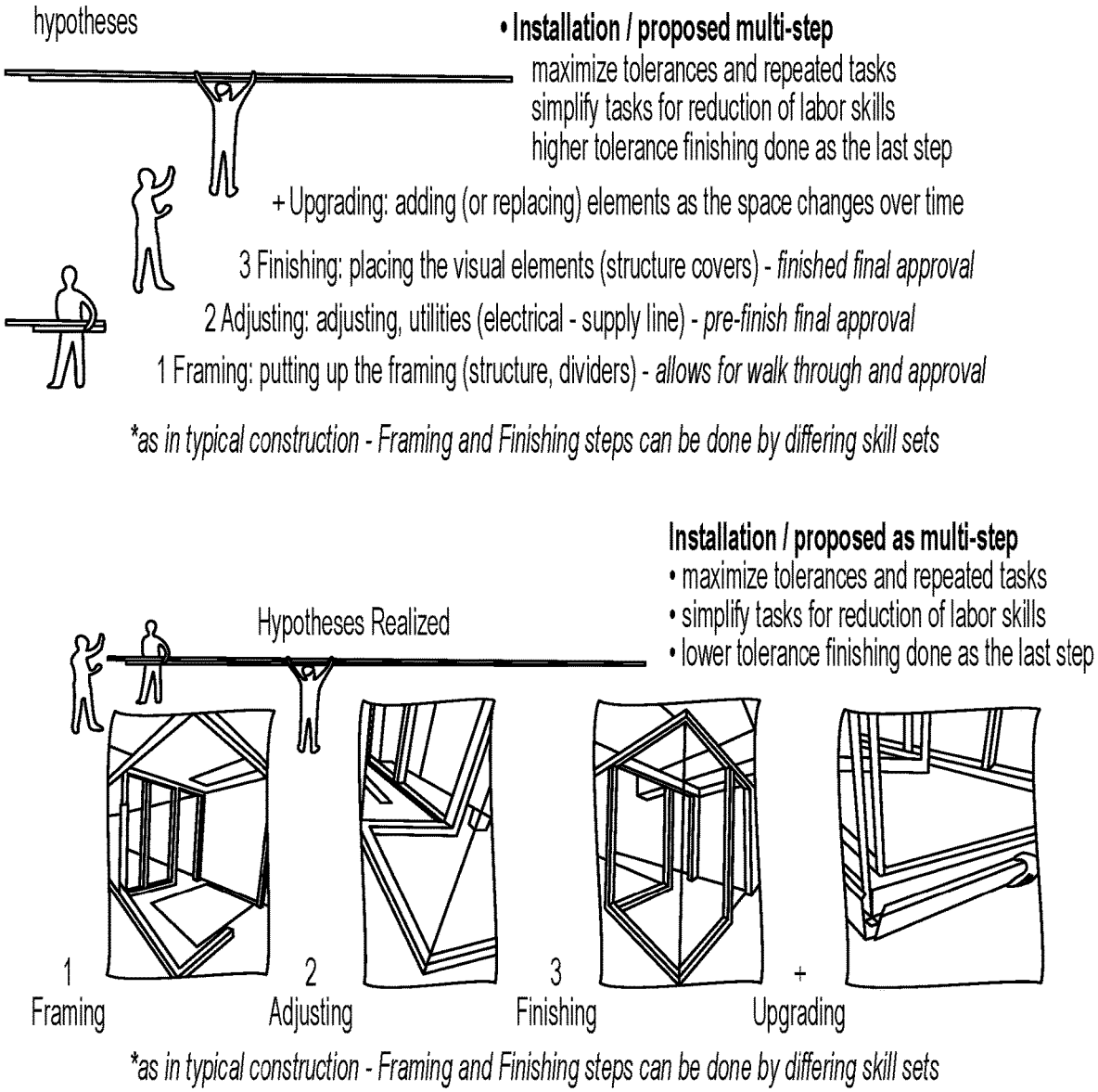
FIG. 30, FIG. 31A and FIG. 31B show procedures in a method of assembling a modular wall in accordance with an embodiment of the present patent application.
Figure 31A:
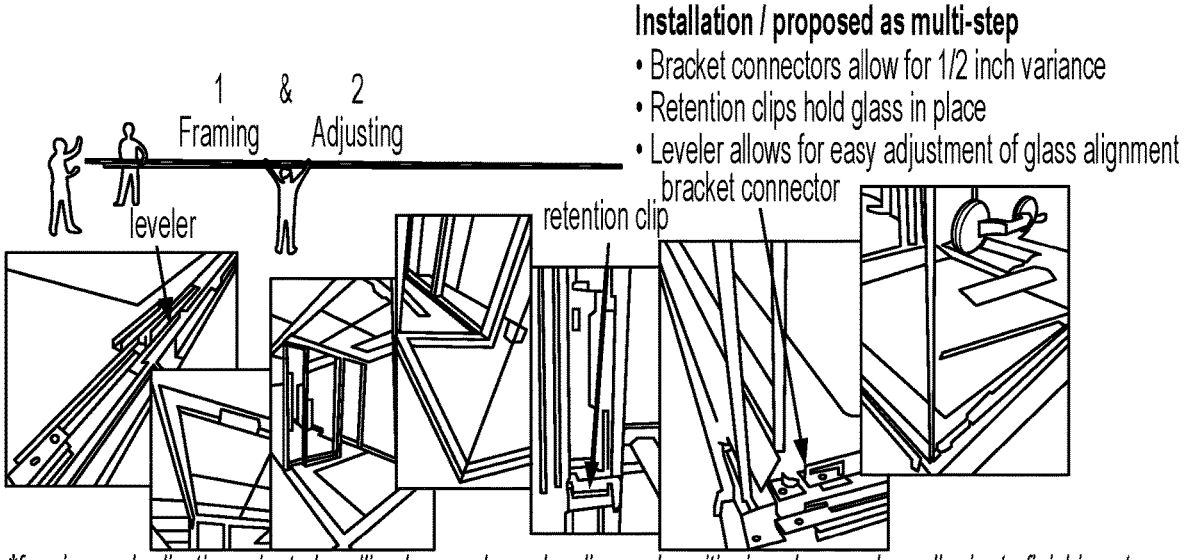
Figure 31B:
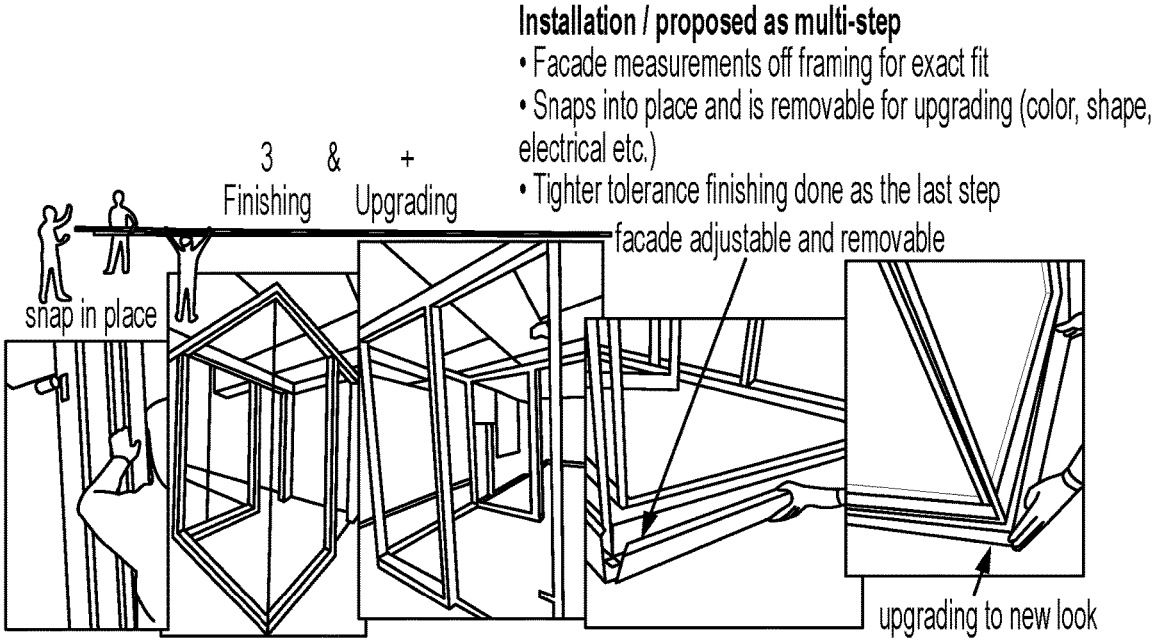

FIG. 30, FIG. 31A and FIG. 31B show procedures in a method of assembling a modular wall in accordance with an embodiment of the present patent application. Modular wall assembly components described in the present patent application are designed to allow for a unique two-phase process that overcome the issues/problems of the prior art discussed above with respect to FIG. 29. For example, the unique two-phase process of the present patent application may include a framing phase and a finishing phase.

The framing phase may include installation of the framing elements (e.g., panel receiving structures, height adjustment units, connectors, floor/wall tracks, etc.) that provide the supportive understructure for the modular walls. That is, the framing phase may include installation of non-exposed structural elements of the modular walls. The framing phase may also include putting up the framing (e.g., structure, dividers). Since only the framing is up, confirmational walkthroughs, adjustments and approvals may be made freely without damaging any visual elements. So, in other words, repetitive install, teardowns and re-installing of parts may be done without effecting the final exposed finish elements to ensure dimensions and spaces are as specified and desired.

Additional on-site utilities (e.g., electrical, communications, and supply lines) may also be installed and/or connected during this framing phase. The framing phase may also include adjusting of the utilities as specified and desired.

FIG. 31A shows framing (and adjusting) phase, which may include multi-step procedures. The framing and adjusting procedures may be performed prior to handling the panels (e.g., heavy glass). Leveling and positioning of the panels may also work well prior to the finishing phase. FIG. 31A shows bracket connectors that allow for ½ inch variance, retention clips that are configured to hold panel/glass in place, and a leveler that may allow for easy adjustment of the panel/glass alignment. The adjustability and larger tolerance framing supports glass and walls.

The (second) finishing phase may include installation of (exposed) visual elements (e.g., structure covers) and surfaces. The wall element (e.g., glass, framed glass or wall panel or unitized assembly) may also be installed, leveled, and adjusted and then the trim, façade, and/or casing elements (some of these terms are interchangeable since they behave in similar manners) are cut to size with some trim needing more expertise fitting and miter cuts for a precise and clean look. The façade/casing is assembled last. The finishing phase also may include upgrading the modular walls, for example, by adding or replacing elements as the space changes over time.

FIG. 31B shows finishing (and upgrading) phase, which may include multi-step procedures. FIG. 31B shows various pictures of a finished assembly of adjustable profile with dual glass with reutilized clear wall door. Measurements of the exposed visual elements and surfaces (e.g., façade) may be based on the framing (done in the previous phase) allowing for an exact fit. The exposed visual elements and surfaces may be easily snapped into place, and may also be easily adjustable/removable for upgrading (color, shape, electrical, etc.) to new look.

Figure 32A:
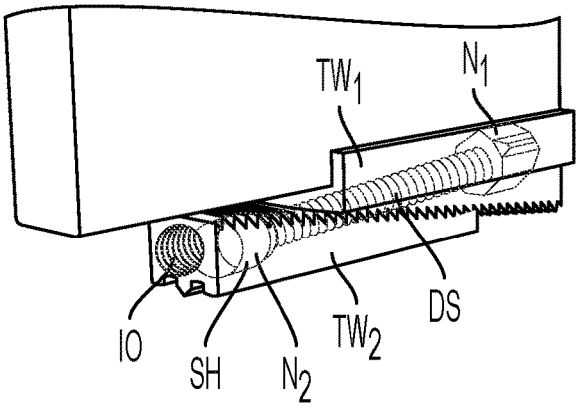
FIG. 32A and FIG. 32B show an alternative design for the wedge height adjuster for operation by a rotatable tool.
Figure 32B:
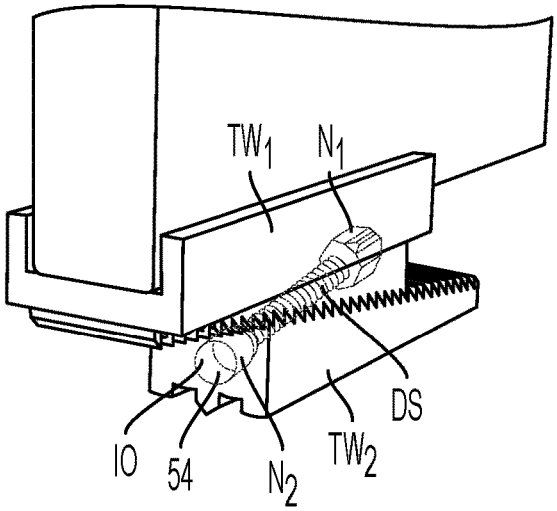

FIGS. 32A-B show an alternative design for the wedge height adjuster discussed above. In this design, the sawtooth profile is illustrated, but optional and the wedge-shaped members may have flat surfaces that engage with one another. In FIG. 32A and FIG. 32B, the wedge-shaped members $TW_1$ and $TW_2$ have a drive screw DS extending therebetween. One of the wedge members may have an input opening 10 for receiving a drive tool, such as a rotatable device with a socket, a screwdriver, a drill-driven screwdriver bit or socket, or a crank or jack tool similar to those used in vehicle jacks. In the illustrated design, as a non-limiting example, the head SH of the drive screw has a crossing slots for a Phillips head screwdriver or drill bit. The drive tool engages a head on the drive screw DS to rotate the drive screw DS, which in turn moves the wedges $TW_1$ and $TW_2$ relative to one another. Specifically, as the drive screw DS is rotated in one direction, the wedges are $TW_1$ and $TW_2$ driven relatively toward one another so as to slide along one another to raise the wall section. As the drive screw DS is rotated in the opposite direction, the wedge-shaped members $TW_1$ and $TW_2$ move relatively away from one another to lower the wall section. The drive screw DS is threaded and received in nuts N1 and N2 or other bodies with internal threads mounted within the body of each wedge member $TW_1$ and $TW_2$. The internally threaded bodies may be traditional nuts as shown. They may also have other configurations, such as being barrel shaped or cylindrical cylinders with an axis oriented perpendicular to the drive screw, and the threaded hole through the diameter thereof for receiving the drive screw. It is possible for only one of the bodies to be internally threaded, with the other body being non-threaded so that the drive screw rotates inside it in a passive manner. It is also possible to practice this design with only one internally threaded body. For example, the drive screw DS may have a head forced against a surface of its associated wedge-shaped member, and is received in an internally threaded body on the other wedge-shaped member. However, it is implemented, it is preferred that the body or bodies used be mounted so they can move to accommodate the change of angle of the drive screw DS as the wedge shaped members $TW_1$ and $TW_2$ move toward and away from one another, such as by pivoting. For example, a barrel shaped body can have its axial ends mounted in corresponding openings in its associated wedge shaped member to allow for pivoting movement. With a more traditional nut with flat sides, the nut could be mounted between vertical flat walls that prevent the nut from rotating, but allow for pivoting movement to accommodate the change in angle of the drive screw DS. The wedge shaped members $TW_1$ and $TW_2$ may also include slots on the engaged faces thereof to enable the drive screw DS to extend therebetween and accommodate the change in angle. This non-limiting embodiment has the advantage that the height adjustment can be accomplished by use of a tool as the driving input, rather than manually moving the wedge-shaped members directly.

The framing and finishing phases of the present patent application enable installation of framing/structural elements first and then performing the finishing tasks. The framing and finishing phases also allow for the structure of the modular walls to remain in place while updating the other (finishing) elements of the modular walls. The framing and finishing phases may facilitate larger tolerances (i.e., maximize the tolerances) for framing, enable performing repeated tasks, enable simplifying tasks for reduction of labor skills, enable using specialized labor skills for higher skill level tasks, facilitate adjustments & additions, and/or facilitate tighter tolerance for finishing as finishing is the last step. As in typical construction, the framing and finishing steps may be done by differing skill sets. The two-phase process more closely resembles standard construction methods and divisions of skills. The framing steps can be done by individuals with less training and experience since the parts use are not exposed leaving the more skilled assembly team member to allocate their skillsets to the more precise finishing phase. This allows for more efficient allocation of various skill levels within an assembly team.

The present patent application provides reconfigurable features without disrupting structural framing, utilizes the same construction methodology across the lines to ensure true modularity (i.e., simplify); ensures the design over-all reduces the number of parts needed (i.e., simplify); ensures the design reduces the total weight of aluminum needed vs. current product (i.e., cost reduction).

The present patent application ensures the design allows for interchangeability wall components without compromising the structural integrity of the wall (i.e., easy feature upgrades); and ensures the design allows for interchangeability of exterior components without compromising the structural integrity of the wall (i.e., easy feature upgrades). The system of the present patent application may easily be adapted to the customer's and end user's needs today and beyond.

The present patent application provides a solution that is reconfigurable so as to accommodate ever changing requirements and unforeseen needs functionally and visually throughout all the phases and life of the modular wall system. The present patent application ensures the design allows for forgiving tolerances in the structural assembly phase; ensures the design allows for the ability to modify and adjust as to accommodate adding features or elements easily when needed or requested; and once installed, ensures replacement of panels, features, electrical etc. can be done without disrupting the structural integrity of the framing. The present patent application provides visually and conceptually elegant solution that is easy to install and use, robust, and quality driven. This solution addresses broad, expanding, and changing design aesthetics. This solution is conceptually intuitive so as to be innately understandable how the structure is constructed and modified. This solution includes simplification of assembly procedure and assembly elements. This solution is a robust design structurally and constructed with quality in mind.

The purposefully designed two phase assembly parts allow for adaptability during and after the installation process. It has been observed that adjustments to an office layout and design, due to unforeseen as well as standard tolerance issues arise during the onsite assembly processes.

The ability to add the structural elements first, and then review with a client/user as well as inspectors prior to hanging the outer covering/façade elements allow for adjustments to layouts, clearance checks, and pre-inspections to take place saving time and costs as compared to the current state of the art. For example, if the client/user decides during the walkthrough the space and wall placements need to be changed, repositioning as well as additional elements being added are much easier than when a complete finished system has been installed and, therefore, advantageous when compared to the current wall system products.

The present patent application and its various embodiments as described above uniquely address the observed, noted and researched findings and improve on the prior and current state of the art systems. The listed products, features and embodiments as described in the present patent application should not be considered as limiting in any way.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

The illustration of the embodiments of the present patent application should not be taken as restrictive in any way since a myriad of configurations and methods utilizing the present patent application can be realized from what has been disclosed or revealed in the present patent application. The systems, features and embodiments described in the present patent application should not be considered as limiting in any way. The illustrations are representative of possible construction and mechanical embodiments and methods to obtain the desired features. The location and/or the form of any minor design detail or the material specified in the present patent application can be changed and doing so will not be considered new material since the present patent application covers those executions in the broadest form.

The foregoing illustrated embodiments have been provided to illustrate the structural and functional principles of the present patent application and are not intended to be limiting. To the contrary, the present patent application is intended to encompass all modifications, alterations and substitutions within the spirit and scope of the appended claims.

What is claimed is:

1. A method of reconfiguring a modular wall, the wall comprising:

a panel receiver structure with a panel receiving channel;

a vertical panel received in the channel of the panel receiver structure; and first and second fascia trim members each removably attached to opposing first and second sides of the panel receiver structure, said fascia trim members concealing the panel receiver structure;

the method comprising:

removing at least the second fascia trim member;

positioning a second panel receiver structure on the second side of the panel receiver structure, the second panel receiver structure having a second panel receiving channel;

positioning a second vertical panel in the second panel receiving channel to be parallel to said vertical panel; and re-installing the removed second fascia trim member to the second panel receiver structure.

2. A method according to claim 1, wherein the panel receiving structure has a vertical facing channel and the vertical panel is received in the vertical facing channel; and wherein positioning the second panel receiver structure on the second side of the panel receiver structure comprises positioning the second panel receiver structure such that the panel receiving channel thereof is facing vertically.

3. A method according to claim 2, wherein positioning the second vertical panel in the second upwardly facing channel is performed after said positioning the second panel receiver structure.

4. A method according to claim 3, further comprising connecting the first and second receiver structures using a connector member attached to each receiver structure.

5. A method according to claim 4, wherein the connector member is a clip engaging with each inside wall of the first and second upwardly facing channels.

6. A method according to claim 1, wherein the panel is a translucent pane.

7. A method according to claim 6, wherein the translucent pane is a glass panel.

8. A method according to claim 1, wherein the panel receiving structure has a horizontally facing channel and the vertical panel is received in the horizontally facing channel;

wherein positioning the second panel receiver structure on the second side of the panel receiver structure comprises positioning the second panel receiver structure such that the panel receiving channel thereof is facing horizontally.

9. A method according to claim 8, further comprising connecting the first and second receiver structures using a connector member attached to each receiver structure.

10. A method according to claim 9, wherein the connector member is a clip engaging with each inside wall of the first and second upwardly facing channels.

* * * * *